US006183927B1

(12) United States Patent
Magome et al.

(10) Patent No.: US 6,183,927 B1
(45) Date of Patent: Feb. 6, 2001

(54) TONER AND IMAGE FORMING METHOD

(75) Inventors: Michihisa Magome, Shizuoka-ken; Hiroaki Kawakami, Yokohama; Tatsuya Nakamura, Mishima; Tatsuhiko Chiba, Kamakura; Kohji Inaba; Yuji Moriki, both of Susono; Shinya Yachi, Numazu, all of (JP)

(73) Assignee: Canon Kabushiki Kaisha, Tokyo (JP)

( * ) Notice: Under 35 U.S.C. 154(b), the term of this patent shall be extended for 0 days.

(21) Appl. No.: 09/338,422

(22) Filed: Jun. 23, 1999

(30) Foreign Application Priority Data

| | | |
|---|---|---|
| Jun. 24, 1998 | (JP) | 10-177514 |
| Aug. 31, 1998 | (JP) | 10-244599 |
| Jun. 17, 1999 | (JP) | 11-170948 |

(51) Int. Cl.[7] ..... G03G 9/097
(52) U.S. Cl. ..... 430/110; 430/110; 430/126
(58) Field of Search ..... 430/110, 111, 430/126, 127

(56) References Cited

U.S. PATENT DOCUMENTS

| | | | | |
|---|---|---|---|---|
| 5,187,526 | | 2/1993 | Zaretsky | 355/273 |
| 5,747,209 | | 5/1998 | Takiguchi et al. | 430/106.6 |
| 5,915,150 | * | 6/1999 | Kukimoto et al. | 430/111 |
| 5,989,770 | * | 11/1999 | Ugai et al. | 430/110 |
| 5,994,016 | * | 11/1999 | Kuramoto et al. | 430/110 |

FOREIGN PATENT DOCUMENTS

| | | |
|---|---|---|
| 0181081 | 5/1986 | (EP) . |
| 0280272 | 8/1988 | (EP) . |
| 0415727 | 3/1991 | (EP) . |
| 0822456 | 2/1998 | (EP) . |
| 0886187 | 12/1998 | (EP) . |
| 10231 | 7/1961 | (JP) . |
| 013945 | 2/1981 | (JP) . |
| 01573 | 1/1984 | (JP) . |
| 053856 | 3/1984 | (JP) . |
| 061842 | 4/1984 | (JP) . |
| 66559 | 3/1990 | (JP) . |
| 87159 | 3/1990 | (JP) . |
| 146557 | 6/1990 | (JP) . |
| 167566 | 6/1990 | (JP) . |
| 061251 | 3/1993 | (JP) . |
| 222609 | 8/1994 | (JP) . |
| 36316 | 2/1996 | (JP) . |
| 136439 | 5/1996 | (JP) . |
| 127720 | 5/1997 | (JP) . |
| 190006 | 7/1997 | (JP) . |

OTHER PUBLICATIONS

Watanabe, et al; "Compact Page Printer", Fujitsu Sci. Tech. J., vol. 28, No. 4, pp. 473–480 (Dec. 1992).

Patent Abstracts of Japan, vol.199, No. 904, Apr. 1999 for JP11–7164.

Patent Abstracts of Japan, vol. 12, No. 156, (P–701), May 1988 for JP62–273580.

Data Base WPI, Sect. Ch, Wk.8833, Pervent Pub., AN1988–230753 for JP 63–163374.

* cited by examiner

*Primary Examiner*—John Goodrow
(74) *Attorney, Agent, or Firm*—Fitzpatrick, Cella, Harper & Scinto

(57) ABSTRACT

An electrophotographic toner is formed of toner particles each comprising at least a binder resin, a colorant and a release agent, and a low-crystalline aromatic metal compound present at surfaces of the toner particles. The toner has an average circularity of at least 0.955, and the low-crystalline aromatic metal compound has an X-ray diffraction characteristic free from peaks exhibiting a measurement intensity of at least 10000 cps and a half-value half-width of at most 0.3 deg. in a range of measurement angles 2θ of 6 to 40 deg. Because of the low crystallinity, the aromatic metal compound is uniformly applied onto the toner particle surfaces to stabilize the chargeability and transferability of the toner.

84 Claims, 8 Drawing Sheets

TONER AND IMAGE FORMING METHOD

FIELD OF THE INVENTION AND RELATED ART

The present invention relates to a toner for use in a recording method according to electrophotography, electrostatic recording, magnetic recording, toner jetting, etc., and an image forming method using the toner.

Hitherto, there have been known many methods for electrophotography, wherein generally an electrostatic (latent) image is formed on a photosensitive member according to various means by utilizing a photoconductive substance, the electrostatic image is developed with a toner to form a visible image (toner image), and the toner image is, after being transferred to a transfer-receiving material, such as paper, fixed onto the transfer-receiving material under application of heat and/or pressure, to form a fixed image, thereby providing a copy or a print.

In conventional full-color copying machines, there has been generally used a method wherein four photosensitive members are used, and electrostatic latent images formed on the respective photosensitive members are developed with a cyan toner, a magenta toner, a yellow toner and a black toner, respectively, and the resultant respective color toner images are sequentially transferred onto a transfer(-receiving) material carried on a belt-form conveyer to form a full-color image; or a method wherein a single photosensitive member is used in combination with a transfer material-holding member disposed opposite the photosensitive member and carrying a transfer material wound about the holding member, and 4 cycles of development and transfer are repetitively performed to form a full-color image.

Further, image forming methods using an intermediate transfer member have also been proposed, inclusive of a full-color image forming method using a drum-shaped intermediate transfer member (U.S. Pat. No. 5,187,526), and a method wherein a toner image formed of a toner having an average particle size of at most 10 $\mu$m is transferred onto an intermediate transfer member and the toner image on the intermediate transfer member is further transferred onto a transfer material (Japanese Laid-Open Patent Application (JP-A) 59-15739).

In such an image forming method using an intermediate transfer member wherein a toner image formed on a photosensitive member is once transferred onto the intermediate transfer member and then again transferred onto a transfer material, it is necessary to realize a high toner transfer efficiency exceeding the conventional level. Further, compared with the case of using a single black toner as in a monochromatic copying machine, the amount of toners on the intermediate transfer member are increased so that it becomes difficult to increase the transfer efficiency and uniformly transfer the four-color toner images, thus being liable to cause a local transfer failure so-called hollow image (dropout) as illustrated in FIG. 1B.

In an ordinary transfer step, the transfer material and the intermediate transfer member are charged to a polarity opposite to that of the toner, so that the transfer is effected as an electrostatic action. If a transfer bias voltage is increased in such a transfer step, the toner charge is liable to be lowered or the toner is charged to an opposite polarity (these phenomena are hereinafter inclusively referred to as "toner charge leakage") due to a discharge phenomenon caused between the toner and the photosensitive member or between the photosensitive member and the intermediate transfer member, thus being liable to cause so-called back-transfer that a toner once transferred onto a transfer material is transferred back to the photosensitive member. In a process including a plurality of transfer steps as in the above-mentioned full-color image forming method, an earlier transferred image is more liable to cause back-transfer resulting in a lower image density. If such back-transfer is caused, the resultant image is accompanied with an irregularity, thus failing to provide a high-quality image.

Proposals for improving the transfer efficiency by using a toner subjected to mechanical impact have been proposed in JP-A 2-66559, JP-A 2-87159, JP-A 2-146557, JP-A 2-167566 and JP-A 5-61251. These proposals can provide an improved transfer efficiency which however is not sufficient particularly when used in an image forming apparatus using an intermediate transfer member, thus failing to provide a substantial improvement in preventing back-transfer.

As developing methods for visualizing electrostatic latent images, there have been known the cascade developing method, the magnetic brush developing method, the non-magnetic mono-component developing method and the pressure developing method. Further, there is also frequently used the magnetic monocomponent method wherein a layer of magnetic toner is formed on a rotating sleeve enclosing a magnet therein and is caused to jump onto a photosensitive member under the action of an electric field between the photosensitive member and the sleeve.

Such a mono-component developing scheme can provide a small and light developing apparatus as it does not require carrier particles, such as glass beads or iron powder, as required in the two-component developing scheme. Further, in the two-component developing scheme, the toner concentration in the mixture with carrier particles has to be maintained at constant, so that some means is required for detecting the toner concentration and replenishing the toner at a rate as required. These also result in a larger and heavier developing apparatus. Mono-component developing scheme does not require such means and is also preferred in this respect for providing a smaller and lighter developing apparatus.

In recent years, there has been proposed a so-called contact mono-component developing method wherein a semiconductive developing roller or a developing roller having a surface dielectric layer is pressed against a photosensitive member surface to effect development.

In the monocomponent development method, if a distance is present between the photosensitive member and the toner-carrying member, lines of electric force are liable to be concentrated at edges of an electrostatic latent image, thus causing an edge effect that the toner is localized at the edges of the image because the toner is transferred for development along the lines of electric force, thus being liable to lower the image quality.

The edge effect may be alleviated by reducing the gap between the photosensitive member and the toner-carrying member to the minimum, but it is difficult to set the gap between the photosensitive member and the toner-carrying member to be smaller than the toner layer thickness on the toner-carrying member as a matter of mechanical design.

Accordingly, the contact mono-component development method wherein the toner-carrying member is pressed against the photosensitive member to effect the development, is preferred in order to prevent the edge effect. However, if a surface moving velocity of the toner-carrying member identical to that of the photosensitive member is used, it is difficult to obtain a satisfactory image by developing a latent image on the photosensitive member.

Accordingly, in the contact mono-component developing method, the toner-carrying member surface speed is caused to differ from that of the photosensitive member, whereby a portion of the toner on the toner-carrying member is used for developing the latent image on the photosensitive member and another portion of the toner is peeled, thereby providing a developed image which is very faithful to the latent image and free from the edge effect.

As described above, an arrangement of rubbing the photosensitive member surface with the toner and the toner-carrying member is essential in the contact mono-component developing method, the deterioration of the toner is liable to occur during a long term of use, thus resulting in lowerings in toner flowability and uniform chargeability leading to an increased fog and a lower transfer efficiency. Further, along with the lowering in transfer efficiency, the reproducibility of fine dots is lowered to result in inferior image quality.

A study on the contact mono-component non-magnetic developing scheme has been reported in Japan Hardcopy Paper Collection '89, pages 25–28. The paper however does not touch on the toner durability characteristics due to toner deterioration in long term use.

An outline of a printer using the monocomponent contact developing method is reported in FUJITSU Sci. Tech. J. 28.4, pp. 473–480 (December 1992). The durability characteristics of the toner as mentioned above are not sufficient but have left room for improvements.

For providing reduced fog and improved transfer efficiency, JP-A 6-222609 and JP-A 8-036316 have proposed the use of a toner having a specified amount of external additive and a toner including two species of eternal additives in the mono-component contact developing scheme, but the transfer efficiency after a long term of continuous use is not sufficient.

JP-A 9-127720 and JP-A 9-190006 have proposed an external addition of a metal salt compound to a toner, but as a result of actual image evaluation, the fog and transfer efficiency are not yet at unsatisfactory levels.

European Laid-Open Patent Application (EP-A) 822456 has proposed a toner exhibiting at least one heat absorption peak in a temperature region of at least 120° C. on a DSC (differential scanning calorimetry) curve and having a specific circularity distribution for a range of toner particles having particle sizes of 3 $\mu$m or larger so as to suppress the toner back-transfer.

EP-A 886187 discloses that a toner comprising toner particles having a specific circularity distribution and a specific weight-average particle size in combination with external additive particles having an average particle size and a shape factor in specific ranges held on the toner particles, provides high-quality images by faithful reproduction of minute dots while exhibiting a high durability against a mechanical stress in the developing device and causing little toner deterioration.

However, the toners of these two EP references have left room for improvements in suppression of back-transfer and increased transfer efficiency, and also room for improvements in transfer efficiency and suppression of fog in the contact developing scheme.

SUMMARY OF THE INVENTION

A generic object of the present invention is to provide a toner and an image forming method having solved the above-mentioned problems of the prior art.

A more specific object of the present invention is to provide a toner and an image forming method free from back-transfer and capable of providing a high image density.

Another object of the present invention is to provide a toner and an image forming-method exhibiting a high transfer efficiency and providing images of excellent image qualities.

Another object of the present invention is to provide an image forming method exhibiting excellent continuous image forming performances and high transfer efficiency and capable of providing fog-free high-definition images at a high resolution.

According to the present invention, there is provided a toner, comprising: toner particles each comprising at least a binder resin, a colorant and a release agent, and a low-crystalline aromatic metal compound present at surfaces of the toner particles;

wherein said toner has an average circularity of at least 0.955, and said low-crystalline aromatic metal compound has an X-ray diffraction characteristic free from peaks exhibiting a measurement intensity of at least 10000 cps and a half-value half-width of at most 0.3 deg. in a range of measurement angles 2θ of 6 to 40 deg.

According to another aspect of the present invention, there is provided an image forming method, comprising, at least:

a first developing step of developing a first electrostatic image held on an image bearing member with a first toner to form a first toner image on the image bearing member, a first transfer step of transferring the first toner image on the image bearing member onto a transfer member, a second developing step of developing a second electrostatic image held on the image bearing member with a second toner to form a second toner image on the image bearing member, and a second transfer step of transferring the second toner image on the image bearing member onto the transfer member already carrying the first toner image thereon; wherein at least said first toner comprises the above-mentioned toner of the present invention.

According to a further aspect of the present invention, there is provided an image forming method, comprising, at least:

a charging step of charging an image bearing member;

an exposure step of exposing the charged image bearing member to image light to form an electrostatic latent image on the image member, a developing step of developing the electrostatic latent image on an image bearing member with a layer of the above-mentioned toner according to the present invention carried on a toner-carrying member in contact with the image bearing member to form a toner image on the image bearing member, and a transfer step of transferring the toner image on the image bearing member to a transfer member.

These and other objects, features and advantages of the present invention will become more apparent upon a consideration of the following description of the preferred embodiments of the present invention taken in conjunction with the accompanying drawings.

DETAILED DESCRIPTION OF THE INVENTION

Figure 1A:
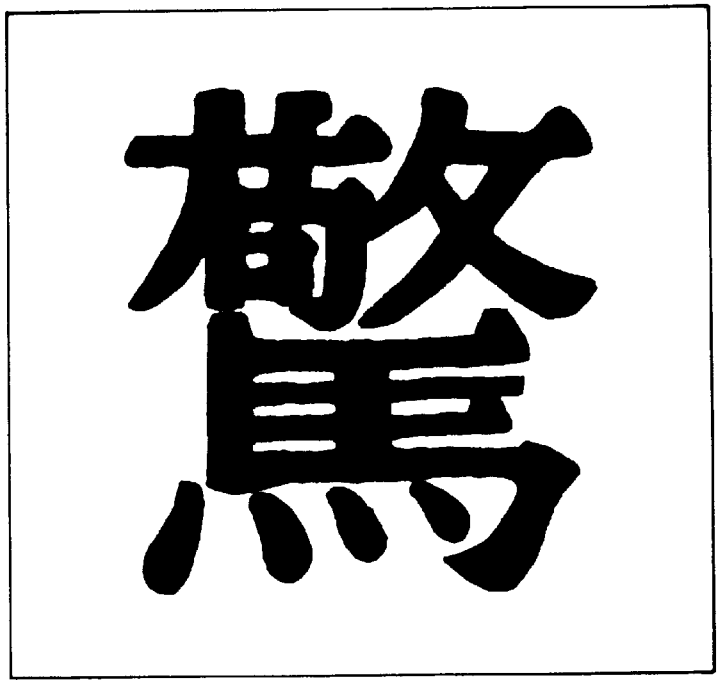
FIGS. 1A and 1B show character image samples free from and accompanied with hollow image dropout, respectively.
Figure 1B:
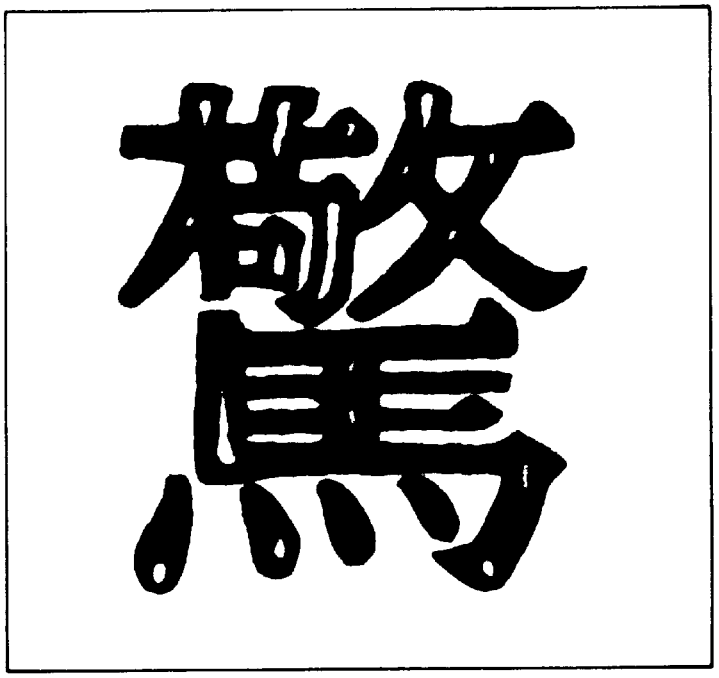

According to our study, it has been fund that the use of a toner comprising toner particles having a high average circularity of at least 0.955 and each comprising at least a binder resin, a colorant and a release agent, and a low-crystalline aromatic metal compound present at or preferably coating the surfaces of the toner particles, provides an improved high transfer efficiency for a long period and suppresses the hollow image dropout and fog.

When an aromatic metal compound (in a sense of including a metal complex compound, a metal salt and a mixture of these) co-present with toner particles has a low-crystalinity (in a sense of also including amorphousness or rather characterized as amorphousness), the aromatic metal compound exhibits a good ductility when blended with toner particles in a manner as described below to be present at the surfaces of the toner particles so as to surface-coat the toner particles. The aromatic metal compound present at or coating the toner particle surfaces is considered to prevent the leakage of toner charge liable to be caused at the time of transfer and provide an increased toner charge due to triboelectrification with the photosensitive member leading to an increased electrostatic attachment force with a transfer material and therefore a prevention of back transfer. Further, as the aromatic metal compound uniformly coats the toner particle surfaces, the toner can be uniformly charged to results in an improved transfer efficiency. Further, as the aromatic metal compound has a charge-control or -promoting function, the uniform coverage therewith of the toner particles allows a quick charging and a sufficient charge of the toner, whereby the toner can exhibit a uniform charge distribution even when its flowability is lowered after a long period of continuous image formation. Moreover, as the aromatic metal compound is present so as to uniformly coat the toner particle surfaces, external additive are less liable to be embedded at the toner particle surfaces, and the toner deterioration is less liable to be caused. It is considered that as a result of synergism of the above-mentioned functions, a high transfer efficiency is obtained and fog-free images can be obtained even in a later stage of long period of continuous image formation.

In case where the aromatic metal compound is crystalline, it is liable to be hard, so that it is present at the surfaces of toner particles having a smooth surface as represented by an average circularity of at least 0.955 so as not to uniformly cover the toner particle surfaces but to be embedded at the toner particle surfaces. As a result, even if the amount of the aromatic metal compound is increased, the particles thereof are merely ununiformly embedded at the toner particle surfaces and fail to coat the entire surfaces of the toner particles. Further, in case where it is present as large crystal particles, they cannot be even embedded at the toner particle surfaces but are merely present as isolated particles, thus failing to prevent toner charge leakage and back-transfer. Further, in a later stage of continuous image formation, the transfer efficiency is lowered.

The above-mentioned state of "coating" or "coverage" with the aromatic metal compound as a preferred state of presence of the aromatic metal compound at the surfaces of toner particles may be confirmed as a state of presence of the aromatic metal compound not in particles on the toner particles when observed through a SEM (scanning electron microscope) at a magnification of $1\times10^4$ to $3\times10^4$.

Figure 2:
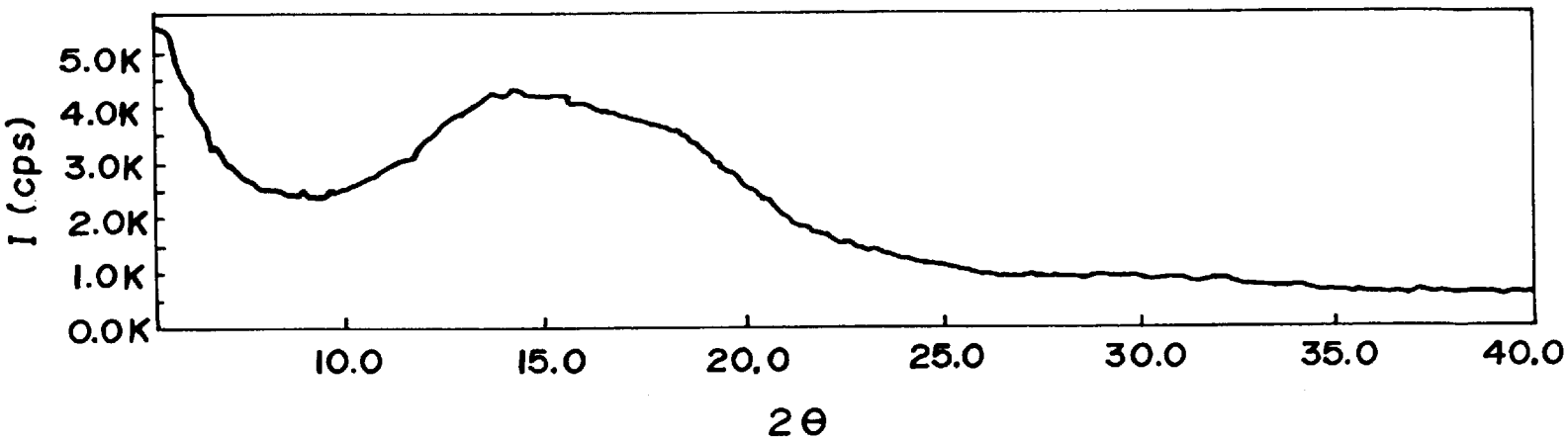
FIG. 2 is an X-ray diffraction chart for a low-crystalline aromatic metal compound.
Figure 3:
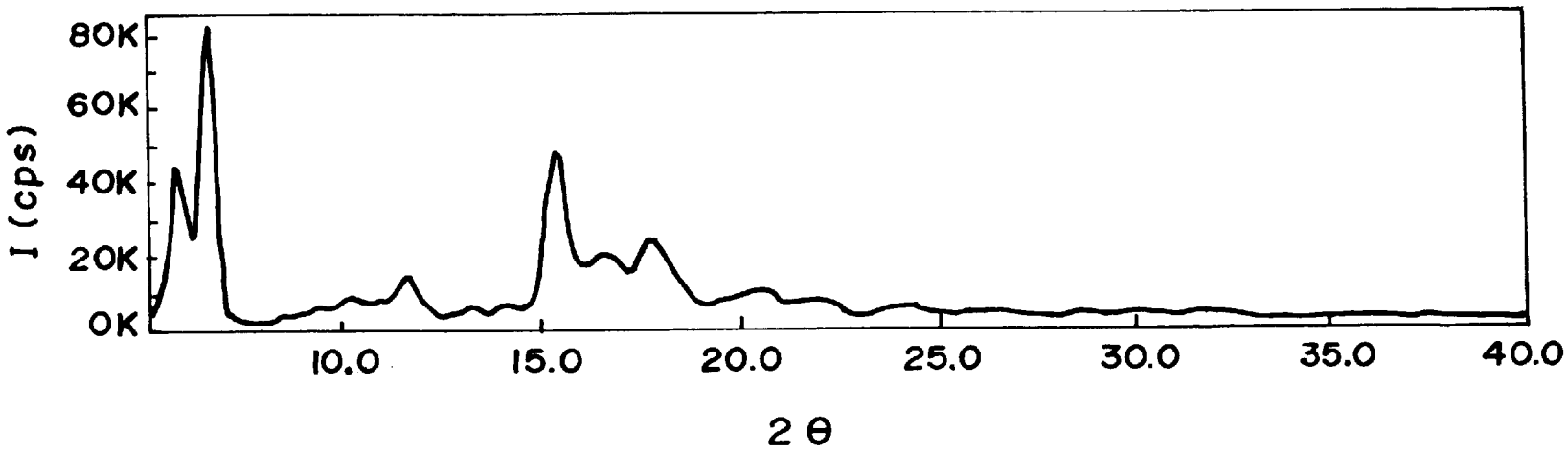
FIG. 3 is an X-ray diffraction chart for a crystalline aromatic metal compound.

The low-crystallinity (in a sense of also covering amorphousness as mentioned above) of an aromatic metal compound used in the present invention is confirmed by an X-ray diffraction pattern of the aromatic metal compound as shown, e.g., in FIG. 2 (for dialkylsalicylic acid chromium compound E used in Example 10), free from peaks exhibiting a measurement intensity of at least 10,000 cps (counts per second) and a half-value half-width of at most 0.3 deg., which is clearly distinguishable from a diffraction pattern as shown in FIG. 3 of a crystalline aromatic metal compound (dialkylsalicylic acid zinc complex salt E used in Comparative Example 3) as represented by a maximum peak at a 2θ-angle of ca. 6.6 deg. showing a measurement intensity of 80,000 cps and a half-value half-width of 0.21 deg. In an ordinary X-ray diffraction analysis, a crystalline substance exhibits an inherent diffraction peak corresponding to its crystal plane spacing based on the Bragg's diffraction condition, and the diffraction intensity depends on the crystal state and crystallinity. Based on this, a substance exhibiting an X-ray diffraction pattern free from peaks exhibiting a measurement intensity of at least 10,000 cps and a half-value half-width of at least 0.3 deg. is regarded as a low-crystalline or amorphous substance. The low-crystallinity examination is performed in a measurement angle 2θ range of 6 deg. to 40 deg., because the measurement result in the 2θ range of below 6 deg. is remarkably affected by the direct beam and the 2θ-range exceeding 40 deg. provides only a small measurement intensity. Herein, the term "half-value half-width" (also known as "half-width at half-maximum") refers to a half of the width of a peak at a half value of the peaktop measurement intensity (cps) of the peak.

The X-ray diffraction data described herein for determining the low-crystallinity of an aromatic metal compound are based on data obtained by using an X-ray diffraction apparatus ("MXP18", available from K.K. Mac Science) with CuKα rays under the following conditions:

X-ray tube ball: Cu

Tube voltage: 50 kilo-volts

Tube current: 300 mA

Scanning mode: 2θ/θ-scan

Scanning speed: 2 deg./min.

Sampling internal: 0.02 deg.

Divergence slit: 0.50 deg.

Scattering slit: 0.50 deg.

Receiving slit: 0.3 mm

For the measurement, a sample aromatic metal compound in powder form is placed without surface unevenness on a glass plate at a rate of ca. 12 mg/cm$^2$.

In addition to the externally added aromatic metal compound for presence at the toner particle surfaces, the aromatic metal compound can also be added internally to the toner particles, and this is even preferred. In the case of such internal addition, the aromatic metal compound may preferably be added in 0.05–5 wt. parts per 100 wt. parts of the binder resin. On the other hand, the aromatic metal compound may preferably be present at the toner particle surfaces at a rate of 0.01–0.5 wt. part, more preferably 0.01–0.3 wt. part, per 100 wt. parts of the toner according to the present invention. If the amount is less than 0.01 wt. part, the uniform presence thereof on the toner particle surfaces becomes difficult, thus exhibiting little effect of suppressing back-transfer and being liable to cause a lowering in transfer efficiency with progress of continuous image formation. In excess of 0.5 wt. part, the proportion thereof not present on the toner particle surfaces but present in isolated form is increased, thus being liable to soil the charging member in the image forming apparatus. The internal addition of the aromatic metal compound provides a toner with improved quick chargeability and uniform chargeability, thus providing an increased transfer efficiency. This is also effective in suppressing the lowering in transfer efficiency during continuous image formation. If the amount of the internal addition is less than 0.5 wt. part. The charging speed at the start of the image forming operation is low and in excess of 5 wt. parts, the resultant toner is liable to have an inferior fixability and cause difficulties, such as provision of OHP-sheet (transparent sheet for overhead projector) with a lower transparency and a color deviation in color toner due to the color of the aromatic metal compound.

The aromatic metal compound internally added to the toner particles may be identical to or different from the species of the aromatic metal compound present at the toner particle surfaces, and may be either crystalline or low-crystalline.

As mentioned above, the aromatic metal compound used in the present invention may be a metal complex compound, a metal salt or a mixture of these. Further, the metal complex compound may be a metal complex or a metal complex salt.

The aromatic metal compound used in the present invention may be any of compounds known heretofore as such. Examples thereof may include metal compounds of aromatic hydroxycarboxylic acids, and aromatic mono- and polycarboxylic compounds, and aromatic monoazo metal compounds. Preferred examples of these may include metal complex compounds, metal salts or mixtures of these, of hydroxycarboxylic acid compounds. Particularly, a hydroxycarboxylic acid aluminum or zirconium compound having aluminum or zirconium as its center atom exhibits a large effect of preventing back-transfer and a high transfer efficiency presumably because of a high chargeability-improving effect and a good toner-coatability of the compound. The aluminum compound is particularly preferred.

As an example of production of the low-crystalline aromatic metal compound used in the present invention, the production of low-crystalline dialkylsalicylic acid aluminum complex compound suitably used in the present invention is described below.

Such a dialkylsalicylic aluminum complex compound may be synthesized by adding an alkaline aqueous solution of dialkylsalicylic acid into an aqueous solution of $Al_2(SO_4)_3$ under stirring to form a reaction product, followed by recovery by filtration, washing and drying. In order to suppress the crystal formation of the aluminum complex compound, the dialkylsalicylic compound may preferably be added in 2.1–3.0 mols, particularly 2.2 to 2.8 mols, per 1 mol of $Al_2(SO_4)_3$ so as to reduce the residual amount of the non-reacted compounds.

The thus-prepared low-crystalline aromatic metal compound may be in the form of particles having an average primary particle size of at most 0.7 $\mu$m, preferably 0.05–0.5 $\mu$m, as a number-average of 50 particles recognized to have primary particle sizes of 0.01 $\mu$m or larger on TEM (transmission electron microscope) photographs at a magnification of $3\times10^4$–$7\times10^4$. However, the low-crystalline aromatic metal compound is characterized by its ductility and can be extended during an appropriate manner of blending with toner particles as described below. Accordingly, the above-mentioned particle size is not critical.

In order to have the aromatic metal compound be present at the toner particle surfaces, it is appropriate to stir toner particles together with powder of the aromatic metal compound under the condition of exerting some mechanical impacting force to these particles according to known methods by using apparatus known under the names of "Mechano-Fusion System" (a mixing apparatus using a dry-mechanochemical process; mfd. by Hosokawa Micron K.K.), I-type jet mill equipped with an imaging member at an accelerator tube outlet, a hybridizer ("Hybridization System") (a mixing apparatus having a rotor or liner; mfd. by Nara Kikai Seisakusho K.K.), "Turbo-mill" (a mixing apparatus having a high-speed rotating pulverization rotor for causing impingement between the rotor and the particles and between the particles; mfd. by Turbo Kogyo K.K.), and Henschell mixers having high-speed stirring blades (e.g., "Henschell Mixer", mfd. by Mitsui Miike Kakouki K.K.). The use of a Henschell mixer is particularly preferred in order to effect a uniform coating on the toner particle surfaces while prevention the occurrence of coarse particles of the aromatic metal compound.

More specifically, when the above-mentioned aromatic metal compound is blended under stirring with toner particles under the action of only a weak shearing force or at a low speed, the aromatic metal compound is isolated from the toner particles. On the other hand, if the blending by stirring is performed under the action of an excessively high shearing force or at an excessively high speed, the adherence of and coating with the aromatic metal compound are abruptly caused, so that the uniform coating onto the entire toner particle surfaces becomes difficult. Accordingly, in order to have the aromatic metal compound be uniformly present on the toner particle surfaces, it is preferred that a Henschell mixer is used and operated at a stirring blade peripheral speed of 30–80 m/sec. for a blending period of 1–10 min. Further, in order to prevent the occurrence of coarse particles, the blending temperature may preferably be suppressed to at most 50° C.

The toner according to the present invention has an average circularity $\overline{C}$ of at least 0.955, preferably 0.955–0.990, more preferably 0.960–0.990, further preferably 0.960–0.985, and preferably also a circularity standard deviation of less than 0.04. The average circularity is used herein as a convenient measure for describing a shape of particles based on a measurement using a flow particle image analyzer ("FPIA-1000", available from Toa Iyou Denshi K.K.). For each measured particle, a circularity Ci is determined by an equation of $Ci$=[the peripheral length of a circle having an area identical to the projection area of a detected particle image]/[the peripheral length of the detected particle image].

Based on the measured circularity values Ci for the respective measured particles having a range of circle equivalent diameter (C.E.D., i.e., a diameter of a circle having an area identical to the projection area of a detected particle image) of from 0.60 μm (inclusive) to 159.21 μm (not inclusive), an average circularity $\overline{C}$, and a standard deviation of circularity SDc, are calculated according to the following formulae:

$$\overline{C} = \sum_{i=1}^{m} Ci/m \tag{1}$$

$$SDc = \left\{ \sum_{i=1}^{m} (\overline{C} - Ci)^2 / m \right\}^{1/2} \tag{2}$$

wherein m represents the number of detected particles.

More specifically, for the particle image analyzer measurement, ca. 5 mg of a sample toner is dispersed in 10 ml of water containing ca. 0.1 mg of a nonionic surfactant, under application of an ultrasonic wave (20 kHz, 50 W) for 5 min. to form a dispersion liquid having a concentration of $5\times10^3$–$2\times10^4$ particles/μl. The resultant sample dispersion liquid is subjected to measurement of particle size distribution and circularity distribution of particles in a circle-equivalent diameter range of 0.60–159.21 μm (upper limit, not inclusive) by using the above-mentioned flow particle image analyzer.

The details of the measurement is described in a technical brochure and an attached operation manual on "FPIA-1000" published from Toa Iyou Denshi K.K. (Jun. 25, 1995) and JP-A 8-136439. The outline of the measurement is as follows.

A sample dispersion liquid is caused to flow through a flat thin transparent flow cell (thickness=ca. 200 μm) having a divergent flow path. A strobe and a CCD camera are disposed at mutually opposite positions with respect to the flow cell so as to form an optical path passing across the thickness of the flow cell. During the flow of the sample dispersion liquid, the strobe is flashed at intervals of 1/30 second each to capture images of particles passing through the flow cell, so that each particle provides a two dimensional image having a certain area parallel to the flow cell. From the two-dimensional image area of each particle, a diameter of a circle having an identical area (an equivalent circle) is determined as a circle-equivalent diameter. Further, for each particle, a peripheral length of the equivalent circle is determined and divided by a peripheral length measured on the two-dimensional image of the particle to determine a circularity of the particle, for calculation of the above-mentioned average circularity $\overline{C}$ and a standard deviation of circularity SDc.

In some cases, the calculation of average circularity $\overline{C}$ and standard deviation of circularity SDc may be performed automatically by dividing the measured particles into, e.g., 61 channels according to measured circularities of respective particles in a circularity range of 0.4–1.0 and using a central value of circularity Ci and a frequency factor fci for each channel for calculation according to the following formulae (1a) and (2a) (instead of the above-mentioned formulae (1) and (2)):

$$\overline{C} = \sum_{i=1}^{61} (fci \times Ci) \Big/ \sum_{i=1}^{61} (fci) \tag{1a}$$

$$SDc = \left\{ \sum_{i=1}^{61} (\overline{C} - Ci)^2 \Big/ \sum_{i=1}^{60} (fci) \right\}^{1/2} \tag{2a}$$

However, the differences in calculation results between the formulae (1) and (2) and the formulae (1a) and (2a) are scarce and substantially negligible based on the flow particle image analyzer measurement.

As a toner contains only very few or substantially no external additive particles having a particle size exceeding 0.6 μm other than toner particles, the values of $\underline{C}$ and SDc measured with respect to a toner sample (including external additives) are substantially identical to those of the toner particles therein.

The circularity of a toner particle is a measure of unevenness of the particle, provides a value of 1.00 for a perfectly spherical toner particle and provides a smaller value as the toner particle shape becomes complex.

A toner particle having an indefinite shape generally shows ununiform chargeability at a convexity and a concavity of the particle and provides a larger contact area with the photosensitive member to exhibit a larger attachment force, thereby resulting in an increase in residual toner.

An average circularity below 0.955 means that the toner contains a substantial amount of indefinitely shaped toner particles having uneven surfaces, and therefore exhibits a lower transfer efficiency and a liability of hollow image dropout. Further, toner particles giving an average circularity below 0.955 have surface unevennesses, so that the aromatic metal compound cannot be uniformly present on the toner particle surfaces. On the other hand, toner particles exhibiting an excessively large average circularity are substantially spherical, thus providing a smaller toner surface area and being liable to fail in providing a good chargeability. Further, a toner exhibiting a circularity standard deviation larger than 0.04 has a substantial degree of fluctuation in shape of the toner particles, so that the uniform charging of the toner is liable to be difficult, thus being liable to result in a lower transfer efficiency.

The toner (and therefore the toner particles thereof) according to the present invention may preferably have a weight-average particle size (diameter) of 4–9 μm so as to faithfully reproduce minute latent image dots, thereby providing a high image quality. Toner particles having a weight-average particle size of 4–9 μm are less liable to cause a lowering in transfer efficiency and leave transfer residual toner on the photosensitive member or the intermediate transfer member and are also less liable to result image irregularities due to fog and transfer failure. Further, a toner having a weight-average particle size of 4–9 μm is less liable to cause scattering of character or line images.

The weight-average particle size of a toner described herein are based on values measured in the following manner.

Coulter counter "Model TA-II" (available from Coulter Electronics Inc.) is used, but it is also possible to use Coulter Multisizer (available from Coulter Electronics Inc.). A 1%-NaCl aqueous solution is prepared as an electrolytic solution by using a reagent-grade sodium chloride (it is also possible to use ISOTON R-II (available from Coulter Scientific Japan K.K.)). For the measurement, 0.1 to 5 ml of a surfactant, preferably a solution of an alkylbenzenesulfonic acid salt, is added as a dispersant into 100 to 150 ml of the electrolytic solution, and 2–20 mg of a sample toner is added thereto. The resultant dispersion of the sample in the electrolytic solution is subjected to a dispersion treatment for ca. 1–3 minutes by means of an ultrasonic disperser, and then subjected to measurement of particle size distribution in the range of 2.00–40.30 μm divided into 13 channels by using the above-mentioned Coulter counter with a 100 μm-aperture to obtain a volume-basis distribution and a number-basis distribution. From the volume-basis distribution, a weight-average particle size (D4) and a volume-average particle size (Dv) are calculated by using a central value as a representative value for each channel. From the number-basis distribution, a proportion (% by number) of particles of 2.00–3.17 μm is obtained.

The particle size range of 2.00–40.30 pm is divided into 13 channels of 2.00–2.52 μm; 2.52–3.17 μm; 3.17–4.00 μm; 4.00–5.04 μm; 5.04–6.35 μm; 6.35–8.00 μm; 8.00–10.08 μm; 10.08–12.70 μm; 12.70–16.00 μm; 16.00–20.20 μm; 20.20–25.40 μm; 25.40–32.00 μm; and 32.00–40.30 μm. For each channel, the lower limit value is included, and the upper limit value is excluded.

The toner according to the present invention may preferably have a glass transition point (Tg) of 50–75° C., more preferably 52–70° C., in view of fixability and storage stability. If Tg is below 45° C., the toner is liable to cause blocking, thus being problematic in storage stability. Further, the toner is liable to be weak against a stress, thus causing toner deterioration, during continuous image formation. If Tg exceeds 75° C., the toner is liable to have inferior fixability, making it difficult to be applicable to a variety of transfer materials.

The values of Tg referred to herein are based on values measured by using a high-accuracy internal heat input compensation-type differential scanning calorimeter (e.g., "DSC-7", available from Perkin-Elmer Corp.) according to ASTM D3418-8. A sample is once subjected to heating for removal of history and then quenched. The sample is then again subjected to heating at a rate of 10° C./min. in a range of 30–200° C. to obtain a DSC for determination of Tg.

The binder resin for the toner of the present invention may for example comprise: homopolymers of styrene and derivatives thereof, such as polystyrene, poly-p-chlorostyrene and polyvinyltoluene; styrene copolymers, such as styrene-p-chlorostyrene copolymer, styrene-vinyltoluene copolymer, styrene-vinylnaphthalene copolymer, styrene-acrylate copolymer, styrene-methacrylate copolymer, styrene-methyl-α-chloromethacrylate copolymer, styrene-acrylonitrile copolymer, styrene-vinyl methyl ether copolymer, styrene-vinyl ethyl ether copolymer, styrene-vinyl methyl ketone copolymer, styrene-butadiene copolymer, styrene-isoprene copolymer and styrene-acrylonitrile-indene copolymer; polyvinyl chloride, phenolic resin, natural resin-modified phenolic resin, natural resin-modified maleic acid resin, acrylic resin such as polyacrylic acid and polyacrylic acid ester, methacrylic resin such as polymethacrylic acid and polymethacrylic acid ester, polyvinyl acetate, silicone resin, polyester resin, polyurethane, polyamide resin, furan resin, epoxy resin, xylene resin, polyvinyl butyral, terpene resin, coumarone-indene resin and petroleum resin. Preferred classes of binder resins may include styrene (co-)polymers and polyester resins.

Examples of the comonomer constituting a styrene copolymer together with styrene monomer may include other vinyl monomers inclusive of: monocarboxylic acids having a double bond and derivative thereof, such as acrylic acid, methyl acrylate, ethyl acrylate, butyl acrylate, dodecyl acrylate, octyl acrylate, 2-ethylhexyl acrylate, phenyl acrylate, methacrylic acid, methyl methacrylate, ethyl methacrylate, butyl methacrylate, octyl methacrylate, acrylonitrile, methacrylonitrile, and acrylamide; dicarboxylic acids having a double bond and derivatives thereof, such as maleic acid, butyl maleate, methyl maleate and dimethyl maleate; vinyl esters, such as vinyl chloride, vinyl acetate, and vinyl benzoate; ethylenic olefins, such as ethylene, propylene and butylene; vinyl ketones, such as vinyl methyl ketone and vinyl hexyl ketone; and vinyl ethers, such as vinyl methyl ether, vinyl ethyl ether, and vinyl isobutyl ether. These vinyl monomers may be used alone or in mixture of two or more species in combination with the styrene monomer.

It is possible that the binder resin inclusive of styrene polymers or copolymers has been crosslinked or can assume a mixture of crosslinked and un-crosslinked polymers.

The crosslinking agent may principally be a compound having two or more double bonds susceptible of polymerization, examples of which may include: aromatic divinyl compounds, such as divinylbenzene, and divinylnaphthalene; carboxylic acid esters having two double bonds, such as ethylene glycol diacrylate, ethylene glycol dimethacrylate and 1,3-butanediol dimethacrylate; divinyl compounds, such as divinylaniline, divinyl ether, divinyl sulfide and divinylsulfone; and compounds having three or more vinyl groups. These may be used singly or in mixture in an amount of 0.001–10 wt. parts per 100 wt. parts of polymerizable monomer(s).

In order to improve the releasability from the fixing member and the fixability during the fixation, the toner particles may preferably contain a low-softening point substance, examples of which may include: paraffin waxes and derivatives thereof, microcrystalline wax and derivatives thereof, Fischer-Tropsche wax and derivatives thereof, polyolefin waxes and derivatives thereof, carnauba wax and derivatives thereof. The derivatives may include an oxide, a block copolymer with a vinyl monomer, and a graft-product modified with a vinyl monomer. It is also possible to use long-chain alcohols, log-chain fatty acids, acid amides, ester waxes, ketones, hardened castor oil and derivatives, vegetable waxes, animal waxes, mineral waxes, and petrolactam in some cases.

The low-softening point substance may exhibit a heat-absorption main peak temperature of 55–120° C., preferably 60–90° C., further preferably 60–85° C., on a DSC curve as measured according to ASTM D3418-8. It is further preferred to use a low-softening point substance showing an onset temperature (temperature at which a DSC curve first deviates from a tangential base line) of at least 40° C. If the heat-absorption main peak appears at below 55° C., the low-softening point substance is caused to exhibit only weak cohesion so that it cannot readily constitute an interior or core of toner particles, so that the low-softening point substance is liable to be precipitated at or exude to the toner particles surface, thus adversely affecting the developing performance. Further, if the onset temperature is below 40° C., the toner particles are liable to have a lower strength, thus being liable to cause a lowering in developing performance during continuous image formation. Further, the resultant fixed images are liable to provide a sticking feed due to a low softening point of the substance.

If the heat-absorption main peak temperature exceeds 120° C., it becomes difficult for the low-softening point to exude at the time of fixation, thus resulting in inferior low-temperature fixability. Further, in the case of toner particle production by direct polymerization, the low-softening point substance exhibits a lower solubility in a polymerizable monomer mixture, so that it is liable to be precipitated during formation of toner particle-size droplets of the polymerizable monomer mixture in an aqueous medium, thus making the droplet formation difficult.

The low-softening point substance may be added in 2–40 wt. parts, preferably 5–35 wt. parts, per 100 wt. parts of the toner binder resin. If the low-softening point substance is less than the lower limit, the offset prevention effect is liable to be scarce. In excess of the upper limit the anti-blocking effect is lowered and the anti-offset effect is also adversely affected, thus being liable to cause melt sticking onto the drum and sleeve. Particularly, in the case of toner particle production by direct polymerization, toner particles having a broad particle size distribution are liable to be formed.

The colorants usable in the present invention may include carbon black, a magnetic material, and yellow, magenta and cyan colorants as shown below.

Examples of the yellow colorant may include: condensed azo compounds, isoindolinone compounds, anthraquinone compounds, azo metal complexes, methin compounds and acrylamide compounds. Specific preferred examples thereof may include C.I. Pigment Yellow 12, 13, 14, 15, 17, 62, 74, 83, 93, 94, 95, 97, 109, 110, 111, 120, 127, 128, 129, 147, 168, 174, 176, 180, 181 and 191.

Examples of the magenta colorant may include: condensed azo compounds, diketopyrrolepyrrole compounds, anthraquinone compounds, quinacridone compounds, basic dye lake compounds, naphthol compounds, benzimidazole compounds, thioindigo compounds and perylene compounds. Specific preferred examples thereof may include: C.I. Pigment Red 2, 3, 5, 6, 7, 23, 48:2, 48:3, 48:4, 57:1, 81:1, 144, 146, 166, 169, 177, 184, 185, 202, 206, 220, 221 and 254.

Examples of the cyan colorant may include: copper phthalocyanine compounds and their derivatives, anthraquinone compounds and basic dye lake compounds. Specific preferred examples thereof may include: C.I. Pigment Blue 1, 7, 15, 15:1, 15:2, 15:3, 15:4, 60, 62, and 66.

These colorants may be used singly, in mixture of two or more species or in a state of solid solution. The above colorants may be appropriately selected in view of hue, color saturation, color value, weather resistance, OHP transparency, and a dispersibility in toner particles. The above colorants may generally be used in a proportion of 2–20 wt. parts per 100 wt. parts of the binder resin. A black colorant comprising a magnetic material, unlike the other colorants, may generally be used in a proportion of 40–150 wt. parts per 100 wt. parts of the binder resin.

Such a magnetic material used as a colorant provides a magnetic toner. Examples of such a magnetic material suitably used for providing a magnetic toner may include: iron oxides, such as magnetite, hematite and ferrite; metals, such as iron, cobalt and nickel, and alloy of these metals with other metals, such as aluminum, cobalt, copper, lead, magnesium, tin, zinc, antimony, beryllium, bismuth, cadmiun, calcium, manganese, selenium, titanium, tungsten and vanadium.

The magnetic material used in the present invention may preferably be a surface-modified one. For example, in case of providing a toner by direct polymerization, it is preferred to use a magnetic material treated with a hydrophobization agent having little polymerization-inhibiting effect. Example of such hydrophobization agent may include: silane coupling agents and titanate coupling agents. The magnetic material may preferably have an average particle size of at most 1 $\mu$m, preferably 0.1–0.5 $\mu$m.

Various additive may be incorporated in and/or externally added to toner particles for imparting various properties to the toner. In view of the continuous image forming performances of the resultant toner, such additives may preferably have a (number-)average particle size (as measured by an electron microscopic observation) which is at most ⅕ of the volume-average particle size of the toner particles. Examples of such additives may include the following.

Flowability improvers: metal oxides, such as silicon oxide, aluminum oxide and titanium oxide; carbon black, and fluorinated carbon, preferably subjected to a hydrophobization treatment.

Abrasives: metal oxides, such as strontium titanate, cerium oxide, aluminum oxide, magnesium oxide, and chromium oxide; nitrides, such as silicon nitride; carbides, such as silicon carbide; and metal salts, such as calcium sulfate, barium sulfate and calcium carbonate.

Lubricants: power of fluorine-containing resins, such as vinylidene fluoride resin and polytetrafluoroethylene; and fatty acid metal salts, such as zinc stearate, and calcium stearate.

Charge controlling particles: particles of metal oxides, such as tin oxide, titanium oxide, zinc oxide, silicon oxide, and aluminum oxide, and carbon black.

These additives may be added singly or in combination of two or more species in an amount of 0.1–10 wt. parts, preferably 0.1–5 wt. parts, per 100 wt. parts of the toner particles.

Particularly, for use in the image forming method including a developing step according to the contact developing scheme, the toner according to the present invention may preferably be formed by mixing the toner particles on which the aromatic metal compound is present further with fine particles, preferably with at least two species of fine particles including smaller-size fine particles and larger-size fine particles having preferably an average particle size of 0.03–0.8 $\mu$m so as to have the smaller-size fine particles function as a flowability improver and have the larger-size fine particles function as so-called spacer particles. If the larger-size fine particle have an average particle size below 0.03 $\mu$m, the particles can be embedded at the toner particle surfaces, thus failing to function as spacer particles. In excess of 0.8 $\mu$m, the particles are not attached to the toner particles but are liable to be isolated particles, so that the spacer effect becomes scarce. On the other hand, the smaller-size fine particles may preferably have a primary particle size of 5 nm (0.005 $\mu$m) to 20 nm (0.02 $\mu$m). In excess of 20 nm, the toner flowability-improving effect is liable to scarce. Below 5 nm, the particles may be embedded or stagnant at the concavities of the toner particle surfaces, thus being liable to foil in controllable chargeability and flowability of the resultant toner.

Such fine particles may comprise silica, titanium oxide, alumina and resins and may preferably be added in a total amount of 0.01–8 wt. parts, preferably 0.1–5 wt. parts, per 100 wt. parts of the toner particles. The larger size fine particles may preferably be added in an amount of 0.1–3.5 times, more preferably 0.1–3.0 times, that of the smaller size fine particles.

It is also preferred that such fine particles have been surface-treated with treating agents, such as silicone varnish, various modified silicone varnish, silicone oil, various modified silicone oil, silane coupling agent, silane coupling agent having a functional group, and other organosilane compounds, selected as desired, for the purpose of hydrophobization and chargeability control.

The average particle size of such fine particles may be determined as follows. Sample fine particles are observed through a scanning electron microscope or a transmission electron microscope at a magnification of $10^4$ to $10^5$ to take photographs. On the photographs, 100 particles (recognizable as primary particles) having a particle size of at least 1 nm are selected at random, and the particle sizes thereof are measured on the photographs and averaged to provide an average particle size.

Preferred examples of other additives for providing the toner used in an image forming method including a development step according to the contact development scheme may include: lubricants, such as polytetrafluoroethylene, zinc stearate, and polyvinylidene fluoride with polyvinylidene fluoride as the most preferred one; abrasives, such as cerium oxide, silicon carbide and strontium titanate with strontium titanate as the most preferred one; anti-caking agents; electroconductivity-imparting agents, such as carbon black, zinc oxide, antimony oxide and tin oxide.

Such toner particles may be externally added to toner particles by mixing and stirring by blending means, such as a Henschell mixer, but it is preferred that this mixing is performed after the mixing under stirring of the toner particles with the aromatic metal compound. This is because in case where such fine particles are mixed with toner particles simultaneously with or prior to the mixing of the toner particles with the aromatic metal compound, the fine particles occupy a substantial part of the toner particle surfaces, so that the uniform coating of the toner particles with the aromatic metal compound becomes difficult, and further the aromatic metal compound failing to be present at the toner particle surfaces is isolated from the toner particles to soil some member in the apparatus, such as a charging member, thereby causing increased fog and lower image quality.

The toner particles constituting the toner according to the present invention may be produced through a pulverization process, a direct polymerization process, etc.

In the pulverization process, the binder resin, the colorant, the low-softening point substance and other additives may be sufficiently blended by a blender, such as a Henschell mixer and a ball mill, and metal-kneaded by a hot-kneading means, such as heating rollers, a kneader, and an extruder to disperse the colorant, etc., in a melted resin to provide a melt-kneaded product, which is then cooled to be solidified, pulverized and classified to obtain toner particles. In the classification step, a multi-division classifier is preferably used in view of production efficiency.

The toner particles thus-obtained through the pulverization process generally has an average circularity below 0.955, and therefore may preferably be subjected to a sphering treatment by surface modification to provide an increased average circularity, as by heat-treating in a hot water bath or in a hot air stream, or by application of a mechanical impact for surface modification. The mechanical surface modification may be performed by using apparatus, such as Mechanofusion system, I-type mill, Hybridizer and the apparatus disclosed in JP-A 10-94734, as mentioned above for mixing under stirring with the aromatic metal compound.

Such toner particles having a sufficiency increased average circularity may be blended with the aromatic metal compound and then with other external additives by a blending means, such a Henschell mixer to obtain the toner.

As other processes for obtaining toner particle having an increased average circularity, it is also possible to adopt a process of spraying a molten mixture into air by using a disk or a multi-fluid nozzle as disclosed in JP-B 56-13945, etc.; a process for directly producing toner particles by suspension polymerization as disclosed in JP-B 36-10231, JP-A 59-53856, and JP-A 59-61842; a dispersion polymerization process for directly producing toner particles as an aqueous organic solvent in which the monomer is soluble but the resultant polymer is insoluble; a process for producing toner particles according to emulsion polymerization as represented by soap-free polymerization wherein toner particles are directly produced by polymerization in the presence of a water-soluble polar polymerization initiator; or a hetero-agglomeration process wherein preliminarily formed first polarity emulsion particles are blended with polar particles having an opposite polarity thereto to cause association with each other to form toner particles. It is particularly preferred to produce toner particles by suspension polymerization. It is also possible to suitably use toner particles obtained through a seed polymerization process wherein an additional monomer is adsorbed onto once-obtained polymerizate particles and polymerized by using a polymerization initiator.

The production of toner particles according to a direct polymerization process may be performed in the following manner. Into a polymerizable monomer, a release agent comprises a low-softening point substance, a colorant, a charge control agent, a polymerization initiator, and another optional additive are added and uniformly dissolved or dispersed by a homogenizer or an ultrasonic dispersing device, to form a polymerizable monomer composition, which is then dispersed and formed into particles in a dispersion medium containing a dispersion stabilizer by means of an ordinary stirrer, a homomixer or a homogenizer preferably under such a condition that droplets of the polymerizable monomer composition can have a desired particle size of the resultant toner particles by controlling stirring speed and/or stirring time. Thereafter, the stirring may be continued in such a degree as to retain the particles of the polymerizable monomer composition thus formed and prevent the sedimentation of the particles. The polymerization may be performed at a temperature of at least 40° C., generally 50–90° C. The temperature can be raised at a later stage of the polymerization. It is also possible to subject a part of the aqueous system to distillation in a latter stage of or after the polymerization in order to remove the yet-unpolymerized part of the polymerizable monomer and a by-product which can cause an odor in the toner fixation step. After the reaction, the produced toner particles are washed, filtered out, and dried. In the suspension polymerization, it is generally preferred to use 300–3000 wt. parts of water as the dispersion medium per 100 wt. parts of the monomer composition.

The polymerizable monomer suitably used for producing toner particles according to the polymerization process may suitably be a vinyl-type polymerizable monomer capable of radical polymerization. The vinyl-type polymerizable monomer may be a monofunctional monomer or a polyfunctional monomer. Examples of the monofunctional monomer may include: styrene; styrene derivatives, such as α-methylstyrene, β-methylstyrene, o-methylstyrene, m-methylstyrene, p-methylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene, and p-phenylstyrene; acrylic monomers, such as methyl acrylate, ethyl acrylate, n-propyl acrylate, isopropyl acrylate, n-butyl acrylate, isobutyl acrylate, tert-butyl acrylate, n-amyl acrylate, n-hexyl acrylate, 2-ethylhexyl acrylate, n-octyl acrylate, n-nonyl acrylate, cyclohexyl acrylate, benzyl acrylate, dimethylphosphateethyl acrylate, diethylphosphateethyl acrylate, dibutylphosphateethyl acrylate, and 2-benzoyloxyethyl acrylate; methacrylic monomers, such as methyl methacrylate, ethyl methacrylate, n-propyl methacrylate, iso-propyl methacrylate, n-butylmethacrylate, iso-butyl methacrylate, tert-butyl methacrylate, n-amyl methacrylate, n-hexyl methacrylate, 2-ethylhexyl methacrylate, n-octyl methacrylate, n-nonyl methacrylate, diethylphosphateethyl methacrylate, and dibutylphosphateethyl methacrylate; methylene aliphatic monocarboxylic acid esters; vinyl esters, such as vinyl acetate, vinyl propionate, vinyl benzoate, vinyl lactate, and vinyl formate; vinyl ethers, such as vinyl methyl ether, vinyl ethyl ether, and vinyl isobutyl ether; and vinyl ketones, such as vinyl methyl ketone, vinyl hexyl ketone, and vinyl isopropyl ketone.

Examples of the polyfunctional monomer may include: diethylene glycol diacrylate, triethylene glycol diacrylate, tetraethylene glycol diacrylate, polyethylene glycol diacrylate, 1,6-hexanediol diacrylate, neopentyl glycol diacrylate, tripropylene glycol diacrylate, polypropylene glycol diacrylate, 2,2'-bis[4-acryloxydiethoxy)phenyl] propane, trimethylolpropane triacrylate, tetramethylolmethane tetraacrylate, ethylene glycol dimethacrylate, diethylene glycol dimethacrylate, triethylene glycol dimethacrylate, tetraethylene glycol dimethacrylate, polyethylene glycol dimethacrylate, 1,3-butylene glycol dimethacrylate, 1,6-hexanediol dimethacrylate, neopentyl glycol dimethacrylate, polypropylene glycol dimethacrylate, 2,2'-bis[4-(methacryloxydiethoxy)phenyl]propane, 2,2'-bis [4-(methacryloxypolyethoxy)phenyl]propane, trimethylolpropane trimethacrylate, tetramethylolmethane tetramethacrylate, divinylbenzene, divinylnaphthalene, and divinyl ether.

In the present invention, the above-mentioned monofunctional monomer may be used singly or in combination of two or more species thereof, or optionally in combination with one or more species of the polyfunctional polymerizable monomer. The polyfunctional polymerizable monomer may also be used as a crosslinking agent.

The polymerization initiator used for polymerization of the above-mentioned polymerizable monomer may be an oil-soluble initiator and/or a water-soluble initiator. Examples of the oil-soluble initiator may include: azo compounds, such as 2,2'-azobisisobutyronitrile, 2,2'-azobis-2,4-dimethylvaleronitrile, 1,1'-azobis(cyclohexane-1-carbonitrile), and 2,2'-azobis-4-methoxy-2,4-dimethylvaleronitrile; and peroxide initiators, such as acetylcyclohexylsulfonyl peroxide, diisopropyl peroxycarbonate, decanoyl peroxide, lauroyl peroxide, stearoyl peroxide, propionyl peroxide, acetyl peroxide, t-butyl peroxy-2-ethylhexanoate, benzoyl peroxide, t-butyl peroxyisobutyrate, cyclohexanone peroxide, methyl ethyl ketone peroxide, dicumyl peroxide, t-butyl hydroperoxide, di-t-butyl peroxide, and cumeme hydroperoxide.

Examples of the water-soluble initiator may include: ammonium persulfate, potassium persulfate, 2,2'-azobis(N, N'-dimethyleneisobutyroamidine)hydrochloric acid salt, 2,2'-azobis(2-amidinopropane)hydrochloric acid salt, azobis (isobutylamidine)hydrochloric acid salt, sodium 2,2'-azobisisobutyronitrilesulfonate, ferrous sulfate and hydrogen peroxide.

The polymerization initiators may be used singly or in combination of two or more species in 0.5–20 wt. parts per 100 wt. parts of the polymerizable monomer.

In production of toner particles by the polymerization using a dispersion stabilizer, it is preferred to use an inorganic or/and an organic dispersion stabilizer in an aqueous dispersion medium. Examples of the inorganic dispersion stabilizer may include: tricalcium phosphate, magnesium phosphate, aluminum phosphate, zinc phosphate, calcium carbonate, magnesium carbonate, calcium hydroxide, magnesium hydroxide, aluminum hydroxide, calcium metasilicate, calcium sulfate, barium sulfate, bentonite, silica, and alumina. Examples of the organic dispersion stabilizer may include: polyvinyl alcohol, gelatin, ethyl cellulose, methyl hydroxypropyl cellulose, ethyl cellulose, carboxymethyl cellulose sodium salt, and starch. These dispersion stabilizers may preferably be used in the aqueous dispersion medium in an amount of 0.2–2.0 wt. parts per 100 wt. parts of the polymerizable monomer mixture.

In the case of using an inorganic dispersion stabilizer, a commercially available product can be used as it is, but it is also possible to form the stabilizer in situ in the dispersion medium so as to obtain fine particles thereof. In the case of tricalcium phosphate, for example, it is adequate to blend an aqueous sodium phosphate solution and an aqueous calcium chloride solution under an intensive stirring to produce tricalcium phosphate particles in the aqueous medium, suitable for suspension polymerization. In order to effect fine dispersion of the dispersion stabilizer, it is also effective to use 0.001–0.1 wt. % of a surfactant in combination, thereby promoting the prescribed function of the stabilizer. Examples of the surfactant may include: sodium dodecylbenzenesulfonate, sodium tetradecyl sulfate, sodium pentadecyl sulfate, sodium octyl sulfate, sodium oleate, sodium laurate, potassium stearate, and calcium oleate.

The toner according to the present invention may ordinarily be used as a mono-component developer or to constitute a two-component developer. In case of being used as a mono-component developer, the toner may be applied onto a developing sleeve by a blade or a roller to be forcibly triboelectrically charged and conveyed to a developing position.

In case of constituting a two-component developer, the toner according to the present invention is combined with a carrier, which is preferably magnetic. Such a magnetic carrier may comprise an element, such as iron, copper, zinc, nickel, cobalt, manganese or chromium, alone or in the form of a composite ferrite. The shape of the magnetic carrier may be spherical, flat or indefinite. The magnetic carrier particles may preferably be provided with a controlled surface state or surface micro-structure, such as a surface unevenness. It is a general practice to sinter an inorganic oxide of the above-described element(s) to form magnetic carrier core particles and then coat the core particles with a resin. In order to reduce the load of the magnetic carrier on the toner, it is also possible to knead such an inorganic oxide and a resin, and pulverize and classify the kneaded product to provide a low-density dispersion carrier, or subject a mixture of such an inorganic oxide and a monomer to suspension polymerization to provide spherical low-density magnetic carrier particles.

It is particularly preferred to use a coated carrier formed by surface-coating the above-prepared carrier particles with a resin. The resin coating may be performed by applying a solution or dispersion of a resin in a solvent onto carrier particles, or by simply blending resin powder with carrier particles.

The coating material on the carrier particles may be different depending on the toner material but may for example comprise polytetrafluoroethylene, monochlorotrifluoroethylene polymer, polyvinylidene fluoride, silicone resin, polyester resin, styrene resin, acrylic resin, polyamide, polyvinyl butyral or aminoacrylate resin. These coating materials may be used singly or in combination of two or more species.

The carrier may preferably have an average particle size of 10–100 μm, more preferably 20–50 μm.

In the case of blending the toner according to the present invention and a magnetic carrier to provide a two-component developer, these may be blended so as to provide a toner concentration of 2–15 wt. %, more preferably 4–13 wt. %.

Now, the image forming method of the present invention will be described.

A first embodiment of the image forming method according to the present invention is characterized by including:

a first developing step of developing a first electrostatic image held on an image bearing member with a first toner to form a first toner image on the image bearing member, a first transfer step of transferring the first toner image on the image bearing member onto a transfer member, a second developing step of developing a second electrostatic image held on the image bearing member with a second toner to form a second toner image on the image bearing member, and a second transfer step of transferring the second toner image on the image bearing member onto the transfer member already carrying the first toner image thereon; wherein the above-mentioned toner of the present invention is used at least as the above-mentioned first toner.

A specific example of image forming apparatus capable of practicing an embodiment of the image forming method according to the present invention will now be described with reference to FIG. 4.

Figure 4:
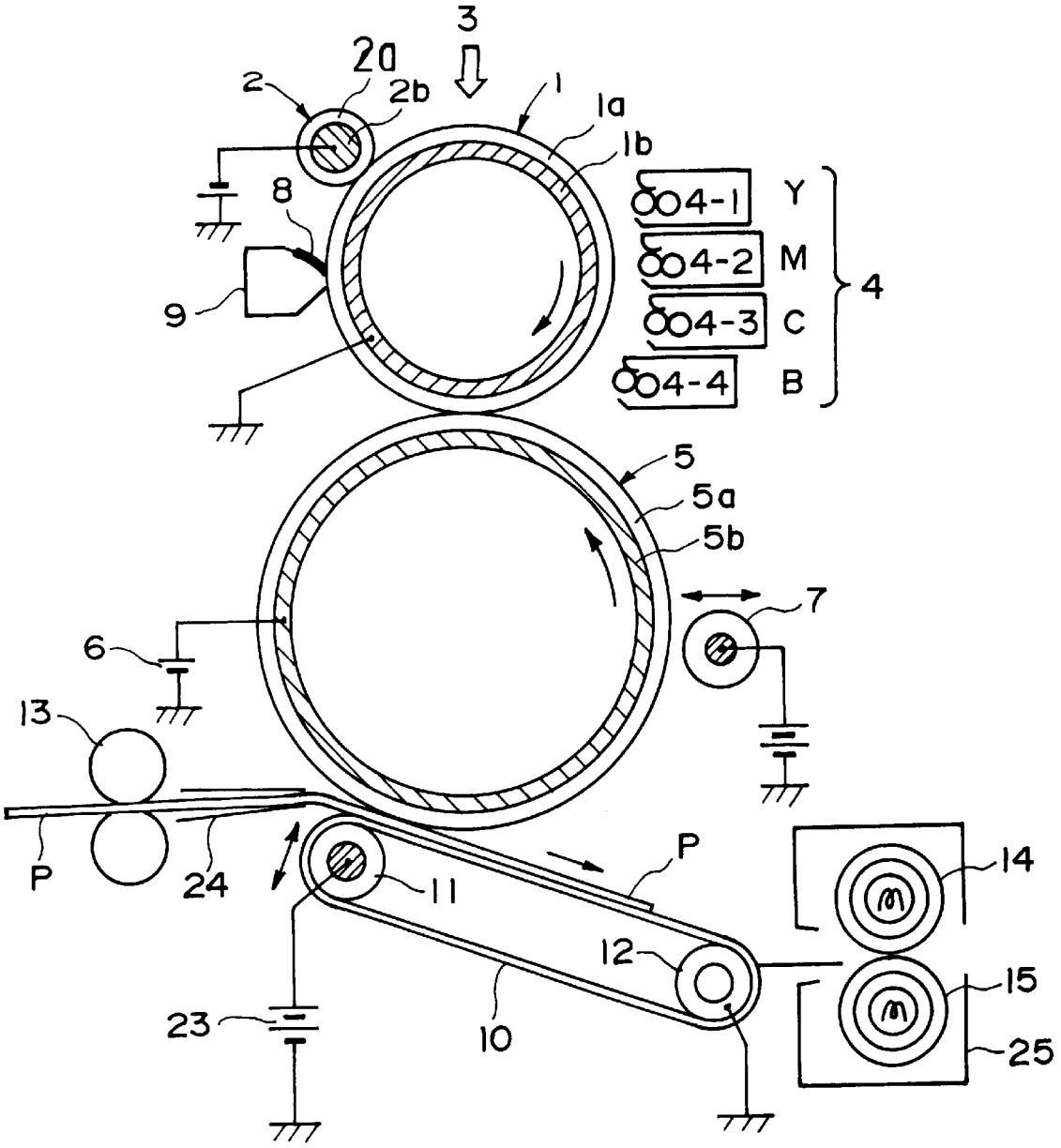
FIG. 4 is a schematic illustration of an example of image forming apparatus applicable to an image forming method of the invention.

FIG. 4 is a schematic sectional view of an image forming apparatus (copying machine or laser printer) capable of forming a mono-color image, a multi-color image and a full-color image based on an electrophotographic process. The apparatus includes an elastic roller 5 of a medium resistivity as an intermediate transfer member and a transfer belt 10 as secondary transfer means.

The apparatus further includes a rotating drum-type electrophotographic photosensitive member (hereinafter called "photosensitive member" or "photosensitive drum") 1 as an image-bearing member, which rotates at a prescribed peripheral speed (process speed) in a clockwise direction as indicated by an arrow. The photosensitive member 1 comprises a support 1*a* and a photosensitive layer 1*b* thereon comprising a photoconductive insulating substance, such as a-Se, CdS, $ZnO_2$, OPC (organic photoconductor), and a-Si (amorphous silicon). The photosensitive member 1 may preferably comprise an a-Si photosensitive layer or OPC photosensitive layer.

The organic photosensitive layer may be composed of a single layer comprising a charge-generating substance and a charge-transporting substance or may be function-separation type photosensitive layer comprising a charge generation layer and a charge transport layer. The function-separation type photosensitive layer may preferably comprise an electroconductive support, a charge generation layer, and a charge transport layer arranged in this order. The organic photosensitive layer may preferably comprise a binder resin, such as polycarbonate resin, polyester resin or acrylic resin, because such a binder resin is effective in improving transferability and cleaning characteristic and is not liable to cause toner sticking onto the photosensitive member or filming of external additives.

In the present invention, a charging step may be performed by using a corona charger which is not in contact with the photosensitive member 1 or by using a contact charger, such as a charging roller. The contact charger as shown in FIG. 4 may preferably be used in view of efficiency of uniform charging, simplicity and a lower ozone-generating characteristic.

The charging roller 2 comprises a core metal 2*b* and an electroconductive elastic layer 2*a* surrounding a periphery of the core metal 2*b*. The charging roller 2 is pressed against the photosensitive member 1 at a prescribed pressure (pressing force) and rotated mating with the rotation of the photosensitive member 1.

The charging step using the charging roller may preferably be performed under process conditions including an applied pressure of the roller of 5–500 g/cm, an AC voltage of 0.5–5 kVpp, an AC frequency of 50–5 kHz and a DC voltage of ±0.2–±1.5 kV in the case of applying AC voltage and DC voltage in superposition; and an applied pressure of the roller of 5–500 g/cm and a DC voltage of ±0.2–±1.5 kV in the case of applying DC voltage.

Other charging means may include those using a charging blade or an electroconductive brush. These contact charging means are effective in omitting a high voltage or decreasing the occurrence of ozone. The charging roller and charging blade each used as a contact charging means may preferably comprise an electroconductive rubber and may optionally comprise a releasing film on the surface thereof. The releasing film may comprise, e.g., a nylon-based resin, polyvinylidene fluoride (PVDF) or polyvinylidene chloride (PVDC).

In the course of rotation, the photosensitive member 1 is uniformly charged to prescribed polarity and potential by the primary charging roller 2 and then exposed to image light 3 from an unshown imagewise exposure means (e.g., a system for color separation of a color original image and focusing exposure, or a scanning exposure system including a laser scanner for outputting a laser beam modified corresponding to time-serial electrical digital image signals based on image data) to form an electrostatic latent image corresponding to a first color component image (e.g., yellow image) of the objective color image.

Then, the electrostatic latent image is developed with a yellow toner (as a first color toner) in a first developing device 4-1. The developing device 4-1 constitutes an apparatus unit which is detachably mountable to a main assembly of the image forming apparatus, and an enlarged view thereof is shown in FIG. 5.

Figure 5:
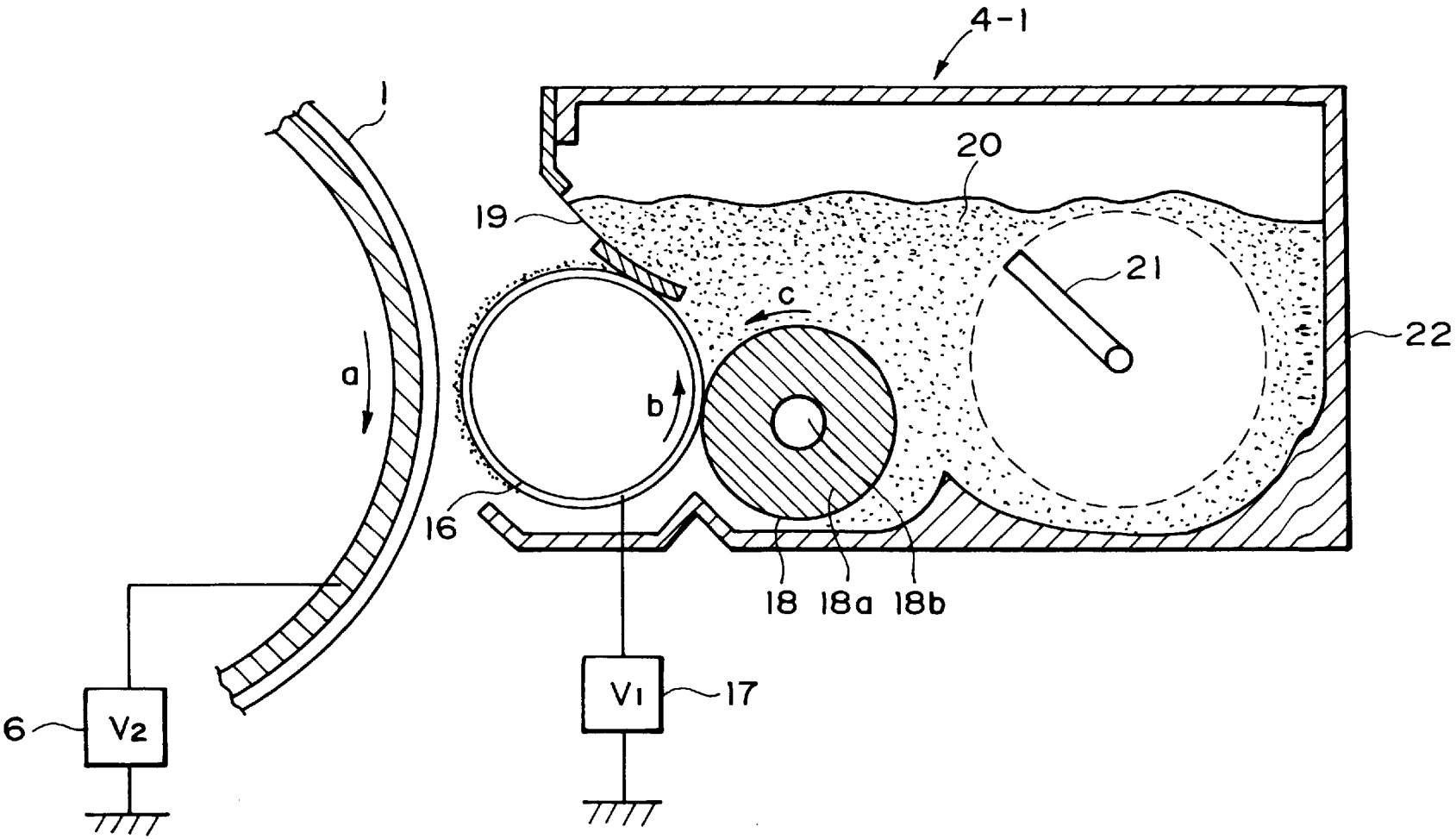
FIG. 5 is a schematic illustration of an example of developing apparatus unit suitably used in the apparatus of FIG. 4.
Figure 6:
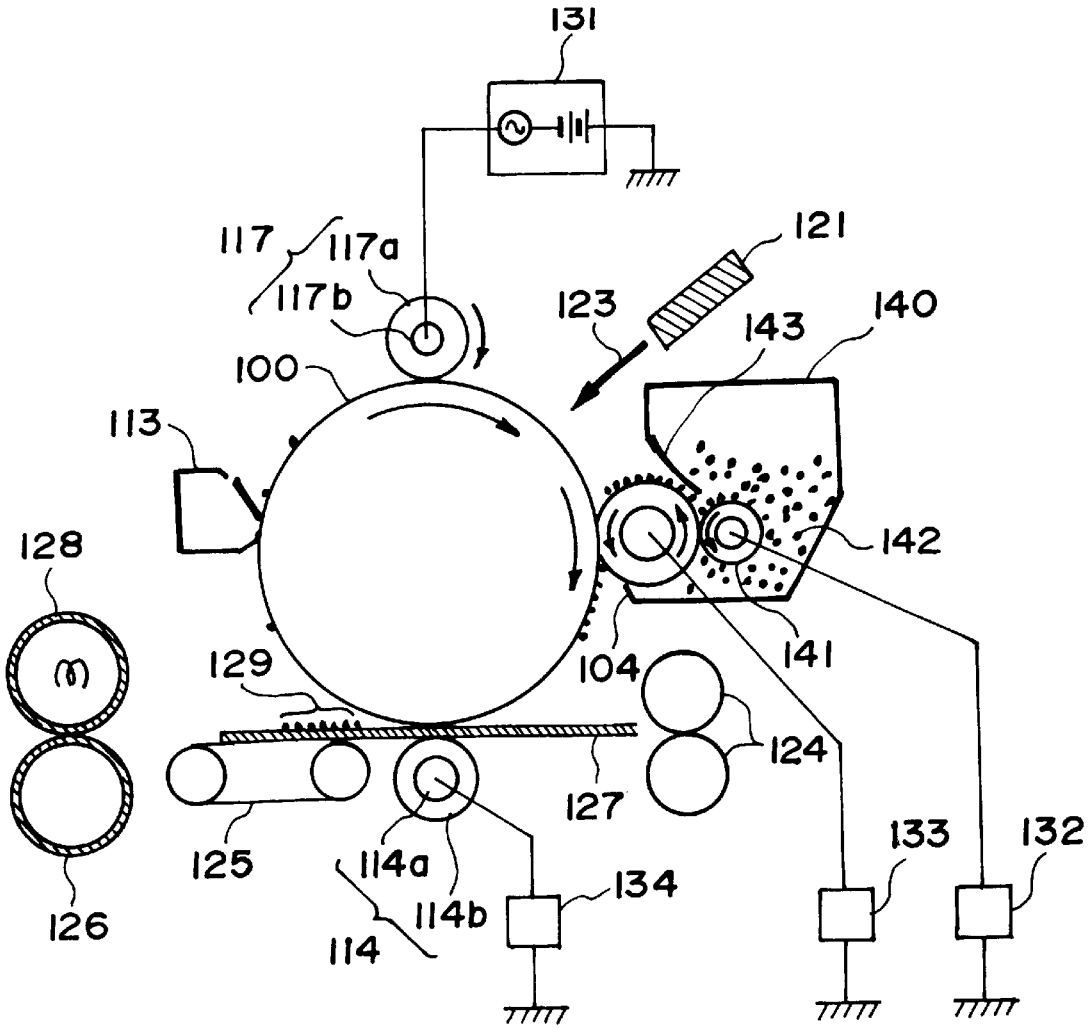
FIG. 6 is a schematic illustration of another example of image forming apparatus applicable to an image forming method of the invention.

Referring to FIG. 5, the developing device 4-1 includes an outer wall or casing 22 enclosing a mono-component non-magnetic toner 20. Being half enclosed within the outer wall 22, a developing sleeve 16 (as a toner-carrying member) is disposed opposite to the photosensitive member 1 rotating in an indicated arrow a direction and so as to develop the electrostatic image on the photosensitive member 1 with the toner carried thereon, thereby forming a toner image on the photosensitive member 1. As shown in FIG. 6, a right half of the developing sleeve 16 is protruded and enclosed in the outer wall 22 and a left half thereof is exposed out of the outer wall 22 and disposed in a lateral position with the photosensitive member 1 and so as to be movable in an indicated arrow b direction while facing the photosensitive member 1. A small gap is left between the developing sleeve 16 and the photosensitive member 1.

The toner-carrying member need not be in a cylindrical form like the developing sleeve 16, but can be in an endless belt form driven in rotation or composed of an electroconductive rubber roller.

In the outer 22, an elastic 19 (as an elastic regulation member) is disposed above the developing sleeve 16, and a toner application roller 18 is disposed upstream of the elastic 19 in the rotation direction of the developing sleeve 16. The elastic regulation member can also be an elastic roller.

The elastic 19 is disposed with a downward inclination toward the upstream side of the rotation direction of the developing sleeve, and abutted counterdirectionally against an upper rotating peripheral surface of the developing sleeve.

The toner application roller 18 is abutted rotatably against a side of the developing sleeve 16 opposite to the photosensitive member 1.

In the developing device 4-1 having the above-described structure, the toner application roller 18 is rotated in an arrow c direction to supply the toner 20 to the vicinity of the developing sleeve 16 and, at an abutting position (nip position) with the developing sleeve 16, frictionally applies or attaches the toner 20 onto the developing sleeve 16.

Along with the rotation of the developing sleeve 16, the toner 20 attached to the developing sleeve 16 is caused to pass between the elastic blade 19 and the developing sleeve 16 at their abutting position, where the toner is rubbed with the surfaces of both the developing sleeve 16 and the elastic blade 19 to be provided with a sufficient triboelectric charge.

The thus triboelectrically charged toner 20 having passed through the abutting position between the developing sleeve 16 and the elastic 19 forms a thin layer of yellow toner to be conveyed to a developing position facing the photosensitive member 1. At the developing position, the developing sleeve 16 is supplied with a DC-superposed AC bias voltage by a bias application means 17, whereby the toner 20 on the developing sleeve is transferred and attached onto the electrostatic image on the photosensitive member 1, to form a toner image.

A portion of the toner 20 remaining on the developing sleeve 16 without being transferred onto the photosensitive member 1 at the developing position is recovered into the outer 22 while passing below the developing sleeve 16 along with the rotation of the developing sleeve 16.

The recovered toner 20 is peeled apart from the developing sleeve 16 by the toner application roller 18 at the abutting position with the developing sleeve 16. Simultaneously therewith, a fresh toner 20 is supplied to the developing sleeve 16 by the rotation of the toner application roller 18, and the fresh toner 20 is again moved to the abutting position between the developing sleeve and the elastic blade 19.

On the other hand, most of the toner 20 peeled apart from the developing sleeve 16 is mixed with the remaining toner 20 in the outer 22, whereby the triboelectric charge of the peeled-apart toner is dispersed therein. A portion of the toner at a position remote from the toner application roller 18 is gradually supplied to the toner application roller 18 by a stirring means 21.

The toner according to the present invention exhibits good developing performance and continuous image forming characteristic in the above-described non-magnetic monocomponent developing step.

The developing sleeve 16 may preferably comprise an electroconductive cylinder of a metal or alloy, such as aluminum or stainless steel, but can be composed of an electroconductive cylinder formed of a resin composition having sufficient mechanical strength and electroconductivity. The developing sleeve 16 may comprise a cylinder of a metal or alloy surface-coated with a coating layer of a resin composition containing electroconductive fine particles dispersed therein.

The electroconductive particles may preferably exhibit a volume resistivity of at most 0.5 ohm.cm after compression at 120 kg/cm$^2$. The electroconductive fine particles may preferably comprise carbon fine particles, a mixture of carbon fine particles and crystalline graphite powder, or crystalline graphite powder. The electroconductive fine particles may preferably have a particle size of 0.005–10 $\mu$m.

Example of the resin material constituting the resin composition may include: thermoplastic resins, such as styrene resin, vinyl resin, polyethersulfone resin, polycarbonate resin, polyphenylene oxide resin, polyamide resin, fluorine-containing resin, cellulosic resin, and acrylic resin; and thermosetting or photocurable resins, such as epoxy resin, polyester resin, alkyd resin, phenolic resin, melamine resin, polyurethane resin, urea resin, silicone resin, and polyimide resin.

Among the above, it is preferred to use a resin showing a releasability such as silicone resin or fluorine-containing resin; or a resin showing excellent mechanical properties, such as polyethersulfone, polycarbonate, polyphenylene oxide, polyamide, phenolic resin, polyester, polyurethane or styrene resin. Phenolic resin is particularly preferred.

The electroconductive fine particles may preferably be used in 3–20 wt. parts per 100 wt. parts of the resin component.

In the case of using a mixture of carbon fine particles and graphite particles, it is preferred to use 1–50 wt. parts of carbon fine particles per 100 wt. parts of graphite particles.

The electroconductive particle-dispersed resin coating layer of the sleeve may preferably show a volume resistivity of $10^{-6}$–$10^{6}$ ohm.cm.

The image forming apparatus shown in FIG. 4 further includes a developing device 4-2, a developing device 4-3 and a developing device 4-4, each of which may be a non-magnetic mono-component developing device having a structure similar to that of the developing device 4-1 described above with reference to FIG. 5. Thus, the developing devices 4-1, 4-2, 4-3 and 4-4 are arranged, e.g., as yellow, magenta, cyan and black developing devices, respectively, containing the respective color toner images.

However, only the black developing device, e.g., 4-4, can be of a magnetic monocomponent type using an insulating magnetic toner as desired.

The intermediate transfer member 5 is driven in rotation at an identical peripheral speed as the photosensitive drum 1 in an indicated arrow direction.

The first-color toner image formed on the photosensitive drum 1 is intermediately transferred onto an outer peripheral surface of the intermediate transfer member 5 in the course of passing through a nip position between the photosensitive drum 1 and the intermediate transfer member 5 under the action of a pressure and an electric field formed by a primary transfer bias voltage (e.g., a positive voltage opposite to the polarity of the toner charge) supplied from a bias supply means 6 to the intermediate transfer member 5. The intermediate transfer member can be in the form of an endless belt instead of the drum 5 as shown.

Thereafter, a second-color toner image, a third-color toner image and a fourth-color toner image are similarly and successively transferred in superposition onto the intermediate transfer member 5 to form thereon a synthetic color toner image corresponding to the objective color image.

The transfer belt 10 (as a secondary transfer means) is wound about a bias roller 11 and a tension roller 12 having shafts extending in parallel with the rotation axis of the intermediate transfer member 5 so as to contact a lower peripheral surface of the transfer member 5. The bias roller 11 is supplied with a prescribed secondary transfer bias voltage from a bias supply 23, and the tension roller 12 is grounded.

During the successive transfer of the first to fourth color toner images from the photosensitive drum 1 to the intermediate transfer member 5, the transfer belt 10 and an intermediate transfer member cleaning roller 7 may be separated from the intermediate transfer member 5.

The synthetic color toner image superposedly transferred onto the intermediate transfer member 5 may be transferred onto a transfer material P by abutting the transfer belt 10 against the intermediate transfer member 5, supplying the transfer material P from a paper supply cassette (not shown) via resist rollers 13 and a transfer pre-guide 24 to a nip position between the intermediate transfer member 5 and the transfer belt 10 at a prescribed timing, and simultaneously applying a secondary transfer bias (voltage) from the bias supply 23 to the bias roller 11. Under the action of the secondary transfer bias, the synthetic color toner image is transferred from the intermediate transfer member 5 to the transfer material P. This step is called a secondary transfer (step) herein.

The transfer material P carrying the toner image transferred thereto is introduced into a heat-pressure fixing device 25 comprising a heating roller 14 and a pressing roller 15 where the toner image is fixed onto the transfer material P. The toner according to the present invention can be well fixed without applying an offset-preventing agent, such as silicone oil, onto the heating roller.

The intermediate transfer member 5 comprises a pipe-like electroconductive core metal 5*b* and a medium resistance-elastic layer 5*a* (e.g., an elastic roller) surrounding a periphery of the core metal 5*b*. The core metal 5*b* can comprise a plastic pipe coated by electroconductive plating. The medium resistance-elastic layer 5*a* may be a solid layer or a foamed material layer in which an electroconductivity-imparting substance, such as carbon black, zinc oxide, tin oxide or silicon carbide, is mixed and dispersed in an elastic material, such as silicone rubber, teflon rubber, chloroprene rubber, urethane rubber or ethylene-propylene-diene terpolymer (EPDM), so as to control an electric resistance or a volume resistivity at a medium resistance level of $10^5$–$10^{11}$ ohm.cm, particularly $10^7$–$10^{10}$ ohm.cm. The intermediate transfer member 5 is disposed under the photosensitive member 1 so that it has an axis (or a shaft) disposed in parallel with that of the photosensitive member 1 and is in contact with the photosensitive member 1. The intermediate transfer member 5 is rotated in the direction of an arrow (counterclockwise direction) at a peripheral speed identical to that of the photosensitive member 1.

After the intermediate transfer of the respective toner image, the surface of the intermediate transfer member 5 is cleaned, as desired, by a cleaning means 10 which can be attached to or detached from the image forming apparatus. In case where the toner image is placed on the intermediate transfer member 5, the cleaning means 10 is detached or released from the surface of the intermediate transfer member 5 so as not to disturb the toner image.

For example, the cleaning of the intermediate transfer member 5 may be performed simultaneously with the primary transfer from the photosensitive drum 1 to the intermediate transfer member 5 by transferring the residual toner on the intermediate transfer member 5 after the secondary transfer back to the photosensitive drum 1 and recovering the re-transferred toner by the cleaner 9 of the photosensitive drum 1. The mechanism is described below.

A toner image formed on the intermediate transfer member 5 is transferred onto a transfer material sent to the transfer belt 10 under the action of a strong electric field caused by a secondary transfer bias of a polarity opposite to the charged polarity (negative) of the toner image applied to the bias roller 11.

At this time, the secondary transfer residual toner remaining on the intermediate transfer member 5 without being transferred to the transfer material P is frequently charged to a polarity (positive) reverse to the normal polarity (negative). However, this doe not mean that all the secondary transfer residual toner is charged to a reverse polarity (positive), but a portion thereof has no charge due to neutralization or retains a negative polarity.

Accordingly, a charging means 7 for charging such a portion of toner having no charge due to neutralization or retaining a negative polarity to a reverse polarity of positive is disposed after the secondary transfer position and before the primary transfer position. As a result, almost all the secondary transfer residual toner can be returned to the photosensitive member 1.

When the reverse-transfer of the secondary transfer residual toner to the photosensitive member 1 and the primary transfer of the toner image formed on the photosensitive member 1 to the intermediate transfer member 5 are performed simultaneously, the secondary transfer residual toner reversely charged on the intermediate transfer member 5 and the normal toner for the primary transfer are not substantially neutralized with each other at the nip position between the photosensitive member 1 and the intermediate transfer member 5, but the reversely charged toner and the normally charged toner are transferred to the photosensitive member 1 and the intermediate transfer member 5, respectively.

This is because the transfer bias voltage is suppressed at a low level so as to cause only a weak electric field at the primary transfer nip between the photosensitive member 1 and the intermediate transfer member 5, thereby suppressing the occurrence of discharge at the nip and the polarity inversion of the toner at the nip.

Further, as the triboelectrically charged toner is electrically insulating so that portions thereof charged to opposite polarities do not cause polarity inversion or neutralization in a short time.

Accordingly, the secondary transfer residual toner charged positively on the intermediate transfer member 5 is transferred to the photosensitive member 1, and the negatively charged toner image on the photosensitive member 1 is transferred to the intermediate transfer member 5, thus behaving independently from each other.

In the case of forming an image on one sheet of transfer material P in response to one image formation initiation signal, it is possible that, after the secondary transfer, the toner image transfer from the photosensitive member 1 to the intermediate transfer member is not performed, but only the secondary transfer residual toner remaining on the intermediate transfer member 5 is reversely transferred to the photosensitive member 1.

In a specific embodiment, a cleaning roller 7 comprising an elastic roller having plural layers may be used as a contact charging means for charging the secondary transfer residual toner on the intermediate transfer member 5.

A second embodiment of the image forming method according to the present invention is characterized by including:

a charging step of charging an image bearing member;

an exposure step of exposing the charged image bearing member to image light to form an electrostatic latent image on the image member, a developing step of developing the electrostatic latent image on an image bearing member with a layer of the toner according to the present invention carried on a toner-carrying member in contact with the image bearing member to form a toner image on the image bearing member, and a transfer step of transferring the toner image on the image bearing member to a transfer member.

In this embodiment of the image forming method according to the present invention, various charging methods can be used, including a contact charging method wherein a charging member is abutted against a photosensitive member, as a suitable one. If an ordinary toner is used in this contact charging system, a residual toner possibly remaining after the cleaning step can be attached to the charging member in a later step to cause a charging failure, thus resulting in image defects caused by charging irregularity. Accordingly, compared with the case of a corona charging system wherein the charging member is free from contact with the photosensitive member, the fog and residual toner amount should be further strictly suppressed. Accordingly, a toner used in the contact charging system is required to exhibit a better chargeability leading to better developing performance and fog-freeness and higher transferability. This requirement of the toner is best fulfilled by the toner according to the present invention comprising the aromatic metal compound present at the toner particle surfaces and having a strictly specified circularity.

In this embodiment of the image forming method according to the present invention, it is essential that the toner-carrying member and the photosensitive member surface contact each other, and a reversal developing scheme is further preferred.

It is possible that the toner-carrying member comprises an elastic roller, and a layer of toner applied onto the elastic roller is caused to contact the photosensitive member surface. In this case, as the development is effected in an electric field formed between the photosensitive member and the elastic member disposed opposite to the photosensitive member via the toner, it is necessary that the surface or proximity thereto of the elastic roller has a potential, and an electric field is formed across a narrow gap between the photosensitive surface and the elastic roller surface. For this purpose, it is possible to control the resistivity of the elastic roller surface material to a medium resistivity level to retain an electric field while avoiding electrical continuity to the photosensitive member surface, or coat an electroconductive roller with a thin layer of insulating material. It is further possible to use an electroconductive roller sleeve coated with a thin insulating resin layer on the surface thereof opposite to the photosensitive member, or an insulating sleeve coated with an electroconductive layer on its (inner) surface not facing the photosensitive member. It is also possible to use a toner-carrying member in the form of a rigid roller in combination with a flexible belt-like photosensitive member. The developing roller (toner-carrying member) may preferably exhibit a resistivity in the range of $10^2$–$10^9$ ohm.cm.

The toner-carrying member may preferably have a surface roughness Ra ($\mu$m) of 0.2–3.0 so as to provide a high image quality and a high continuous image forming performance in combination. The surface roughness Ra is correlated with the toner-conveying performance and toner-charging performance. If the surface roughness Ra exceeds 3.0, it becomes difficult to form a thin toner layer on the toner-carrying member and the toner-charging performance is not improved, so that an improved image quality cannot be expected. By suppressing the roughness to at most 3.0, the toner-conveying performance on the toner-carrying member is suppressed to form a thin toner layer on the toner-carrying member and increase the opportunity of contact with the toner, thereby improving the toner-charging performance, thereby synergistically improving the image quality. On the other hand, if the surface roughness Ra is below 0.2, it becomes difficult to control the coating amount. The coating amount of the toner on the toner-carrying member may preferably be at a level of 0.1–3.0 mg/cm$^2$.

Herein, the surface roughness Ra of a toner carrying member refers to a center line-average roughness as measured by using a surface roughness meter ("SURFCODER SE-30H", mfd. by K.K. Kosaka Kenkyusho) according to JIS B-0601. More specifically, a roughness curve is drawn by a measurement of roughness along a generatrix (x-axis) of a cylindrical sleeve (toner carrying member) and a roughness is taken y ($\mu$m) (=f(x) for a length of a (mm) as a function of distance x ($0 \leqq x \leqq a$), whereby a surface roughness is calculated according to the following formula:

$$Ra(\mu m) = (1/a)\int_0^a |f(x)|\,dx.$$

In this embodiment of the image forming method according to the present invention, the toner carrying member can be rotated in a direction providing a peripheral movement identical to or reverse to that of the photosensitive member. However, it is preferred that the toner-carrying member is rotated in a direction of providing a peripheral movement identical to that of the photosensitive member particularly at a peripheral speed which is 1.05–3.0 times that of the photosensitive member.

If the peripheral speed of the toner-carrying member is less than 1.05 times that of the photosensitive member, the toner on the photosensitive member can receive only an insufficient stirring effect so that it becomes difficult to provide a good image quality. Further, in case of requiring a large amount of toner for developing, e.g., a solid image, the toner supply onto the electrostatic latent image is liable to be insufficient, thus resulting in only a thin image. As the peripheral speed ratio is increased, the amount of toner supplied to the developing position is increased, and the frequency of toner attachment onto and removal from the latent image is increased, thus increasing toner supply to a necessary portion and increasing toner removal from an unnecessary portion to provide a more faithful image. However, if the peripheral speed ratio exceeds 3.0, the toner can be excessively charged to cause some problems, such as a lower image density, and also the toner receives a substantial mechanical stress to promote the toner deterioration and toner sticking onto the toner-carrying member.

The photosensitive member may suitably comprise a photosensitive drum or a photosensitive drum having an insulating layer of a photoconductive substance, such as a-Se, CdS, $ZnO_2$, OPC (organic photoconductor) or a-Si.

An OPC photosensitive member is provided by forming an organic photosensitive layer comprising, e.g., polycarbonate resin, polyester resin or acrylic resin which is preferred because of good transferability and cleanability, thus being less liable to cause cleaning failure, or toner melt-sticking or filming of external additive onto the photosensitive member.

Figure 7:
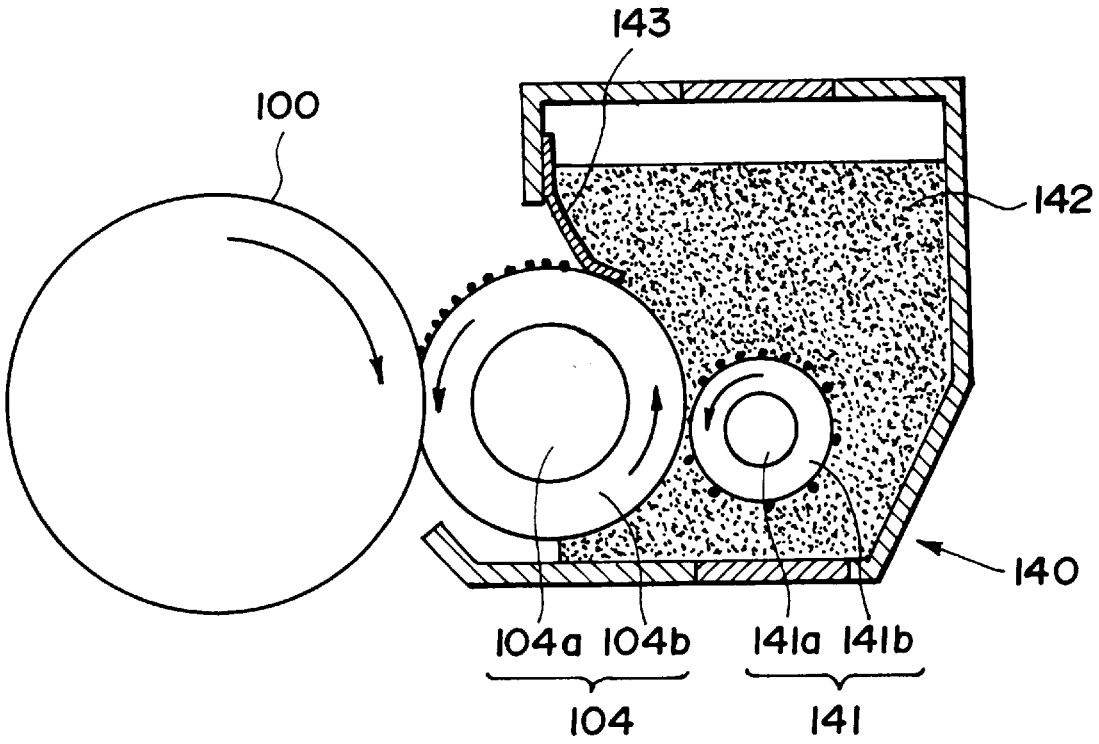
FIG. 7 is a schematic illustration of an example of developing apparatus unit suitably used in the apparatus of FIG. 6.

Now, this embodiment of the image forming method will now be described with reference to FIGS. 6 and 7 showing an example of apparatus suitable therefor.

Referring to FIG. 6, the image forming apparatus includes a developing device 140, a photosensitive member 100, a transfer-receiving material 127 such as paper, a transfer-promoting member 114, a fixing pressure roller 126, a fixing heating roller 128, and a primary charging member 117 for charging the photosensitive member in contact with the photosensitive member 100. The primary charging member 117 comprises a charging roller 117*a* and a core metal 117*b* which is connected to a bias voltage supply 131 so as to uniformly charge the surface of the photosensitive member 100.

The developing device 140 contains a toner 142 and is equipped with a toner-carrying member 104 rotating in the direction of an indicated arrow while being in contact with the photosensitive member 100. The developing device 140 further includes a developer regulating blade 143 for regulating the toner coating amount and charging the toner and a toner application roller 141 rotating in an indicated arrow direction for applying the toner 142 onto the toner-carrying member 104 and triboelectrically charging the toner through friction with the toner-carrying member 104. The toner-carrying member is connected to a developing bias-voltage supply 133. The application roller 141 is connected to a bias voltage supply 132 so as to receive a relatively negative voltage for a negatively chargeable toner or a relatively positive voltage for a positively chargeable toner compared with the developing bias voltage.

The transfer-receiving material 127 is supplied with a transfer voltage from a transfer promoting roller 114 that is connected to a transfer bias voltage supply 134 supplying a voltage of a polarity opposite to that of the photosensitive member 100.

The toner-carrying member 104 is caused to control the photosensitive member 100 so as to provide a developing nip width (i.e., a length of contact in a rotating direction) of preferably 0.2 to 8.0 mm. Below 0.2 mm, the developing performance becomes insufficient to fail in providing a sufficient image density and also fail in sufficient recovery of transfer residual toner. In excess of 8.0 mm, the toner supply becomes excessive, thus being liable to cause fog and promote the wearing of the photosensitive member 100.

The toner-carrying member 104 may preferably be an elastic roller having a surface elastic layer, which may suitably comprise an elastic material having a hardness (Asker C) of 20–65 deg.

The toner-carrying member 104 may preferably have a volume resistivity in a range of ca. $10^2$–$10^9$ ohm.cm. Below $10^2$ ohm.cm, an eddy current can flow if some pinholes are possibly present at the surface of the photosensitive member 100. On the other hand, above $10^9$ ohm.cm, the toner is liable to be excessively charged triboelectrically, thus causing a lowering in image density.

The toner may preferably be applied onto the toner-carrying member 104 at a coating rate of 0.1–2.0 mg/cm$^2$, more preferably 0.2–2.0 mg/cm$^2$. Below 0.1 mg/cm$^2$, it is difficult to obtain a sufficient image density. Above 2.0 mg/cm$^2$, it becomes difficult to uniformly triboelectrically charge all the individual toner particles, thus being liable to cause fog. A range of 0.2–1.2 mg/cm$^2$ is further preferred.

The toner coating rate can be controlled by the toner-regulating blade 143, which contacts the toner-carrying member 104 via the toner layer thereon. The contact pressure may preferably be in a range of 5–50 g/cm. Below 5 g/cm, not only the control of toner coating rate but also uniform charging become difficult, thus causing fog. On the other hand, above 50 g/cm, the toner particles are supplied with an excessive load to e deformed, and toner melt-sticking onto the blade 143 and the toner-carrying member 104 are liable to occur.

For the regulation of the toner coating rate, a metal blade or roller can also be used instead of an elastic blade for applying a pressure to the toner.

The elastic regulating member may preferably comprise a material having an appropriate position in a triboelectric chargeability series suitable for provides the toner with an appropriate charge of a desired polarity, which may for example be selected from elastomers, such as silicone rubber, urethane rubber and NBR (nitrile rubber), elastic synthetic resins such as polyurethane terephthalate, and elastic metals, such as stainless steel, copper and phosphor bronze. It is also possible to use a composite member of these elastic materials.

In case where the elastic regulating member and the toner-carrying member are required to have a durability, it is preferred to use a laminate of an elastic metal and a resin or rubber or a coated elastic metal so that the resin or rubber abut the toner-carrying member.

Further, the elastic regulating member can contain an organic material or an inorganic material added thereto, e.g., by melt-mixing or dispersion. For example, by adding a metal oxide, a metal powder, a ceramic, carbon allotrope, whisker, inorganic fiber, dye, pigment or a surfactant, the toner chargeability can be controlled. Particularly, in the case of using an elastic member formed of a rubber or a resin, it is preferred to add fine powder of a metal oxide, such as silica, alumina, titania, tin oxide, zirconia oxide or zinc oxide; carbon black; or a charge control agent generally used in toners.

Further, by applying a DC and/or AC electric field to the blade regulation member, or the supply roller or brush member, it becomes possible to exert a disintegration action onto the toner layer, particularly enhance the uniform thin layer application performance and uniform chargeability at the regulating position, and the toner supply/peeling position at the supply position, thereby providing increased image density and better image quality.

Referring again to FIG. 6, the primary charging member 117 is a charging roller comprising basically a core metal 117*b* and an electroconductive elastic layer 117*a* surrounding a periphery of the core metal 117*b*. The charging roller 117 is pressed against the outer surface of the photosensitive member 100 at a prescribed pressing force and rotates mating with the rotation of the photosensitive member 100.

The charging step using the charging roller 117 may preferably be performed under the process conditions including a roller pressing force of 5–500 g/cm. The supply voltage may be a DC voltage, an AC-superposed DC voltage, etc., and need not be particularly restricted. In case of a DC voltage alone, a voltage in a range of ±0.2–±5 kilo-volts may be used.

Other charging means may include those using a charging blade or an electroconductive brush. These contact charging means are effective in omitting a high voltage or decreasing the occurrence of ozone. The charging roller and charging blade each used as a contact charging means may preferably comprise an electroconductive rubber and may optionally comprise a releasing film on the surface thereof. The releasing film may comprise, e.g., a nylon-based resin, polyvinylidene fluoride (PVDF) or polyvinylidene chloride (PVDC).

Subsequent to the primary charging step, the photosensitive member 100 is exposed to image light 123 from a light emission device 121 to form an electrostatic latent image on the photosensitive member 100 corresponding to data signals carried on the image light 123, and the electrostatic latent image is developed with the toner carried by the toner-carrying member 104 at a position in contact with the toner-carrying member 104, to form a toner image on the photosensitive member 600. In this developing step, particularly a digital latent image, i.e., a latent image comprising an assembly of exposed digital spots, may be faithfully developed without disturbing the latent image dots. Then, the visual toner image on the photosensitive member 100 is transferred onto a transfer(-receiving) material 127 (as an example of transfer member) with the aid of a transfer-promoting member 114. After the transfer, the surface of the photosensitive member 100 is cleaned by a cleaning device 113. Incidentally, the cleaning device 113 can be omitted in case where the toner transfer efficiency is high. In this case, a control is performed by applying a DC or AC bias voltage component so as to recover the residual toner on the photosensitive member during a period of development or a blank period after the development. More specifically, the residual toner is passed between the photosensitive member 100 and the primary charging member 117 to again reach the developing nip whereby the toner is recovered via the toner-carrying member 104 to the developing device. Then, the transferred toner image 129 on the transfer material 127 is passed together with the transfer material 127 between the fixing pressure roller 126 and the fixing heating roller 128 to be fixed as a permanent image on the transfer material 127. In this embodiment, a hot roller fixing means comprising a combination of a heating roller 128 enclosing a heat-generating member, such as a halogen heater, and an elastic pressure roller 126 pressed against the heating roller 128 is used as a heat-pressure fixing means, but a heat fixing means including a heater for heating the toner image via a film may also be used.

Now, an image forming system using an intermediate transfer belt (as another example of transfer member) will be described with reference to FIG. 8.

Figure 8:
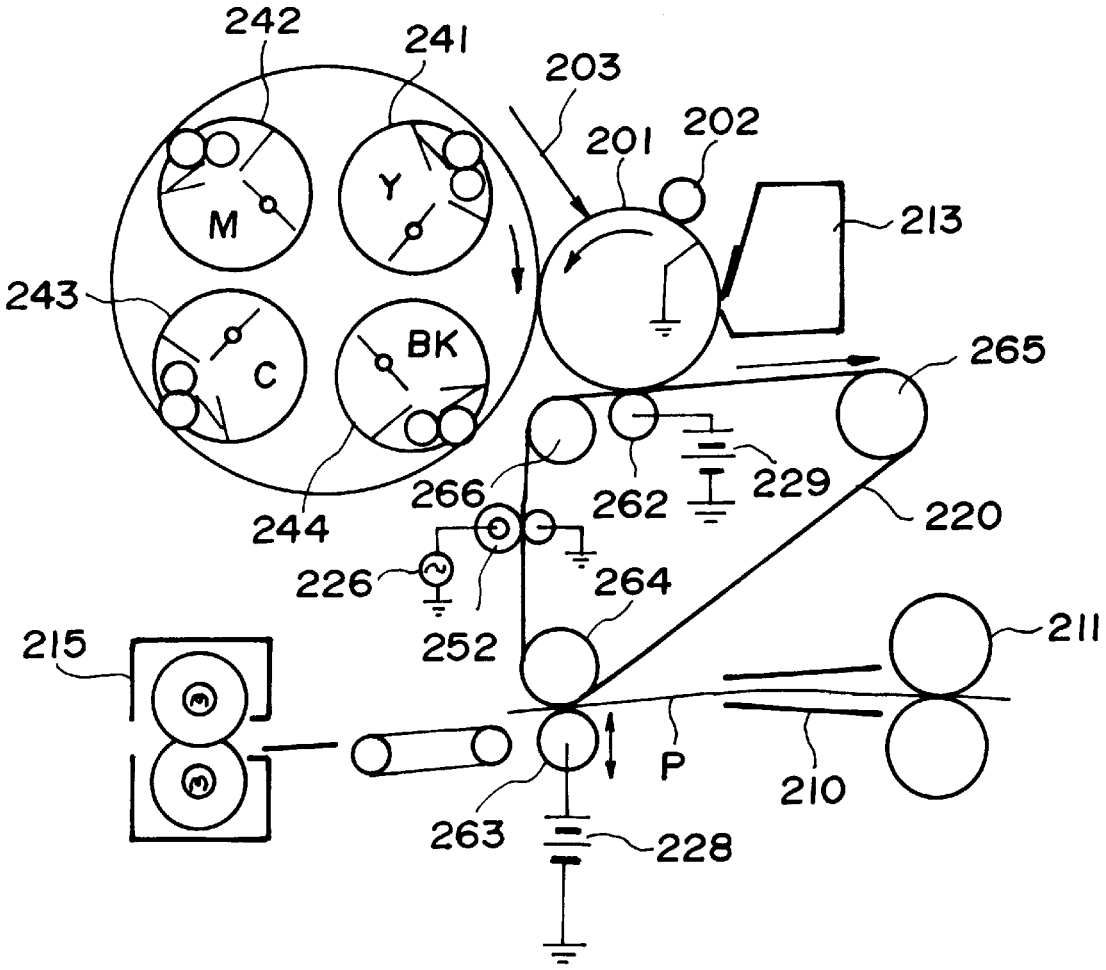
FIG. 8 is a schematic illustration of an example of a full-color image forming apparatus including an intermediate transfer member applicable to an image forming method according to the invention.

FIG. 8 is a schematic illustration of a color image forming apparatus (copying machine or printer) utilizing electrophotography.

Referring to FIG. 8, the image forming apparatus includes a drum-shaped electrophotographic photosensitive member 201 which is driven in rotation in an indicated arrow direction at a prescribed peripheral speed (process speed).

During the rotation, the photosensitive drum 201 is uniformly charged to prescribed polarity and potential by a primary charger 202 and then exposed to image light 203 supplied from an imagewise exposure means (not shown) to form an electrostatic latent image corresponding to a first color component image (e.g., a yellow color component image) of an objective color image.

Then, the electrostatic latent image is developed into a yellow (first-color) component image by a yellow developing device 241. At this time, second to fourth developing devices (i.e., magenta developing device 242, cyan developing device 243 and black developing device 244) are not operated and do not act on the photosensitive drum 201, so that the yellow-component image on the photosensitive drum 201 is not affected by the second to fourth developing devices.

The intermediate transfer belt 220 is driven in rotation in an indicated arrow direction.

When the first-color yellow component image formed on the photosensitive member 201 passes through a nip between the photosensitive member 201 and the intermediate transfer belt 220, the yellow component color image is gradually transferred onto an outer peripheral surface of the intermediate transfer belt 220 under the action of an electric field formed by a primary transfer bias voltage applied onto the intermediate transfer belt 220 applied from a bias voltage supply 229 via a primary transfer roller 262.

After completing the transfer of the first-color yellow toner image onto the intermediate transfer belt 220, the surface of the photosensitive drum 201 is cleaned by a cleaning device 213.

Thereafter, a second-color magenta toner image, a third-color cyan toner image and a fourth-color black toner image, are sequentially transferred in superposition on the intermediate transfer belt 220, to form a synthetic color toner image corresponding to an objective color image.

A secondary transfer roller 263 is disposed in an axially parallel position with respect to a secondary transfer counter-roller 264 and in contact with and separably from the lower surface of the intermediate transfer belt 220.

The primary transfer bias voltage for transferring a toner image from the photosensitive drum 201 to the intermediate transfer belt 220 is supplied from the bias-voltage supply 229 in a polarity opposite to that of the toner. The voltage is for example in the range of +100 volts to +2000 volts.

During the steps of transfer of first-color to third-color toner images from the photosensitive drum 201 to the intermediate transfer drum 220, the secondary transfer roller 263 and the transfer residual toner charger 252 can be separated from the intermediate transfer belt 202, as desired.

By abutting the secondary transfer roller 263 against the intermediate transfer belt 200, the full-color image transferred onto the intermediate transfer belt 220 is transferred onto a transfer material P supplied from a paper supply roller 211 to an abutting position between the intermediate transfer belt 220 and the secondary transfer roller 263 under application of a secondary transfer bias voltage onto the secondary transfer roller 263 (secondary transfer). The transfer material P having received the toner image is then introduced into a fixing device 215 where the toner image is heat-fixed onto the transfer material P.

After the toner image transfer onto the transfer material P, a transfer residual toner cleaning device 252 is abutted against the intermediate transfer belt 220, and a bias voltage of a polarity opposite to the photosensitive drum 201 is applied, whereby a transfer residual toner remaining on the intermediate transfer belt 220 without being transferred onto the transfer material P is imparted with a charge opposite to that of the photosensitive drum.

The transfer residual toner is electrostatically transferred onto the photosensitive drum 201 at a position of abutment against the photosensitive drum 201 or a position close thereto, whereby the intermediate transfer belt 220 is cleaned.

As described above, according to the present invention, high-quality images can be obtained at a high density without causing back-transfer by using a toner containing an aromatic metal compound present at toner particle surfaces and having an average circularity of at least 0.955. Further, in case where the toner is used in the image forming method including a developing step according to a contact development scheme, high-quality images can be formed at a high transfer rate even after a late stage of continuous image formation.

EXAMPLES

Hereinbelow, the present invention will be described more specifically based on Examples.

Example 1

Into a four-necked flask equipped with a high-speed stirrer ("TK-Homomixer", available from Tokushu Kika Kogyo K.K.), 910 wt. parts of deionized water and 450 wt. parts of 1 mol/liter-$Na_2PO_4$ aqueous solution were placed and warmed to 55° C. under stirring at 12000 rpm. To the system, 68 wt. parts of 1.0 mol/liter-$CaCl_2$ aqueous solution was gradually added to form an aqueous dispersion medium containing finely dispersed hardly water-soluble dispersion stabilizer $Ca_3(PO_4)_2$.

| | |
|---|---|
| Styrene monomer | 160 wt.parts |
| n-Butyl acrylate | 40 " |
| Yellow pigment (Pigment Yellow 17) | 20 " |
| Release agent | 30 " |
| Polyester (Reaction product of terephthalic acid and bisphenol A, Mw = $3 \times 10^4$) | 20 " |
| Amorphous dialkylsalicylic acid aluminum complex compound A | 2 " |

The above ingredients were dispersed for 3 hours by an attritor, and 4 wt. parts of 2,2'-azobis(2,4-dimethylvaleronitrile) (polymerization initiator) was added thereto to form a polymerizable monomer composition, which was then dispersed into the above-prepared aqueous dispersion medium under the identical stirring speed for 10 min. to form monomer droplets therein. Then, the high-speed stirrer was replaced by a propeller blade stirrer, and then polymerization was performed at 50 rpm, first at 55° C. for 1 hour, then at 60° C. for 4 hours, and at 80° C. for 5 hours.

After the polymerization, the slurry was cooled, and dilute hydrochloric acid was added thereto to remove the dispersion stabilizer.

The polymerizate was further washed and dried to obtain Yellow toner particles 1 having a weight-average particle size (D4) of 7.2 $\mu$m and an average circularity ($\overline{C}$) of 0.982.

100 wt. parts of the thus-obtained Yellow toner particles 1 and 0.15 wt. part of amorphous dialkyl salicylic acid aluminum complex compound A were blended at a temperature below 45° C. for 5 min. in a Henschell mixer at a blade peripheral speed of 50 m/sec, and then 1.5 wt. parts of hydrophobized silica was externally added thereto to obtain Yellow toner 1, which exhibited a weight-average particle size ($D_4$), an average circularity ($\overline{C}$) and a circularity standard deviation (SDc) inclusively shown in Table 1 hereinafter.

The mixture of Yellow toner particles 1 and amorphous dialkylsalicylic acid aluminum compound A after the Henschelll mixer stirring and before the silica external addition was observed through a SEM (scanning electron microscope) at magnifications of $10^4$ and $3\times10^4$, whereby the particle state of the amorphous dialkylsalicylic acid aluminum (Al) compound was observed at the toner particle surfaces but a uniform coverage of the toner particle surfaces was confirmed.

Incidentally, the above-mentioned amorphous dialkylsalicylic acid Al compound was obtained by adding a dialkylsalicylic acid alkaline aqueous solution to an $Al_2(SO_4)_3$ aqueous solution in a ratio of 2.6 mols of dialkylsalicylic acid per 1 mol of $Al_2(SO_4)_3$, under stirring, followed by recovery by filtration, washing with warm water and drying. The amorphous dialkylsalicylic acid Al compound exhibited an average primary particle size of 0.15 $\mu$m.

As a result of the X-ray diffraction analysis, the dialkylsalicylic acid Al compound provided a diffraction pattern free from any peak exhibiting a measurement intensity of at least $10^4$ cps and a half-value half-width of at most 0.3 deg. in a measurement angle 2θ range of 6–40 deg.

Magenta toner 1, Cyan toner 1 and Black toner 1 were prepared in the same manner as in preparation of Yellow toner 1 except for using a magenta pigment (Pigment Red 122), a cyan pigment (Pigment Blue 15:3) and carbon black, respectively, in place of the yellow pigment. The properties of the respective color toners thus prepared are also shown in Table 1 together with those of toners prepared in the following Examples.

The thus-obtained 4 color toners were respectively charged in developing devices 4-1 to 4-4 each having a structure as shown in FIG. 5, which were installed in an apparatus having an arrangement as shown in FIG. 4. Thus, the respective toners were subjected to an image forming test in a normal temperature/normal humidity (23° C./60% RH) environment under conditions including latent image potentials of −600 volts at dark part and −150 volts at light part, a developing contrast of 150 volts, a primary transfer bias voltage of +300 volts on the intermediate transfer member 5, and a secondary transfer bias voltage of +800 volts on the transfer belt 10.

The image forming tests were performed by changing the order of transfer of color toner in respective series of (1) yellow-magenta-cyan-black, (2) magenta-cyan-yellow-black, and (3) black-magenta-cyan-yellow. In each series, the resultant images exhibited a high image density and were clear images free from hollow image dropout. Further, regardless of the transfer order, the respective toners exhibited high primary transfer efficiency, high secondary transfer efficiency, and a low back-transfer rate. The results are inclusively shown in Table 3.

Example 2

Yellow toner 2, Magenta toner 2, Cyan toner 2 and Black toner 2 were prepared respectively in the same manner as in Example 1 except that the amorphous dialkylsalicylic acid aluminum compound A internally added was changed to crystal dialkylsalicylic acid zinc complex salt B, the stirring speed of the TK homomixer at the time of monomer droplet formation was changed to 15000 rpm, and 0.15 wt. part of the amorphous dialkylsalicylic acid aluminum compound A was changed to 0.01 wt. part of amorphous dialkylsalicylic acid zirconium compound C. The evaluation results of the respective toners are shown in Table 4.

As a result of the SEM observation in the same manner as in Example 1, the presence in a non-particle state of and a uniform coverage with the amorphous dialkylsalicylic acid zirconium compound C on the toner particle surfaces were confirmed after the mixing by the Henschell mixer and before the external silica addition.

The crystallinity of the internally added crystalline dialkylsalicylic acid zinc complex salt B was confirmed by its X-ray diffraction pattern showing a maximum peak at 2θ=6.58 deg. exhibiting a measurement intensity of 80000 cps and a half-value half-width of 0.21 deg. as shown in FIG. 3. Further, the amorphousness or low-crystallinity of the dialkylsalicylic acid zirconium complex compound C was confirmed by its X-ray diffraction pattern free from any peak exhibiting a measurement intensity of at least $10^4$ cps and a half-value half-width of at most 0.3 deg. in a measurement angle 2θ range of 6–40 deg.

Example 3

Yellow toner 3, Magenta toner 3, Cyan toner 3 and Black toner 3 were prepared in the same manner as in Example 1 except for increasing the amount of the externally added amorphous dialkylsalicylic acid aluminum complex compound A from 0.15 wt. part to 0.5 wt. part per 100 wt. parts of toner particles.

As a result of the SEM observation in the same manner as in Example 1. Yellow toner 3 before the external silica addition similarly exhibited the presence in a non-particle state of and a uniform coverage with the amorphous dialkylsalicylic acid aluminum compound A on the toner particle surfaces.

The thus-obtained four color toners were respectively charged in four color developing devices in a commercially available copying machine "CLC-700", mfd. by Canon K.K.) after remodeling and subjected to a full-color image forming test in a normal temperature/normal humidity (23° C./60% RH) environment under conditions including a developing contrast of 300 volts, latent image potentials on the photosensitive member including a dark-part potential of −500 volts and a light-part potential of −100 volts, a developing contrast of 300 volts, and transfer bias voltages of +2.5 kV for first color, +4.0 kV for second color, +5.5 kV for third color and +7.0 kV for fourth color.

The resultant images exhibited a high image density and were clear images free from hollow image dropout. All the toners exhibited very high transfer efficiency and back-transfer rate. As a result of a SEM observation of the carriers after continuous image formation on 10,000 sheets, forming test a slight degree of attachment of the dialkylsalicylic acid aluminum compound A was recognized. The evaluation results are shown in Table 5.

Example 4

Yellow toner 9, Magenta toner 4, Cyan toner 4 and Black toner 4 were prepared in the same manner as in Example 1 except that the internally added amorphous dialkylsalicylic acid aluminum compound was omitted during toner particle production, and subjected to an image forming test in the same manner as in Example 1.

The resultant images exhibited a high image density and were clear images free from hollow image dropout. The transfer efficiencies were slightly lower than in Example 1 but were sufficiently high and the back transfer rates were low for the respective color toner regardless of the transfer order. The evaluation results are shown in Table 6.

Example 5

| | |
|---|---|
| Polyester resin | 100 wt.parts |
| Yellow pigment | 5 " |
| Release agent | 4 " |
| Amorphous dialkylsalicylic acid zirconium compound C | 5 " |

The above ingredients were sufficiently preliminarily blended in a Henschell mixer and melt-kneaded through a twin-screw extruder at ca. 140° C. After cooling, the kneaded product was coarsely crushed into ca. 1–2 mm by a hammer mill and then finely pulverized by an air jet pulverizer, followed by classification to obtain Yellow toner particles 5a having a weight-average particle size (D4) of 8.6 μm and an average circularity ($\overline{C}$) of 0.951.

Yellow toner particles 5a were then subjected to a surface treatment for 3 min. by a hybridizer at 4000 rpm to obtain Yellow toner particles 5 having an average circularity ($\overline{C}$) of 0.963.

100 wt. parts of the thus-obtained Yellow toner particles 5 and 0.2 wt. part of the amorphous dialkylsalicylic acid aluminum complex compound A were blended at a temperature below 45° C. for 5 min. in a Henschell mixer at a blade peripheral speed of 50 m/sec, and then 1.5 wt. parts of hydrophobized silica was externally added thereto to obtain Yellow toner 5.

As a result of the SEM observation in the same manner as in Example 1. Yellow toner 5 before the external silica addition similarly exhibited the presence in a non-particle state of and a uniform coverage with the amorphous dialkylsalicylic acid aluminum compound A on the toner particle surfaces. Magenta toner 5, Cyan toner 5 and Black toner 5 were prepared in the same manner as in preparation of Yellow toner 5 above except for using a magenta pigment, a cyan pigment and carbon black, respectively, in place of the yellow pigment.

The thus-prepared four color toners were evaluated in an image formation test in the same manner as in Example 1. The evaluation results are shown in Table 7.

Comparative Example 1

100 wt. parts of Yellow toner particles 5a prepared in Example 5 and 0.2 wt. part of the amorphous dialkylsalicylic acid aluminum complex compound A were blended at a temperature below 45° C. for 5 min. in a Henschell mixer at a blade peripheral speed of 50 m/sec, and then 1.5 wt. parts of hydrophobized silica was externally added thereto to obtain Yellow toner 6.

Magenta toner 6, Cyan toner 6 and Black toner 6 were prepared in the same manner as in preparation of Yellow toner 6 above except for using a magenta pigment, a cyan pigment and carbon black, respectively, in place of the yellow pigment.

The thus-prepared four color toners were evaluated in an image formation test in the same manner as in Example 1. The resultant images exhibited some degree of hollow image dropout, which was however at a practically acceptable level. Fog-free images were continually obtained. All the color toners exhibited somewhat lower transfer efficiencies in both primary and secondary transfer. The back-transfer rate was low. The evaluation results are shown in Table 8.

As a result of the SEM observation in the same manner as in Example 1, Yellow toner 6 before the external silica addition exhibited that the amorphous dialkylsalicylic acid aluminum compound A failed to coat the concavities on the toner particles.

Example 6

| | |
|---|---|
| Styrene-butylacrylate-monobutyl maleate copolymer | 100 wt.parts |
| Magnetite | 80 " |
| Release agent | 4 " |
| Amorphous dialkylsalicylic acid aluminum compound A | 5 " |

The above ingredients were sufficiently preliminarily blended in a Henschell mixer and melt-kneaded through a twin-screw extruder at ca. 140° C. After cooling, the kneaded product was coarsely crushed into ca. 1–2 mm by a hammer mill and then finely pulverized by an air jet pulverizer, followed by classification to obtain Black toner particles 7a having a weight-average particle size (D4) of 8.3 μm and an average circularity ($\overline{C}$) of 0.944.

100 wt. parts of the thus-obtained Black toner particles 7a and 0.2 wt. part of the amorphous dialkylsalicylic acid aluminum complex compound A were subjected to a surface treatment for 3 min. by a hybridizer at 4000 rpm, and then 1.5 wt. parts of hydrophobized silica was externally added thereto by a Henschell mixer to obtain Black toner 7.

As a result of the SEM observation in the same manner as in Example 1, Black toner 7 before the external silica addition exhibited the presence in a non-particle state of and a uniform coverage with the amorphous dialkylsalicylic acid aluminum compound A on the toner particle surface.

The thus-obtained Black toner 7 was used together with Yellow toner 5, Magenta toner 5 and Cyan toner 5 used in Example 5 and evaluated in an image forming test in the same manner as in Example 1. The evaluation results are shown in Table 9.

Example 7

Yellow toner 8, Magenta toner 8, Cyan toner 8 and Black toner 8 were prepared in the same manner as in Example 1 except for changing the amount of the amorphous dialkylsalicylic acid aluminum complex compound A from 0.15 wt. part to 0.005 wt. part per 100 wt. parts of the respective color toner particles, and were evaluated in an image forming test in the same manner as in Example 1.

As a result, toners of an earlier transfer order exhibited a slightly higher back transfer rate but at a practically acceptable level. Images free from hollow image dropout or fog could be continually formed until the final stage of continuous image formation. The evaluation results are summarized in Table 10.

Example 8

Yellow toner 9, Magenta toner 9, Cyan toner 9 and Black toner 9 were prepared in the same manner as in Example 1 except that the amorphous dialkylsalicylic acid aluminum complex compound A was increased in amount from 0.15 wt. part to 1.0 wt. part and blended with 100 wt. parts of the respective color toner particles by a hybridizer at 4000 rpm for 5 min. instead of the Henschell mixer.

As a result of the SEM observation in the same manner as in Example 1, Yellow toner 7 before the external silica addition exhibited the presence in a non-particle state of and a uniform coverage with the amorphous dialkylsalicylic acid aluminum compound A on the toner particle surface.

The thus-obtained Yellow toner 9, Magenta toner 9, Cyan toner 9 and Black toner 9 were evaluated in an image forming test in the same manner as in Example 1. As a result, the primary transfer efficiency and the secondary transfer efficiency were both slightly lower but at a practically acceptable level. The back transfer rate was low. The resultant images were accompanied with slight hollow-image dropout and fog but they were at a practically acceptable level. The results are summarized in Table 11.

Example 9

Yellow toner 10, Magenta toner 10, Cyan toner 10 and Black toner 10 were prepared in the same manner as in Example 1 except that the externally added amorphous dialkylsalicylic acid Al compound was changed to 0.3 wt. part of amorphous monoazo Fe complex compound D per 100 wt. parts of respective color toner particles.

As a result of the SEM observation in the same manner as in Example 1, Yellow toner 10 before the external silica addition exhibited the presence in a non-particle state of and a uniform coverage with the amorphous monoazo Fe complex compound D on the toner particle surface.

The amorphousness or low-crystallinity of the monoazo Fe complex compound was confirmed by the absence on its X-ray diffraction pattern of any peak exhibiting a measurement intensity of at least $10^4$ cps and half-value half-width of at most 0.3 deg. in a measurement angle 2θ range of 6–40 deg.

The thus-obtained Yellow toner 10, Magenta toner 10, Cyan toner 10 and Black toner 10 were evaluated in an image forming test in the same manner as in Example 1. The evaluation results are shown in Table 12.

Example 10

Yellow toner 11, Magenta toner 11, Cyan toner 11 and Black toner 11 were prepared in the same manner as in Example 1 except that the externally added amorphous dialkylsalicylic acid Al compound was changed to 0.3 wt. part of amorphous dialkylsalicylic acid chromium complex compound F per 100 wt. parts of respective color toner particles.

As a result of the SEM observation in the same manner as in Example 1, Yellow toner 11 before the external silica addition exhibited that the amorphous dialkylsalicylic acid chromium Compound E was present in a non-particle state but the coverage therewith on the toner particle surfaces was spot-like and not uniform.

The thus-obtained Yellow toner 11, Magenta toner 11, Cyan toner 11 and Black toner 11 were evaluated in an image forming test in the same manner as in Example 1. The evaluation results are shown in Table 13.

The amorphousness or low-crystallinity of the dialkylsalicylic acid chromium complex compound E was confirmed by the absence on its X-ray diffraction pattern of any peak exhibiting a measurement intensity of at least $10^4$ cps and half-value half-width of at most 0.3 deg. in a measurement angle 2θ range of 6–40 deg. as shown in FIG. 2. More specifically, only a dull peak showing a measurement intensity of 4300 cps and a half-value half-width of ca. 4 at 2θ=14.32 deg.

The toners exhibited high primary and secondary transfer efficiencies. The resultant images were free from hollow image dropout or fog. However, the toners exhibited somewhat higher back-transfer rates.

Comparative Example 2

Yellow toner 12, Magenta toner 12, Cyan toner 12 and Black toner 12 were prepared in the same manner as in Example 1 except the internally and externally added amorphous dialkylsalicylic acid aluminum compound was omitted, and subjected to an image forming test in the same manner as in Example 1.

Regardless of transfer color orders, first-color and second color transferred toners exhibited high back-transfer rates, and the resultant images exhibited low image density and much fog and were also accompanied with hollow image dropout. The toners also exhibited low primary and secondary transfer efficiencies. The evaluation results are summarized in Table 14.

Comparative Example 3

Yellow toner 13, Magenta toner 13, Cyan toner 13 and Black toner 13 were prepared in the same manner as in Example 1 except that the internally added amorphous dialkylsalicylic acid Al compound was omitted and the externally added amorphous dialkylsalicylic acid Al compound was changed to 0.3 wt. part of the crystalline dialkylsalicylic acid zinc complex salt B used in Example 2 per 100 wt. parts of respective color toner particles.

As a result of the SEM observation in the same manner as in Example 1, Yellow toner 13 before the external silica addition exhibited that the crystalline dialkylsalicylic acid zinc complex salt was ununiformly embedded at the toner particle surfaces in a particle state and failed to coat the toner particle surfaces.

Yellow toner 13, Magenta toner 13, Cyan toner 13 and Black toner 13 were evaluated in an image forming test in the same manner as in Example 1. As a result, the resultant images were free from hollow image dropout. However, regardless of transfer color orders, the toners exhibited high back-transfer rates and resulted in ununiform images with irregularities. The evaluation results are summarized in Table 15.

Comparative Example 4

Yellow toner 14, Magenta toner 14, Cyan toner 14 and Black toner 14 were prepared in the same manner as in Example 1 except that the internally added amorphous dialkyl salicylic acid Al compound was omitted and the externally added amorphous dialkylsalicylic acid Al compound was changed to 0.25 wt. part of crystalline azo Fe complex compound F per 100 wt. parts of respective color toner particles.

The crystallinity of the azo Fe complex compound F was confirmed by its X-ray diffraction pattern showing a maximum peak at $2\theta$=13.6 deg. exhibiting a measurement intensity of 15000 cps and a half-value half-width=0.13 deg.

Yellow toner 14, Magenta toner 14, Cyan toner 14 and Black toner 14 were evaluated in an image forming test in the same manner as in Example 1. The evaluation results are shown in Table 14.

Comparative Example 5

Yellow toner 15, Magenta toner 15, Cyan toner 15 and Black toner 15 were prepared in the same manner as in Example 1 except that the externally added amorphous dialkylsalicylic acid Al compound was changed to 0.3 wt. part of aluminum oxide G per 100 wt. parts of respective color toner particles.

Yellow toner 15, Magenta toner 15, Cyan toner 15 and Black toner 15 were evaluated in an image forming test in the same manner as in Example 1. The evaluation results are shown in Table 17.

Comparative Example 6

Yellow toner 16, Magenta toner 16, Cyan toner 16 and Black toner 16 were prepared by externally blending 1.5 wt. parts each of hydrophobized silica with 100 wt. parts of respective color toner particles having an average circularity of ca. 0.963 after the hybridization prepared in Example 5.

Yellow toner 16, Magenta toner 16, Cyan toner 16 and Black toner 16 were evaluated in an image forming test in the same manner as in Example 1. As a result, the toners exhibited high primary and secondary transfer efficiencies, and the resultant images were free from hollow image dropout. However, regardless of transfer color order, the first-color and second-color transferred images exhibited high back-transfer rates, thus resulting in poor images having low image densities. The evaluation results are summarized in Table 18.

Example 11

Yellow toner 17, Magenta toner 17, Cyan toner 17 and Black toner 17 were prepared in the same manner as in Example 1 except for increasing the amount of the externally added amorphous dialkylsalicylic acid aluminum complex compound A was increased from 0.15 wt. part to 0.3 wt. part per 100 wt. parts of toner particles and the blending with respective color toner particles was performed for 5 min. at a blade peripheral speed of 50 m.sec at a temperature of below 45° C.

As a result of the SEM observation in the same manner as in Example 1. Yellow toner 17 before the external silica addition similarly exhibited the presence in a non-particle state of and a uniform coverage with the amorphous dialkylsalicylic acid aluminum compound A on the toner particle surfaces.

Yellow toner 17, Magenta toner 17, Cyan toner 17 and Black toner 17 were evaluated in an image forming test in the same manner as in Example 1. As a result, similarly as in Example 3, clear images free from hollow image dropout were formed. Further, regardless of transfer color order, the toners exhibited high primary and secondary transfer efficiencies and low back-transfer rates. As a result of a SEM observation, the carriers after continuous image formation on 10,000 sheets were substantially free from soiling. The evaluation results are summarized in Table 19.

The manners and standards of evaluation described in the above Examples and Comparative Examples and summarized in Tables 3–19 are supplemented as follows.

(1) Regarding the image forming test performed by using an apparatus shown in FIGS. 4 and 5, the developing step and the primary transfer step are repeated 4 cycles to form 4-color images in superposition on the intermediate transfer member 5, which are then transferred simultaneously onto a recording material P (secondary transfer) and then fixed onto the recording material. The respective color toners are evaluated with respect to a primary transfer efficiency, a back-transfer rate and a secondary transfer efficiency in the following manner.

Primary Transfer Efficiency

Image formation is performed under a condition of providing a 10 cm×10 cm square monocolor solid image. At this time, a toner weight (W1) on the photosensitive member prior to the primary transfer and a toner weight (W2) on the intermediate transfer member after the primary transfer are measured to calculate a primary transfer efficiency TE1 according to the following formula:

$$TE1\ (\%)=(W2/W1)\times 100.$$

Back-Transfer Rate

Monocolor image formation is performed for each color toner to measure a back-transfer rate.

More specifically, for obtaining a back-transfer rate of a first-color transfer, a development and a primary transfer are performed so as to form a 10 cm×10 cm square solid color image of a first-color toner, and development and primary transfer for second- to fourth-color toners are repeated so as to form solid white images, thereby forming a 10 cm×10 cm square solid image of the first color toner on the intermediate transfer member. Under these conditions, a toner weight (W2) after the primary transfer for the first color toner and a toner weight (W3) after the primary transfer for the fourth color toner are respectively measured on the intermediate transfer member to calculate a back transfer rate $TR_{back}$ (%) according to the following equation:

$$TR_{back}\ (\%)=[1-(W3/W2)]\times 100.$$

For obtaining a back-transfer rate of a second-color transfer, a development and a primary transfer for a first color transfer are performed so as to form a solid white image. Then a development and a primary transfer are performed so as to form a 10 cm×10 cm square solid color image of a second-color toner, and development and primary transfer for third- to fourth-color transfer are repeated so as to form solid white images, thereby forming a 10 cm×10 cm square solid image of the second color toner on the intermediate transfer member. Under these conditions, a toner weight (W2) after the primary transfer for the second color toner and a toner weight (W3) after the primary transfer for the fourth color toner are respectively measured on the intermediate transfer member to calculate a back transfer rate $TR_{back}$ (%) according to the above equation.

Further, for obtaining a back-transfer rate of a third-color transfer, development and primary transfer for first and second color transfer are repeated respectively so as to form solid white images. Then, a development and a primary transfer are performed so as to form a 10 cm×10 cm square solid color image of a third-color toner, and development and primary transfer for fourth-color transfer are repeated so as to form solid white images, thereby forming a 10 cm×10 cm square solid image of the third color toner on the intermediate transfer member. Under these conditions, a toner weight (W2) after the primary transfer for the third color toner and a toner weight (W3) after the primary transfer for the fourth color toner are respectively measured on the intermediate transfer member to calculate a back transfer rate $TR_{back}$ (%) according to the above equation.

Incidentally, a lower back-transfer rate $TR_{back}$ represents a better suppression of back-transfer.

Secondary Transfer Efficiency

Image formation is performed under a condition of providing a 10 cm×10 cm square monocolor solid image. At this time, a toner weight (W3) on the intermediate transfer member prior to the secondary transfer and a toner weight (W4) on the recording material after the secondary transfer are measured to calculate a secondary transfer efficiency TE2 according to the following formula:

$$TE2\ (\%)=(W4/W3)\times 100.$$

(2) Regarding the image forming test performed in Example 3 by using a full-color copying machine ("CLC-700" after remodeling), four color toner images are formed in superposition on a recording material held on a transfer drum by 4 cycles of repetition of development to form a color toner image on the photosensitive member and transfer of the color toner image onto the recording material, and after separation of the recording material from the transfer drum, the four color toner images in superposition on the recording material are fixed onto the recording material to form a full-color image. The respective color toners are evaluated with respect to a transfer efficiency and a back-transfer rate in the following manner.

Transfer Efficiency

Image formation is performed under a condition of providing a 10 cm×10 cm square monocolor solid image. At this time, a toner weight (W1) on the photosensitive member prior to the transfer and a toner weight (W5) on the recording material after the transfer are measured to calculate a transfer efficiency TE according to the following formula:

$$TE\ (\%)=(W5/W1)\times 100.$$

Back-Transfer Rate

Monocolor image formation is performed for each color toner to measure a back-transfer rate.

More specifically, for obtaining a back-transfer rate of a first-color transfer, a development and a transfer are performed so as to form a 10 cm×10 cm square solid color image of a first-color toner, and development and transfer for second- to fourth-color transfer are repeated so as to form solid white images, thereby forming a 10 cm×10 cm square solid image of the first color toner on the recording material. Under these conditions,a toner weight (W5) after the transfer for the first color toner and a toner weight (W6) after the transfer for the fourth color toner are respectively measured on the recording material to calculate a back transfer rate $TR_{back}$ (%) according to the following equation:

$$TR_{back}\ (\%)=[1-(W6/W5)]\times 100.$$

For obtaining a back-transfer rate of a second-color transfer, a development and a transfer for a first color transfer are performed so as to form a solid white image. Then, a development and a transfer are performed so as to form a 10 cm×10 cm square solid color image of a second-color toner, and development and transfer for third- to fourth-color transfer are repeated so as to form solid white images, thereby forming a 10 cm×10 cm square solid image of the second color toner on the recording material. Under these conditions, a toner weight (W5) after the transfer for the first color toner and a toner weight (W6) after the transfer for the fourth color toner are respectively measured on the recording material to calculate a back transfer rate $TR_{back}$ (%) according to the above equation.

Further, for obtaining a back-transfer rate of a third-color transfer, development and transfer for first and second color transfer are repeated respectively so as to form solid white images. Then, a development and a primary transfer are performed so as to form a 10 cm×10 cm square solid color image of a third-color toner, and development and primary transfer for a fourth-color transfer are performed again so as to form solid white images, thereby forming a 10 cm×10 cm square solid image of the third color toner on the recording material. Under these conditions, a toner weight (W5) after the transfer for the first color toner and a toner weight (W6) after the transfer for the fourth color toner are respectively measured on the recording material to calculate a back transfer rate $TR_{back}$ (%) according to the above equation.

Image Density

A solid image is formed and the image density thereof is measured by a Macbeth reflection densitometer (available from Macbeth Co.)

Hollow Image Dropout

Images are evaluated according to the following standard:

A: Very good. Hollow image dropout is not observed at all.

B: Good. Slight hollow image dropout is recognized but at a level of no problem at all.

C: Fair. Hollow image dropout is observed but at a practically acceptable level.

D: Poor. Serious hollow image dropout is observed.

Image Quality

Image quality of resultant images is evaluated with respect to uniformity of image, thin-line reproducibility and fog according to the following standard:

A: Very good. Fog-free clear images.

B: Good. Good images are formed with slight fog, or slightly inferior image uniformity or thin-line reproducibility.

C: Fair. Images with fog or inferior image uniformity or thin-line reproducibility but at a practically acceptable level.

D: Poor. Noticeable fog, poor thin-line reproducibility and/or ununiform image.

The fog was measured by using a reflective densitometer ("REFLECTOMETER MODEL TC-6DS") together with a blue filter for yellow toner images, a green filter for magenta toner images, an amber filter for cyan toner images, and a green filter for black toner images.

As mentioned, the evaluation results for the respective color toners for inclusively shown in the following Tables 3–19.

TABLE 1

Properties of respective color toners

| Ex. or Comp. Ex. | Toner | D4 (μm) | C (—) | SDc (—) | Externally added aromatic metal compound/wt. parts |
|---|---|---|---|---|---|
| Ex. 1 | Yellow 1 | 7.2 | 0.982 | 0.028 | amorphous |
| | Magenta 1 | 7.4 | 0.984 | 0.027 | DASA* Al |
| | Cyan 1 | 7.4 | 0.983 | 0.028 | /0.15 part |
| | Black 1 | 7.0 | 0.983 | 0.025 | |
| Ex. 2 | Yellow 2 | 4.8 | 0.983 | 0.028 | amorphous |
| | Magenta 2 | 4.7 | 0.984 | 0.027 | DASA* Zr |
| | Cyan 2 | 4.9 | 0.983 | 0.028 | /0.01 part |
| | Black 2 | 4.8 | 0.982 | 0.026 | |
| Ex. 3 | Yellow 3 | 7.2 | 0.982 | 0.028 | amorphous |
| | Magenta 3 | 7.4 | 0.984 | 0.027 | DASA* Al |
| | Cyan 3 | 7.4 | 0.983 | 0.028 | /0.5 part |
| | Black 3 | 7.0 | 0.983 | 0.025 | |
| Ex. 4 | Yellow 4 | 7.4 | 0.982 | 0.028 | amorphous |
| | Magenta 4 | 7.2 | 0.984 | 0.027 | DASA* Al |
| | Cyan 4 | 7.3 | 0.984 | 0.027 | /0.15 part |
| | Black 4 | 7.5 | 0.983 | 0.025 | |
| Ex. 5 | Yellow 5 | 8.6 | 0.963 | 0.036 | amorphous |
| | Magenta 5 | 8.7 | 0.964 | 0.035 | DASA* Al |
| | Cyan 5 | 8.8 | 0.963 | 0.036 | /0.2 part |
| | Black 5 | 8.9 | 0.963 | 0.036 | |
| Comp. Ex. 1 | Yellow 6 | 8.6 | 0.951 | 0.045 | amorphous |
| | Magenta 6 | 8.7 | 0.952 | 0.044 | DASA* Al |
| | Cyan 6 | 8.8 | 0.951 | 0.044 | /0.2 part |
| | Black 6 | 8.9 | 0.951 | 0.045 | |
| Ex. 6 | Yellow 7 | 8.6 | 0.963 | 0.036 | amorphous |
| | Magenta 7 | 8.7 | 0.964 | 0.035 | DASA* Al |
| | Cyan 7 | 8.8 | 0.963 | 0.036 | /0.2 part |
| | Black 7 | 8.3 | 0.956 | 0.037 | |
| Ex. 7 | Yellow 8 | 7.2 | 0.982 | 0.028 | amorphous |
| | Magenta 8 | 7.4 | 0.984 | 0.027 | DASA* Al |
| | Cyan 8 | 7.4 | 0.983 | 0.028 | /0.005 part |
| | Black 8 | 7.0 | 0.983 | 0.025 | |

TABLE 1-continued

Properties of respective color toners

| Ex. or Comp. Ex. | Toner | D4 (μm) | C (—) | SDc (—) | Externally added aromatic metal compound/wt. parts |
|---|---|---|---|---|---|
| Ex. 8 | Yellow 9 | 7.2 | 0.992 | 0.021 | amorphous |
| | Magenta 9 | 7.4 | 0.993 | 0.020 | DASA* Al |
| | Cyan 9 | 7.4 | 0.991 | 0.021 | /1.0 part |
| | Black 9 | 7.0 | 0.992 | 0.020 | |
| Ex. 9 | Yellow 10 | 7.2 | 0.982 | 0.028 | amorphous |
| | Magenta 10 | 7.4 | 0.984 | 0.027 | monoazo Fe |
| | Cyan 10 | 7.4 | 0.983 | 0.028 | /0.3 part |
| | Black 10 | 7.0 | 0.983 | 0.025 | |
| Ex. 10 | Yellow 11 | 7.2 | 0.982 | 0.028 | amorphous |
| | Magenta 11 | 7.4 | 0.984 | 0.027 | DASA* Cr |
| | Cyan 11 | 7.4 | 0.983 | 0.028 | /0.3 part |
| | Black 11 | 7.0 | 0.983 | 0.025 | |
| Comp. Ex. 2 | Yellow 12 | 7.6 | 0.984 | 0.027 | |
| | Magenta 12 | 7.3 | 0.985 | 0.026 | none |
| | Cyan 12 | 7.5 | 0.984 | 0.027 | |
| | Black 12 | 7.2 | 0.983 | 0.025 | |
| Comp. Ex. 3 | Yellow 13 | 7.4 | 0.982 | 0.028 | crystalline |
| | Magenta 13 | 7.2 | 0.984 | 0.027 | DASA* Zn |
| | Cyan 13 | 7.3 | 0.984 | 0.027 | /0.3 part |
| | Black 13 | 7.5 | 0.983 | 0.025 | |
| Comp. Ex. 4 | Yellow 14 | 7.4 | 0.982 | 0.028 | crystalline |
| | Magenta 14 | 7.2 | 0.984 | 0.027 | azo Fe |
| | Cyan 14 | 7.3 | 0.984 | 0.027 | /0.02 part |
| | Black 14 | 7.5 | 0.983 | 0.025 | |
| Comp. Ex. 5 | Yellow 15 | 7.4 | 0.982 | 0.028 | aluminum oxide |
| | Magenta 15 | 7.2 | 0.984 | 0.027 | /0.3 part |
| | Cyan 15 | 7.3 | 0.984 | 0.027 | |
| | Black 15 | 7.5 | 0.983 | 0.025 | |
| Comp. Ex. 6 | Yellow 16 | 8.6 | 0.963 | 0.036 | none |
| | Magenta 16 | 8.7 | 0.964 | 0.035 | |
| | Cyan 16 | 8.8 | 0.963 | 0.036 | |
| | Black 16 | 8.6 | 0.963 | 0.036 | |
| Ex. 11 | Yellow 17 | 7.2 | 0.982 | 0.028 | amorphous |
| | Magenta 17 | 7.4 | 0.984 | 0.027 | DASA* Al |
| | Cyan 17 | 7.4 | 0.983 | 0.028 | /0.3 part |
| | Black 17 | 7.0 | 0.983 | 0.025 | |

*DASA: dialkylsalicylic acid

Table 2 (not contained).

TABLE 3

| Example 1 | | | | | | |
|---|---|---|---|---|---|---|
| | Transfer efficiency | | Back | | | |
| | primary | secondary | transfer | Image | | |
| Transfer order | (%) | (%) | (%) | density | hollow | quality |
| (1) 1st: Yellow | 97 | 98 | 3 | 1.45 | A | A |
| 2nd: Magenta | 99 | 99 | 2 | 1.45 | A | A |
| 3rd: Cyan | 98 | 98 | 2 | 1.45 | A | A |
| 4th: Black | 99 | 98 | — | 1.46 | A | A |
| (2) 1st: Magenta | 98 | 98 | 3 | 1.45 | A | A |
| 2nd: Cyan | 99 | 98 | 2 | 1.45 | A | A |
| 3rd: Yellow | 99 | 98 | 2 | 1.45 | A | A |
| 4th: Black | 98 | 99 | — | 1.46 | A | A |
| (3) 1st: Black | 98 | 98 | 3 | 1.45 | A | A |
| 2nd: Magenta | 97 | 98 | 3 | 1.45 | A | A |
| 3rd: Cyan | 99 | 97 | 2 | 1.45 | A | A |
| 4th: Black | 99 | 99 | — | 1.46 | A | A |

TABLE 4

| Example 2 | | | | | | |
|---|---|---|---|---|---|---|
| | Transfer efficiency | | Back | | | |
| | primary | secondary | transfer | Image | | |
| Transfer order | (%) | (%) | (%) | density | hollow | quality |
| (1) 1st: Yellow | 98 | 98 | 4 | 1.44 | A | A |
| 2nd: Magenta | 97 | 99 | 3 | 1.45 | A | A |
| 3rd: Cyan | 99 | 98 | 3 | 1.45 | A | A |
| 4th: Black | 98 | 97 | — | 1.46 | A | A |
| (2) 1st: Magenta | 97 | 98 | 4 | 1.44 | A | A |
| 2nd: Cyan | 98 | 98 | 3 | 1.45 | A | A |
| 3rd: Yellow | 98 | 97 | 2 | 1.45 | A | A |
| 4th: Black | 97 | 99 | — | 1.46 | A | A |
| (3) 1st: B1ack | 99 | 98 | 4 | 1.44 | A | A |
| 2nd: Magenta | 97 | 96 | 4 | 1.44 | A | A |
| 3rd: Cyan | 98 | 98 | 3 | 1.45 | A | A |
| 4th: Black | 97 | 97 | — | 1.45 | A | A |

TABLE 5

| Example 3 | | | | | |
|---|---|---|---|---|---|
| | Transfer efficiency | Back transfer | Image | | |
| Transfer order | (%) | (%) | density | hollow | quality |
| (1) 1st: Yellow | 97 | 3 | 1.45 | A | A |
| 2nd: Magenta | 99 | 3 | 1.45 | A | A |
| 3rd: Cyan | 98 | 3 | 1.46 | A | A |
| 4th: Black | 97 | — | 1.46 | A | A |
| (2) 1st: Magenta | 98 | 3 | 1.45 | A | A |
| 2nd: Cyan | 97 | 2 | 1.46 | A | A |
| 3rd: Yellow | 97 | 2 | 1.46 | A | A |

TABLE 5-continued

| Example 3 | | | | | |
|---|---|---|---|---|---|
| | Transfer efficiency | Back transfer | Image | | |
| Transfer order | (%) | (%) | density | hollow | quality |
| 4th: Black | 98 | — | 1.46 | A | A |
| (3) 1st: Black | 99 | 3 | 1.45 | A | A |
| 2nd: Magenta | 98 | 3 | 1.46 | A | A |
| 3rd: Cyan | 97 | 2 | 1.46 | A | A |
| 4th: Black | 98 | — | 1.46 | A | A |

TABLE 6

| Example 4 | | | | | | |
|---|---|---|---|---|---|---|
| | Transfer efficiency | | Back | | | |
| | primary | secondary | transfer | Image | | |
| Transfer order | (%) | (%) | (%) | density | hollow | quality |
| (1) 1st: Yellow | 94 | 95 | 3 | 1.41 | A | A |
| 2nd: Magenta | 95 | 94 | 3 | 1.42 | A | A |
| 3rd: Cyan | 94 | 96 | 2 | 1.42 | A | A |
| 4th: Black | 96 | 94 | — | 1.43 | A | A |
| (2) 1st: Magenta | 95 | 95 | 3 | 1.41 | A | A |
| 2nd: Cyan | 94 | 94 | 2 | 1.42 | A | A |
| 3rd: Yellow | 94 | 96 | 2 | 1.42 | A | A |
| 4th: Black | 96 | 94 | — | 1.43 | A | A |
| (3) 1st: Black | 94 | 95 | 3 | 1.41 | A | A |
| 2nd: Magenta | 95 | 96 | 3 | 1.42 | A | A |
| 3rd: Cyan | 94 | 94 | 2 | 1.42 | A | A |
| 4th: Black | 95 | 94 | — | 1.42 | A | A |

TABLE 7

| Example 2 | | | | | | |
|---|---|---|---|---|---|---|
| | Transfer efficiency | | Back | | | |
| | primary | secondary | transfer | Image | | |
| Transfer order | (%) | (%) | (%) | density | hollow | quality |
| (1) 1st: Yellow | 90 | 92 | 4 | 1.37 | B | A |
| 2nd: Magenta | 91 | 91 | 4 | 1.38 | B | A |
| 3rd: Cyan | 90 | 91 | 3 | 1.38 | B | A |
| 4th: Black | 92 | 90 | — | 1.40 | B | A |
| (2) 1st: Magenta | 92 | 91 | 4 | 1.37 | B | A |
| 2nd: Cyan | 91 | 91 | 4 | 1.37 | B | A |
| 3rd: Yellow | 92 | 92 | 4 | 1.38 | B | A |
| 4th: Black | 91 | 90 | — | 1.39 | B | A |
| (3) 1st: Black | 90 | 91 | 4 | 1.37 | B | A |
| 2nd: Magenta | 90 | 92 | 3 | 1.38 | B | A |
| 3rd: Cyan | 92 | 90 | 3 | 1.38 | B | A |
| 4th: Black | 91 | 91 | — | 1.40 | B | A |

TABLE 8

| Comp. Ex. 1 | | | | | | |
|---|---|---|---|---|---|---|
| | Transfer efficiency | | Back | | | |
| | primary | secondary | transfer | Image | | |
| Transfer order | (%) | (%) | (%) | density | hollow | quality |
| (1) 1st: Yellow | 87 | 88 | 5 | 1.32 | C | B |
| 2nd: Magenta | 85 | 87 | 4 | 1.32 | C | B |
| 3rd: Cyan | 88 | 86 | 4 | 1.33 | C | B |
| 4th: Black | 88 | 86 | — | 1.35 | C | A |
| (2) 1st: Magenta | 86 | 87 | 5 | 1.31 | C | B |
| 2nd: Cyan | 88 | 86 | 5 | 1.32 | C | B |
| 3rd: Yellow | 87 | 88 | 4 | 1.33 | C | B |
| 4th: Black | 86 | 87 | — | 1.35 | C | A |
| (3) 1st: Black | 85 | 86 | 5 | 1.39 | C | B |
| 2nd: Magenta | 88 | 87 | 4 | 1.33 | C | B |
| 3rd: Cyan | 87 | 85 | 4 | 1.32 | C | B |
| 4th: Black | 86 | 87 | — | 1.35 | C | A |

TABLE 9

| Example 6 | | | | | | |
|---|---|---|---|---|---|---|
| | Transfer efficiency | | Back | Image | | |
| Transfer order | primary (%) | secondary (%) | transfer (%) | density | hollow | quality |
| (1) 1st: Yellow | 90 | 92 | 4 | 1.37 | B | A |
| 2nd: Magenta | 92 | 90 | 3 | 1.38 | B | A |
| 3rd: Cyan | 91 | 91 | 3 | 1.38 | B | A |
| 4th: Black | 88 | 88 | — | 1.36 | C | B |
| (2) 1st: Magenta | 91 | 92 | 4 | 1.37 | B | A |
| 2nd: Cyan | 92 | 90 | 4 | 1.37 | B | A |
| 3rd: Yellow | 92 | 91 | 3 | 1.38 | B | A |
| 4th: Black | 89 | 88 | — | 1.37 | C | B |
| (3) 1st: Black | 88 | 89 | 5 | 1.35 | C | B |
| 2nd: Magenta | 91 | 91 | 4 | 1.37 | B | A |
| 3rd: Cyan | 92 | 91 | 3 | 1.38 | B | A |
| 4th: Black | 91 | 92 | — | 1.40 | B | A |

TABLE 10

| Example 7 | | | | | | |
|---|---|---|---|---|---|---|
| | Transfer efficiency | | Back | Image | | |
| Transfer order | primary (%) | secondary (%) | transfer (%) | density | hollow | quality |
| (1) 1st: Yellow | 98 | 98 | 8 | 1.42 | A | B |
| 2nd: Magenta | 97 | 98 | 6 | 1.43 | A | B |
| 3rd: Cyan | 99 | 97 | 5 | 1.43 | A | A |
| 4th: Black | 98 | 98 | — | 1.46 | A | A |
| (2) 1st: Magenta | 98 | 99 | 8 | 1.42 | A | B |
| 2nd: Cyan | 98 | 97 | 7 | 1.45 | A | B |
| 3rd: Yellow | 97 | 98 | 5 | 1.43 | A | A |
| 4th: Black | 99 | 98 | — | 1.46 | A | A |
| (3) 1st: Black | 98 | 98 | 8 | 1.42 | A | B |
| 2nd: Magenta | 99 | 97 | 7 | 1.42 | A | B |
| 3rd: Cyan | 98 | 98 | 6 | 1.43 | A | A |
| 4th: Black | 97 | 99 | — | 1.45 | A | A |

TABLE 11

| Example 8 | | | | | | |
|---|---|---|---|---|---|---|
| | Transfer efficiency | | Back | Image | | |
| Transfer order | primary (%) | secondary (%) | transfer (%) | density | hollow | quality |
| (1) 1st Yellow | 88 | 89 | 4 | 1.34 | C | B |
| 2nd: Magenta | 87 | 88 | 3 | 1.34 | C | B |
| 3rd: Cyan | 88 | 87 | 3 | 1.34 | C | B |
| 4th: Black | 86 | 88 | — | 1.35 | C | B |
| (2) 1st: Magenta | 88 | 87 | 4 | 1.33 | C | B |
| 2nd: Cyan | 87 | 89 | 3 | 1.34 | C | B |
| 3rd: Yellow | 87 | 87 | 3 | 1.34 | C | B |
| 4th: Black | 88 | 88 | — | 1.36 | C | B |
| (3) 1st: Black | 86 | 87 | 4 | 1.32 | C | B |
| 2nd: Magenta | 88 | 89 | 3 | 1.34 | C | B |
| 3rd: Cyan | 87 | 88 | 2 | 1.35 | C | B |
| 4th: Black | 87 | 88 | — | 1.36 | C | B |

TABLE 12

| Example 9 | | | | | | |
|---|---|---|---|---|---|---|
| | Transfer efficiency | | Back | Image | | |
| Transfer order | primary (%) | secondary (%) | transfer (%) | density | hollow | quality |
| (1) 1st: Yellow | 98 | 99 | 9 | 1.42 | A | C |
| 2nd: Magenta | 98 | 98 | 8 | 1.42 | A | B |
| 3rd: Cyan | 99 | 98 | 7 | 1.43 | A | B |
| 4th: Black | 97 | 99 | — | 1.46 | A | A |
| (2) 1st: Magenta | 98 | 98 | 9 | 1.42 | A | C |
| 2nd: Cyan | 97 | 98 | 9 | 1.42 | A | B |
| 3rd: Yellow | 99 | 97 | 8 | 1.43 | A | B |
| 4th: Black | 98 | 98 | — | 1.46 | A | A |
| (3) 1st: Black | 99 | 97 | 9 | 1.42 | A | C |
| 2nd: Magenta | 97 | 98 | 8 | 1.43 | A | B |
| 3rd: Cyan | 98 | 98 | 8 | 1.43 | A | B |
| 4th: Black | 98 | 99 | — | 1.46 | A | A |

TABLE 13

| Example 10 | | | | | | |
|---|---|---|---|---|---|---|
| | Transfer efficiency | | Back | Image | | |
| Transfer order | primary (%) | secondary (%) | transfer (%) | density | hollow | quality |
| (1) 1st: Yellow | 98 | 98 | 12 | 1.40 | A | C |
| 2nd: Magenta | 97 | 98 | 11 | 1.40 | A | C |
| 3rd: Cyan | 99 | 97 | 10 | 1.41 | A | B |
| 4th: Black | 97 | 99 | — | 1.46 | A | A |
| (2) 1st: Magenta | 99 | 98 | 13 | 1.40 | A | C |
| 2nd: Cyan | 98 | 97 | 12 | 1.40 | A | C |
| 3rd: Yellow | 98 | 98 | 10 | 1.41 | A | B |
| 4th: Black | 97 | 98 | — | 1.45 | A | A |
| (3) 1st: Black | 98 | 98 | 12 | 1.40 | A | C |
| 2nd: Magenta | 98 | 98 | 10 | 1.41 | A | B |
| 3rd: Cyan | 97 | 98 | 9 | 1.41 | A | B |
| 4th: Black | 99 | 97 | — | 1.46 | A | A |

TABLE 14

| Comp. Ex. 2 | Transfer efficiency | | Back | Image | | |
|---|---|---|---|---|---|---|
| Transfer order | primary (%) | secondary (%) | transfer (%) | density | hollow | quality |
| (1) 1st: Yellow | 80 | 81 | 25 | 1.04 | D | D |
| 2nd: Magenta | 79 | 81 | 22 | 1.05 | D | D |
| 3rd: Cyan | 81 | 80 | 18 | 1.10 | D | D |
| 4th: Black | 80 | 79 | — | 1.22 | D | D |
| (2) 1st: Magenta | 79 | 80 | 25 | 1.03 | D | D |
| 2nd: Cyan | 80 | 81 | 23 | 1.06 | D | D |
| 3rd: Yellow | 81 | 80 | 17 | 1.11 | D | D |
| 4th: Black | 80 | 81 | — | 1.23 | D | D |
| (3) 1st: Black | 80 | 79 | 26 | 1.02 | D | D |
| 2nd: Magenta | 81 | 80 | 23 | 1.06 | D | D |
| 3rd: Cyan | 81 | 80 | 20 | 1.09 | D | D |
| 4th: Black | 80 | 80 | — | 1.22 | D | D |

TABLE 15

| Comp. Ex. 3 | Transfer efficiency | | Back | Image | | |
|---|---|---|---|---|---|---|
| Transfer order | primary (%) | secondary (%) | transfer (%) | density | hollow | quality |
| (1) 1st: Yellow | 93 | 92 | 22 | 1.25 | A | D |
| 2nd: Magenta | 92 | 93 | 18 | 1.30 | A | D |
| 3rd: Cyan | 94 | 92 | 16 | 1.32 | A | C |
| 4th: Black | 93 | 92 | — | 1.41 | A | A |
| (2) 1st: Magenta | 93 | 92 | 21 | 1.25 | A | D |
| 2nd: Cyan | 93 | 94 | 17 | 1.32 | A | C |
| 3rd: Yellow | 94 | 92 | 16 | 1.33 | A | C |
| 4th: Black | 92 | 92 | — | 1.40 | A | A |
| (3) 1st: Black | 93 | 93 | 23 | 1.26 | A | D |
| 2nd: Magenta | 92 | 94 | 19 | 1.30 | A | D |
| 3rd: Cyan | 93 | 92 | 16 | 1.32 | A | C |
| 4th: Black | 94 | 92 | — | 1.41 | A | A |

TABLE 16

| Comp. Ex. 4 | Transfer efficiency | | Back | Image | | |
|---|---|---|---|---|---|---|
| Transfer order | primary (%) | secondary (%) | transfer (%) | density | hollow | quality |
| (1) 1st: Yellow | 92 | 93 | 23 | 1.52 | A | D |
| 2nd: Magenta | 93 | 93 | 19 | 1.30 | A | D |
| 3rd: Cyan | 94 | 92 | 16 | 1.33 | A | C |
| 4th: Black | 92 | 93 | 13 | 1.40 | A | A |
| (2) 1st: Magenta | 94 | 93 | 22 | 1.26 | A | D |
| 2nd: Cyan | 93 | 92 | 18 | 1.30 | A | D |
| 3rd: Yellow | 92 | 93 | 16 | 1.32 | A | C |
| 4th: Black | 93 | 92 | 15 | 1.40 | A | A |
| (3) 1st: Black | 93 | 93 | 23 | 1.25 | A | D |
| 2nd: Magenta | 93 | 92 | 20 | 1.27 | A | D |
| 3rd: Cyan | 92 | 93 | 16 | 1.32 | A | C |
| 4th: Black | 93 | 94 | 14 | 1.42 | A | A |

TABLE 17

| Comp. Ex. 5 | Transfer efficiency | | Back | Image | | |
|---|---|---|---|---|---|---|
| Transfer order | primary (%) | secondary (%) | transfer (%) | density | hollow | quality |
| (1) 1st: Yellow | 90 | 91 | 24 | 1.21 | B | D |
| 2nd: Magenta | 91 | 90 | 19 | 1.25 | B | D |
| 3rd: Cyan | 91 | 89 | 16 | 1.28 | B | C |
| 4th: Black | 90 | 90 | — | 1.38 | B | A |
| (2) 1st: Magenta | 91 | 91 | 23 | 1.24 | B | D |
| 2nd: Cyan | 91 | 90 | 18 | 1.26 | B | D |
| 3rd: Yellow | 90 | 89 | 15 | 1.27 | B | C |
| 4th: Black | 91 | 91 | — | 1.38 | B | A |
| (3) 1st: Black | 89 | 91 | 23 | 1.21 | B | D |
| 2nd: Magenta | 90 | 91 | 20 | 1.25 | B | D |
| 3rd: Cyan | 91 | 91 | 17 | 1.29 | B | C |
| 4th: Black | 90 | 90 | — | 1.38 | B | A |

TABLE 18

| Comp. Ex. 6 | Transfer efficiency | | Back | Image | | |
|---|---|---|---|---|---|---|
| Transfer order | primary (%) | secondary (%) | transfer (%) | density | hollow | quality |
| (1) 1st: Yellow | 89 | 88 | 24 | 1.19 | B | D |
| 2nd: Magenta | 88 | 89 | 20 | 1.21 | B | D |
| 3rd: Cyan | 87 | 89 | 15 | 1.25 | B | C |
| 4th: Black | 89 | 87 | — | 1.36 | B | A |
| (2) 1st: Magenta | 89 | 88 | 21 | 1.21 | B | D |
| 2nd: Cyan | 88 | 88 | 17 | 1.23 | B | D |
| 3rd: Yellow | 87 | 89 | 15 | 1.25 | B | C |
| 4th: Black | 88 | 87 | — | 1.36 | B | A |
| (3) 1st: Black | 89 | 87 | 22 | 1.19 | B | D |
| 2nd: Magenta | 88 | 88 | 19 | 1.21 | B | D |
| 3rd: Cyan | 88 | 87 | 16 | 1.23 | B | C |
| 4th: Black | 87 | 89 | — | 1.36 | B | A |

TABLE 19

| Example 11 | Transfer efficiency | Back transfer | Image | | |
|---|---|---|---|---|---|
| Transfer order | (%) | (%) | density | hollow | quality |
| (1) 1st: Yellow | 99 | 3 | 1.45 | A | A |
| 2nd: Magenta | 99 | 2 | 1.45 | A | A |
| 3rd: Cyan | 98 | 2 | 1.46 | A | A |
| 4th: Black | 97 | — | 1.46 | A | A |
| (2) 1st: Magenta | 98 | 3 | 1.45 | A | A |
| 2nd: Cyan | 97 | 3 | 1.45 | A | A |
| 3rd: Yellow | 98 | 2 | 1.46 | A | A |
| 4th: Black | 98 | — | 1.45 | A | A |
| (3) 1st: Black | 99 | 3 | 1.45 | A | A |
| 2nd: Magenta | 97 | 2 | 1.46 | A | A |
| 3rd: Cyan | 98 | 3 | 1.46 | A | A |
| 4th: Black | 98 | — | 1.46 | A | A |

Example 12

Into a four-necked flask equipped with a high-speed stirrer ("TK-Homomixer", available from Tokushu Kika Kogyo K.K.), 910 wt. parts of deionized water and 450 wt. parts of 1 mol/liter-$Na_2PO_4$ aqueous solution were placed and warmed to 60° C. under stirring at 15000 rpm. To the system, 68 wt. parts of 1.0 mol/liter-$CaCl_2$ aqueous solution was gradually added to form an aqueous dispersion medium containing finely dispersed hardly water-soluble dispersion stabilizer $Ca_3(PO_4)_2$.

| | |
|---|---|
| Styrene monomer | 160 wt. parts |
| n-Butyl acrylate | 40 wt. parts |
| Carbon black | 4 wt. parts |
| Release agent | 30 wt. parts |
| Styrene-butadiene copolymer | 10 wt. parts |
| Crystalline azo iron compound F (used in Comp. Example 4) | 4 wt. parts |

The above ingredients were dispersed for 3 hours by an attritor, and 4 wt. parts of 2,2'-azobis(2,4-dimethylvaleronitrile) (polymerization initiator) was added thereto to form a polymerizable monomer composition, which was then dispersed into the above-prepared aqueous dispersion medium under the identical stirring speed for 10 min. to form monomer droplets therein. Then, the high-speed stirrer was replaced by a propeller blade stirrer, and then polymerization was performed at 200 rpm, first at 60° C. for 5 hours, and then at 80° C. for 5 hours.

After the polymerization, the slurry was cooled, and dilute hydrochloric acid was added thereto to remove the dispersion stabilizer.

The polymerizate was further washed and dried to obtain black-colored Toner particle A having a weight-average particle size (D4) of 7.3 $\mu$m, an average circularity ($\overline{C}$) of 0.981 and a circularity standard deviation (SDc) of 0.026.

100 wt. parts of the thus-obtained Toner particles A and 0.1 wt. part of amorphous dialkyl salicylic acid aluminum complex compound A were blended at a temperature below 45° C. for 5 min. in a Henschell mixer at a blade peripheral speed of 50 m/sec, and then 1.5 wt. parts of hydrophobized silica having an average particle size (Dav) of 10 nm and 0.5 wt. part of resin particles (Dav=0.5 $\mu$m, polymethyl methacrylate) were externally added thereto to obtain Toner A, which exhibited a weight-average particle size ($D_4$) of 7.3 $\mu$m, an average circularity ($\overline{C}$) of 0.981 and a circularity standard deviation (SDc) of 0.02. The properties of Toner A are shown in Table 20 together with those of the toners obtained in the following Examples and Comparative Examples.

Toner A b before the external addition of silica and resin particles (i.e., a mixture of Toner particles A and amorphous dialkylsalicylic acid aluminum compound A after the Henschell mixer stirring) was observed through a SEM (scanning electron microscope) at magnifications of $10^4$ and $3\times10^4$, whereby the particle state of the amorphous dialkylsalicylic acid aluminum (Al) compound was not observed at the toner particle surfaces but a uniform coverage on the toner particle surfaces was confirmed.

Example 13

Into a four-necked flask equipped with a high-speed stirrer ("TK-Homomixer", available from Tokushu Kika Kogyo K.K.), 910 wt. parts of deionized water and 450 wt. parts of 1 mol/liter-$Na_2PO_4$ aqueous solution were placed and warmed to 60° C. under stirring at 15000 rpm. To the system, 68 wt. parts of 1.0 mol/liter-$CaCl_2$ aqueous solution was gradually added to form an aqueous dispersion medium containing finely dispersed hardly water-soluble dispersion stabilizer $Ca_3(PO_4)_2$.

| | |
|---|---|
| Styrene monomer | 160 wt. parts |
| n-Butyl acrylate | 40 wt. parts |
| Carbon black | 4 wt. parts |
| Release agent | 30 wt. parts |
| Polyester resin | 4 wt. parts |
| Crystalline azo chromium complex compound H | 4 wt. parts |

The above ingredients were dispersed for 3 hours by an attritor, and 4 wt. parts of 2,2'-azobis(2,4-dimethylvaleronitrile) (polymerization initiator) was added thereto to form a polymerizable monomer composition, which was then dispersed into the above-prepared aqueous dispersion medium under the identical stirring speed for 10 min. to form monomer droplets therein. Then, the high-speed stirrer was replaced by a propeller blade stirrer, and then polymerization was performed at 200 rpm, first at 60° C. for 5 hours and then at 80° C. for 5 hours.

After the polymerization, the slurry was cooled, and dilute hydrochloric acid was added thereto to remove the dispersion stabilizer.

The polymerizate was further washed and dried to obtain black-colored toner particles B (D4=7.6 $\mu$m. $\overline{C}$=0.982, SDc=0.025).

100 wt. parts of the thus-obtained Toner particles B and 0.3 wt. part of amorphous dialkyl salicylic acid zirconium complex compound C (used in Example 2) were blended at a temperature below 45° C. for 9 min. in a Henschell mixer at a blade peripheral speed of 35 m/sec, and then 1.5 wt. parts of hydrophobized silica (Dav=10 nm) and 0.5 wt. part of resin particles (Dav=0.5 $\mu$m) were externally added thereto to obtain Toner B, which exhibited a weight-average particle size ($D_4$), an average circularity ($\overline{C}$) and a circularity standard deviation (SDc) inclusively shown in Table 20 appearing hereinafter.

As a result of the SEM observation in the same manner as in Example 1, Toner B before the external addition of silica and resin particles exhibited the presence in a non-particle state of and a uniform coverage with the amorphous dialkylsalicylic acid zirconium compound C on the toner particle surface.

Incidentally, the crystallinity of the azo Cr complex compound H was confirmed by its X-ray diffraction pattern showing a maximum peak at 2θ=8.72 deg. exhibiting a measurement intensity of 41000 cps and a half-value half-width=0.14 deg.

Example 14

Toner C was obtained in the same manner as in Example 12 except that the externally added amorphous dialkylsalicylic acid Al compound A was replaced by 0.1 wt. part of amorphous dialkylsalicylic acid Zr compound C per 100 wt. parts of Toner particles A.

As a result of the SEM observation in the same manner as in Example 12, Toner C before the external addition of silica and resin particles exhibited the presence in a non-particle state of and a uniform coverage with the amorphous dialkylsalicylic acid Zr compound C on the toner particle surfaces.

Example 15

Toner D was obtained in the same manner as in Example 12 except that the amount of the externally added amorphous dialkylsalicylic acid Al compound A was reduced to 0.01 wt. part per 100 wt. parts of Toner particles A.

As a result of the SEM observation in the same manner as in Example 12, Toner D before the external addition of silica and resin particles exhibited the presence in a non-particle state of and a uniform coverage with the amorphous dialkylsalicylic acid Al compound A on the toner particle surfaces.

Example 16

Toner D was obtained in the same manner as in Example 12 except that the amount of the externally added amorphous dialkylsalicylic acid Al compound A was reduced to 0.05 wt. part per 100 wt. parts of Toner particles A.

As a result of the SEM observation in the same manner as in Example 12, Toner F before the external addition of silica and resin particles exhibited the presence in a non-particle state of and a uniform coverage with the amorphous dialkylsalicylic acid Al compound A on the toner particle surfaces.

Example 17

Toner F was obtained in the same manner as in Example 12 except that the amount of the externally added amorphous dialkylsalicylic acid Al compound A was increased to 0.5 wt. part per 100 wt. parts of Toner particles A.

As a result of the SEM observation in the same manner as in Example 12, Toner E before the external addition of silica and resin particles exhibited the presence in a non-particle state of and a uniform coverage with the amorphous dialkylsalicylic acid Al compound A on the toner particle surfaces.

Example 18

Toner G was obtained in the same manner as in Example 12 except that the amount of the externally added amorphous dialkylsalicylic acid Al compound A was increased to 0.7 wt. part per 100 wt. parts of Toner particles A.

As a result of the SEM observation in the same manner as in Example 12, Toner F before the external addition of silica and resin particles exhibited the presence in a non-particle state of and a uniform coverage with the amorphous dialkylsalicylic acid Al compound A on the toner particle surfaces.

Example 19

| | |
|---|---|
| Polyester resin | 100 wt. parts |
| Carbon black | 4 wt. parts |
| Release agent | 4 wt. parts |
| Amorphous dialkylsalicylic acid zirconium compound C | 5 wt. parts |

The above ingredients were sufficiently preliminarily blended in a Henschell mixer and melt-kneaded through a twin-screw extruder at ca. 140° C. After cooling, the kneaded product was coarsely crushed into ca. 1–2 mm by a hammer mill and then finely pulverized by an air jet pulverizer, followed by classification to obtain black-colored Toner particles Ha (D4=8.4 $\mu$m, $\overline{C}$=0.952, SDc=0.045).

Toner particles Ha were then subjected to a surface treatment for 3 min. by a hybridizer at 4000 rpm to obtain Toner particles H ($\overline{C}$=0.963, SDc=0.036).

100 wt. parts of the thus-obtained Toner particles H and 0.1 wt. part of the amorphous dialkylsalicylic acid aluminum complex compound A were blended at a temperature below 45° C. for 5 min. in a Henschell mixer at a blade peripheral speed of 50 m/sec, and then 1.0 wt. part of hydrophobilized silica (Dav=12 nm) and 0.3 wt. part of resin particles (Dav=0.5 $\mu$m) were externally added thereto to obtain Toner H.

As a result of the SEM observation in the same manner as in Example 12, Toner A before the external addition of silica and resin particles exhibited the presence in a non-particle state of and a uniform coverage with the amorphous dialkylsalicylic acid Al compound A on the toner particle surfaces.

Example 20

Toner I was prepared in the same manner as in Example 12 except that the average particle size (Dav) of the externally added resin particles were changed to 1.0 $\mu$m.

Example 21

Toner J was prepared in the same manner as in Example 12 except that the external addition of the resin particles (Dav=0.5 $\mu$m) was omitted.

Example 22

Toner K was prepared in the same manner as in Example 13 except that the internal addition of the crystalline azo chromium complex compound H was omitted.

Example 23

Toner L was obtained in the same manner as in Example 13 except that the externally added amorphous dialkylsalicylic acid Al compound A was replaced by amorphous dialkylsalicylic acid Cr compound E.

As a result of the SEM observation in the same manner as in Example 12, Toner L before the external addition of silica and resin particles exhibited the presence in a non-particle state of the amorphous dialkylsalicylic acid Cr compound E on the toner particle surfaces, but the coverage was not uniform but discrete spot-like.

Example 24

To 100 wt. parts of Toner particles B prepared in Example 13, 0.3 wt. part of the amorphous dialkylsalicylic acid chromium complex compound E and 1.5 wt. parts of hydrophobized silica particles (Dav=10 nm) and 0.5 wt. part of resin particles (Dav=0.5 $\mu$m) were externally added simultaneously, followed by 9 min. of blending by means of a Henschell mixer at a blade peripheral speed of 35 m/sec. at a temperature below 45° C., whereby Toner M was obtained.

As a result of the SEM observation in the same manner as in Example 12, Toner M after the external addition exhibited that a portion of the amorphous dialkylsalicylic acid Cr complex compound E coated the toner particle surfaces but another portion thereof was present in isolation from the toner particles.

Comparative Example 7

Toner N was prepared in the same manner as in Example 13 except that the external addition of the amorphous dialkylsalicylic acid zirconium complex compound C was omitted.

Comparative Example 8

Toner O was prepared in the same manner as in Example 13 except that the externally added dialkylsalicylic acid zirconium complex compound C was replaced by crystalline alkylsalicylic acid zinc compound B (used in the Comparative Example 3).

As a result of the SEM observation in the same manner as in Example 12 of Toner O after the external addition of the crystalline zinc compound C but before the external addition of silica and resin particles, the crystalline dialkylsalicylic acid zinc complex compound was ununiformly embedded at the toner particle surfaces and failed to coat the toner particle surface.

Comparative Example 9

Toner P was prepared in the same manner as in Example 13 except that the externally added dialkylsalicylic acid zirconium complex compound C was replaced by crystalline azo chromium complex compound H.

As a result of the SEM observation in the same manner as in Example 12 of Toner P after external addition of the crystalline chromium compound H but before the external addition of silica and resin particles, the crystalline Cr complex compound was ununiformly embedded at the toner particle surfaces and failed to coat the toner particle surface.

Comparative Example 10

Toner Q was prepared in the same manner as in Example 22 except that the externally added dialkylsalicylic acid zirconium complex compound C was replaced by crystalline azo chromium complex compound H.

As a result of the SEM observation in the same manner as in Example 12 of Toner Q after the external addition of the crystalline Cr compound H but before the external addition of silica and resin particles, the crystalline complex compound was ununiformly embedded at the toner particle surfaces and failed to coat the toner particle surface.

Comparative Example 11

Toner R was prepared in the same manner as in Example 19 except that Toner particles Ha were directly blended with the amorphous dialkylsalicylic acid aluminum complex compound A and then with the hydrophobized silica without the hybridizer treatment.

As a result of the SEM observation in the same manner as in Example 12, Toner R before the blending with the hydrophobized silica exhibited that the amorphous dialkylsalicylic acid aluminum compound A failed to coat the concavities on the toner particle surfaces.

TABLE 20

| Ex. & Comp. Ex. | Toner properties Toner | D4 (μm) | $\overline{C}$ (–) | SDc (–) |
|---|---|---|---|---|
| Ex. 12 | A | 7.3 | 0.981 | 0.026 |
| Ex. 13 | B | 7.6 | 0.982 | 0.025 |
| Ex. 14 | C | 7.3 | 0.981 | 0.026 |
| Ex. 15 | D | 7.3 | 0.981 | 0.026 |
| Ex. 16 | E | 7.3 | 0.981 | 0.026 |
| Ex. 17 | F | 7.3 | 0.981 | 0.026 |
| Ex. 18 | G | 7.3 | 0.981 | 0.026 |
| Ex. 19 | H | 8.4 | 0.963 | 0.036 |
| Ex. 20 | I | 7.3 | 0.981 | 0.026 |
| Ex. 21 | J | 7.3 | 0.981 | 0.026 |
| Ex. 22 | K | 7.5 | 0.981 | 0.025 |
| Ex. 23 | L | 7.6 | 0.982 | 0.025 |
| Ex. 24 | M | 7.6 | 0.982 | 0.025 |
| Comp. Ex. 7 | N | 7.6 | 0.982 | 0.025 |
| Comp. Ex. 8 | O | 7.6 | 0.982 | 0.025 |
| Comp. Ex. 9 | P | 7.6 | 0.982 | 0.030 |
| Comp. Ex. 10 | Q | 7.2 | 0.972 | 0.045 |
| Comp. Ex. 11 | R | 8.4 | 0.952 | 0.030 |

The above-prepared Toners A–R were evaluated by using an electrophotographic apparatus having a structure a shown in FIGS. 6 and 7 obtained by remodeling a commercially available laser beam printer ("LBP-860", mfd. by Canon K.K.) in the following manner.

The process speed was changed to 60 mm/sec. The charging system was changed to one of a contact charging scheme 117 using a rubber roller 117*a* supplied with a DC voltage of −1200 volts.

The developing unit in the process cartridge was remodeled by replacing the toner-carrying member of a stainless steel sleeve with a toner-carrying member 104 of a medium-resistivity rubber roller (with a diameter of 16 mm, an Asker-C hardness of 45 deg., a resistivity of $10^5$ ohm.cm) formed of silicone rubber with carbon black dispersed therein, disposed so as to be abutted against the photosensitive member. The developing nip width was set to ca. 3 mm. The toner-carrying member was rotated in the same surface-moving direction as the photosensitive member at the developing position at a circumferential speed which was 140% of that of the photosensitive member.

The photosensitive member 100 was formed by coating an Al cylinder (of 30 mm in diameter and 254 mm in length) with the following layers successively by dipping:

(1) a 15 μm-thick electroconductive coating layer of a phenolic resin with tin oxide and titanium oxide powder dispersed therein, (2) a 0.6 μm-thick undercoating layer formed principally of modified nylon and copolymer nylon, (3) a 0.6 μm-thick charge generation layer of butyral resin containing a titanyl phthalocyanine pigment having an absorption band in a long-wavelength region dispersed therein, (4) a 20 μm-thick charge transport layer of a polycarbonate resin (having a molecular weight of $2\times10^4$ as measured according to the Ostwald's method) containing a hole-transporting triphenylamine compound dissolved therein in 8 wt. parts per 10 wt. parts of the polycarbonate resin.

An application roller 141 of a foam urethane rubber was disposed within a developing device 140 as a means for applying a toner onto the toner-carrying member 104 and abutted against the toner-carrying member 104. The application roller 141 was supplied with a voltage of ca −150 volts. For controlling the toner coating layer in the toner-carrying member 104, a stainless steel blade 143 was disposed so as to apply a contact linear pressure of ca. 20 g/cm. A DC voltage of −450 volts was applied as a developing voltage. An outline of the thus-remodeled cartridge is shown in FIG. 7.

So as to be adapted to the above-remodeled process cartridge, the electrophotographic apparatus was remodeled and operated in the following manner with reference to FIG. 6.

The photosensitive member was uniformly charged by the DC-supplied roller charger 117. After the charging, the photosensitive member was exposed to imagewise laser light 123 to form an electrostatic latent image, which was developed by a toner by the developing device to form a toner image thereon. The toner image was then transferred onto a recording material 127 by a transfer roller supplied with a voltage of +700 volts.

The photosensitive member was charged at −580 volts as a dark-part potential and −150 volts as a light-part potential. The recording material 127 was plain paper of 75 g/m$^2$.

By using an image forming apparatus having the above-described organization, Toners A–R of Examples 12–24 and Comparative Examples 7–11 were subjected to a continuous image forming test on 7000 sheets in a normal temperature/normal humidity (23° C./65% RH) environment with respect to the following items.

Transfer Efficiency

Transfer residual toner remaining on the photosensitive member after formation and transfer of a solid black image is peeled off after application of an adhesive tape (an adhesive-applied Meyler (polyethylene terephthalate) tape) and applied on recording paper to measure a Macbeth reflective density at C, an identical adhesive tape is applied onto a transferred solid black toner image on a recording paper to measure a Macbeth reflection density at D, and an identical adhesive tape is applied onto blank recording paper to measure a Macbeth reflection density at E. The transfer efficiency TE (%) is approximately calculated according to the following formula:

$$TE\ (\%)=\{1-(C-E)/(D-E)\}\times 100$$

From the calculated value of TE, the transfer efficiency is evaluated according to the following standard:

A: TE≧96%

B: TE=92–95%

C: TE=88–91%

D: TE≦87%

Image Quality

The resultant images are evaluated according to the following standard:

A: Very good.

B: Good images with slight roughness.

C: Roughness observed but at a practically acceptable level.

D: Images with serious roughness.

Fog

Fog was measured by using a reflecto-densitometer ("REFLECTOMETER MODEL TC-6DS", available from Tokyo Denshoku K.K.) together with a green filter for black toner images (or a blue filter for yellow toner images used in Example 26 described later) to measure reflectances at white image portions near four corners and one middle part on an every 1000-th sheet of recording paper during continuous image formation on 7000 sheets, thereby obtaining an average reflectance (W2 %) at a white image portion on a recording paper after image formation and measure a reflectance (W1 %) of the recording paper before the image portion, whereby the fog F (%) is calculated from the following formula:

$$F\ (\%)=W1\ (\%)-W2\ (\%).$$

For evaluation at the initial stage of image formation is performed according to the following standard.

A: F≦3%

B:3%<F≦5%

C: F>5%

D: F value at each of the 5 points exceeds 5%.

Fog during the continuous image formation is performed according to the following standard.

A: F≦3% over an entire period of the continuous image formation.

B: F≦5% over an entire period of the continuous image formation.

C: F temporarily exceeds 5% during the continuous image formation.

D: F exceeds 5% for 50% or more of the continuous image formation period.

The evaluation results are inclusively shown in Table 21.

TABLE 21

Image forming performance in continuous image formation test

| | | Initial stage | | | Final stage (or during the continuous test) | | |
|---|---|---|---|---|---|---|---|
| Ex. & Comp. Ex. | Toner | quality | fog | transfer efficiency | quality | fog | transfer efficiency |
| Ex. 12 | A | A | A | A | A | A | A |
| Ex. 13 | B | A | A | A | A | B | A |
| Ex. 14 | C | A | A | A | A | A | B |
| Ex. 15 | D | A | A | A | A | A | A |
| Ex. 16 | E | A | A | A | A | A | B |
| Ex. 17 | F | A | A | A | A | B | A |
| Ex. 18 | G | A | A | A | A | C | B |
| Ex. 19 | H | A | A | B | A | A | B |
| Ex. 20 | I | A | A | A | A | B | B |
| Ex. 21 | J | A | A | A | A | B | B |
| Ex. 22 | K | A | B | B | A | B | B |
| Ex. 23 | L | A | A | A | A | B | C |
| Ex. 24 | M | B | B | B | B | C | C |
| Comp. Ex. 7 | N | A | B | B | C | C | D |
| Comp. Ex. 8 | O | A | B | B | B | C | D |
| Comp. Ex. 9 | P | A | B | B | B | C | D |
| Comp. Ex. 10 | Q | C | C | D | D | D | D |
| Comp. Ex. 11 | R | B | B | C | B | C | D |

Example 25

The continuous image forming test of Example 12 using Toner A was repeated after taking off the cleaning device 113 (FIG. 6).

The image forming performances were good (A) for all the six evaluation items in Table 21.

Example 26

Into a four-necked flask equipped with a high-speed stirrer ("TK-Homomixer", available from Tokushu Kika Kogyo K.K.), 910 wt. parts of deionized water and 450 wt. parts of 1 mol/liter-$Na_2PO_4$ aqueous solution were placed and warmed to 55° C. under stirring at 12000 rpm. To the system, 68 wt. parts of 1.0 mol/liter-$CaCl_2$ aqueous solution was gradually added to form an aqueous dispersion medium containing finely dispersed hardly water-soluble dispersion stabilizer $Ca_3(PO_4)_2$.

| | |
|---|---|
| Styrene monomer | 160 wt. parts |
| n-Butyl acrylate | 40 wt. parts |
| Yellow pigment | 20 wt. parts |
| Release agent | 30 wt. parts |
| Polyester | 20 wt. parts |
| Amorphous dialkylsalicylic acid aluminum complex compound A | 2 wt. parts |

The above ingredients were dispersed for 3 hours by an attritor, and 4 wt. parts of 2,2'-azobis(2,4-dimethylvaleronitrile) (polymerization initiator) was added thereto to form a polymerizable monomer composition, which was then dispersed into the above-prepared aqueous dispersion medium under the identical stirring speed for 10 min. to form monomer droplets therein. Then, the high-speed stirrer was replaced by a propeller blade stirrer, and then polymerization was performed at 200 rpm, first at 60° C. for 5 hours and then at 80° C. for 5 hours.

After the polymerization, the slurry was cooled, and dilute hydrochloric acid was added thereto to remove the dispersion stabilizer.

The polymerizate was further washed and dried to obtain Yellow toner particles S (D4=7.2 μm, $\overline{C}$=0.979 and SDc=0.030).

100 wt. parts of the thus-obtained Yellow toner particles S and 0.05 wt. part of amorphous dialkyl salicylic acid aluminum complex compound A were blended at a temperature below 45° C. for 5 min. in a Henschell mixer at a blade peripheral speed of 50 m/sec, and then 1.5 wt. parts of hydrophobized silica (Dav=10 nm) and 0.5 wt. part of hydrophobized silica (Dav=0.04 μm) were externally added thereto to obtain Yellow toner S, which exhibited a weight-average particle size ($D_4$), an average circularity ($\overline{C}$) and a circularity standard deviation (SDc) inclusively shown in Table 22 together with those of the following Comparative Example 12.

As a result of the SEM observation in the same manner as in Example 12, Toner S before the external addition of two types silica particles exhibited the presence in a non-particle state of and a uniform coverage with the amorphous dialkylsalicylic acid Al compound A on the toner particle surfaces.

Comparative Example 12

Toner T was prepared in the same manner as in Example 26 except that the externally added dialkylsalicylic acid aluminum complex compound A was replaced by crystalline alkylsalicylic acid zinc compound B.

TABLE 22

| Toner properties | | | | |
|---|---|---|---|---|
| Ex. & Comp. Ex. | Toner | D4 (μm) | $\overline{C}$ (–) | SDc (–) |
| Ex. 26 | S | 7.2 | 0.979 | 0.030 |
| Comp Ex. 12 | T | 7.2 | 0.979 | 0.030 |

Toners S and T were evaluated by using an image forming apparatus obtained by remodeling a full-color image forming machine ("LBP-2040", mfd. by Canon K.K.) having an organization as shown in FIG. 4 so as to allow a contact development as explained in Example 12, and a continuous image forming test on 3000 sheets was performed in a normal temperature/normal humidity (23° C./65% RH) environment.

The evaluation items were similar to those in Example 12 except that a primary transfer efficiency TE1 (%) for transfer from the photosensitive member to the intermediate transfer member and a secondary transfer efficiency TE2 (%) for transfer from the intermediate transfer member to the recording paper were evaluated instead of the transfer efficiency for transfer from the photosensitive member to the recording paper based on measured values of F: Macbeth reflection density of a residual toner remaining on the photosensitive member after formation and transfer of a solid image peeled off by an adhesive tape and applied on a recording paper, G: Macbeth reflection density of a solid toner image on the intermediate transfer member before the secondary transfer, H: Macbeth reflection density of a residual toner before the secondary transfer peeled off by an adhesive tape and applied on a recording paper, I: Macbeth reflection density of a solid toner image on a recording paper after the secondary transfer and before fixation coated with the adhesive tape, and E: Macbeth reflection density of a recording paper before used coated with the adhesive tape. TE1 and TE2 are approximately calculated according to the following formulae:

$$TE1\ (\%)=\{1-(F-E)/(G-E)\}\times 100$$

$$TE2\ (\%)=\{1-(H-E)/(I-E)\}\times 100$$

The evaluation results are summarized in the following Table 23.

TABLE 23

| Image forming performance in continuous image formation test | | | | | | | | | |
|---|---|---|---|---|---|---|---|---|---|
| | | Initial stage | | | | Final stage (or during the continuous test) | | | |
| Ex. & Comp. | | | | transfer efficiency | | | | transfer efficiency | |
| Ex. | Toner | quality | fog | TE1 | TE2 | quality | fog | TE1 | TE2 |
| Ex. 26 | S | A | A | A | A | A | A | A | A |
| Comp. Ex. 12 | T | A | B | B | B | B | C | D | D |

What is claimed is:

1. A toner, comprising: toner particles each comprising at least a binder resin, a colorant and a release agent, and a low-crystalline aromatic metal compound present at surfaces of the toner particles;

wherein said toner has an average circularity of at least 0.955, and said low-crystalline aromatic metal compound has an X-ray diffraction characteristic free from peaks exhibiting a measurement intensity of at least 10000 cps and a half-value half-width of at most 0.3 deg. in a range of measurement angles 2θ of 6 to 40 deg.

2. The toner according to claim 1, wherein said low-crystalline aromatic metal compound is present at the toner particle surfaces in a proportion of 0.01–0.5 wt. part per 100 wt. parts of the toner particles.

3. The toner according to claim 1, wherein said low-crystalline aromatic metal compound is present at the toner particle surfaces in a proportion of 0.01–0.3 wt. part per 100 wt. parts of the toner particles.

4. The toner according to claim 1, wherein said low-crystalline aromatic metal compound is present at the toner particle surfaces in a form of coating the toner particle surfaces.

5. The toner according to claim 1, wherein said low-crystalline aromatic metal compound comprises an aromatic hydroxycarboxylic acid metal compound.

6. The toner according to claim 5, wherein said aromatic hydroxycarboxylic acid metal compound has aluminum or zirconium as its central metal atom.

7. The toner according to claim 5, wherein said aromatic hydroxycarboxylic acid metal compound has aluminum as its central metal atom.

8. The toner according to claim 1, wherein said toner particles contain an aromatic metal compound internally added thereto.

9. The toner according to claim 8, wherein said toner particles contain 0.05–5 wt. parts of the aromatic metal compound internally added thereto per 100 wt. parts of the binder resin, and 0.01–0.5 wt. part of said low-crystalline aromatic metal compound is present at the toner particle surfaces per 100 wt.

10. The toner according to claim 8, wherein said toner particles contain 0.05–5 wt. parts of the aromatic metal compound internally added thereto per 100 wt. parts of the binder resin, and 0.01–0.3 wt. part of said low-crystalline aromatic metal compound is present at the toner particle surfaces per 100 wt. parts of the toner particles.

11. The toner according to claim 1, wherein the toner has an average circularity of 0.955–0.990.

12. The toner according to claim 1, wherein the toner has an average circularity of 0.960–0.990.

13. The toner according to claim 1, wherein the toner has an average circularity of 0.960–0.985.

14. The toner according to claim 1, wherein the toner has a standard deviation of circularity of below 0.04.

15. The toner according to claim 1, wherein the toner has a weight-average particle size of 4–9 $\mu$m.

16. The toner according to claim 1, wherein said toner further includes external additive particles in addition to the toner particles and the low-crystalline aromatic metal compound present at the toner particle surfaces.

17. The toner according to claim 16, wherein the toner has been obtained by first blending under stirring the toner particles and the low-crystalline aromatic metal compound to form the toner particles carrying the low-crystalline aromatic metal compound at the surface thereof, and then blending the toner particles further with the external additive particles.

18. The toner according to claim 16, wherein said external additive particles include at least two species of particles having mutually different average particle sizes.

19. The toner according to claim 18, wherein at least one species of the external additive particles have an average particle size of 0.03–0.8 $\mu$m.

20. The toner according to claim 1, wherein said toner particles have been obtained by first melt-kneading toner ingredients including at least the binder resin, the colorant and the release agent, followed by cooling and pulverization to form particles having an average circularity of below 0.955, and then subjecting the particles to a surface modification providing an enhanced circularity.

21. The toner according to claim 1, wherein said toner particles have been obtained by polymerizing a polymerizable monomer composition comprising at least a polymerizable monomer, a colorant and a release agent in an aqueous medium.

22. The toner according to claim 1, wherein the toner is used as a mono-component developer.

23. The toner according to claim 1, wherein the toner is blended with magnetic carrier particles to be used as a two-component developer.

24. An image forming method, comprising, at least:

a first developing step of developing a first electrostatic image held on an image bearing member with a first toner to form a first toner image on the image bearing member, a first transfer step of transferring the first toner image on the image bearing member onto a transfer member, a second developing step of developing a second electrostatic image held on the image bearing member with a second toner to form a second toner image on the image bearing member, and a second transfer step of transferring the second toner image on the image bearing member onto the transfer member already carrying the first toner image thereon; wherein at least said first toner comprises toner particles each comprising at least a binder resin, a colorant and a release agent, and a low-crystalline aromatic metal compound present at surfaces of the toner particles;

said first toner has an average circularity of at least 0.955, and said low-crystalline aromatic metal compound has an X-ray diffraction characteristic free from peaks exhibiting a measurement intensity of at least 10000 cps and a half-value half-width of at most 0.3 deg. in a range of measurement angles 2θ of 6 to 40 deg.

25. The method according to claim 24, wherein said low-crystalline aromatic metal compound is present at the toner particle surfaces in a proportion of 0.01–0.5 wt. part per 100 wt. parts of the toner particles.

26. The method according to claim 24, wherein said low-crystalline aromatic metal compound is present at the toner particle surfaces in a proportion of 0.01–0.3 wt. part per 100 wt. parts of the toner particles.

27. The method according to claim 24, wherein said low-crystalline aromatic metal compound is present at the toner particle surfaces in a form of coating the toner particle surfaces.

28. The method according to claim 24, wherein said low-crystalline aromatic metal compound comprises an aromatic hydroxycarboxylic acid metal compound.

29. The method according to claim 28, wherein said aromatic hydroxycarboxylic acid metal compound has aluminum or zirconium as its central metal atom.

30. The method according to claim 28, wherein said aromatic hydroxycarboxylic acid metal compound has aluminum as its central metal atom.

31. The method according to claim 24, wherein said toner particles contain an aromatic metal compound internally added thereto.

32. The method according to claim 31, wherein said toner particles contain 0.05–5 wt. parts of the aromatic metal compound internally added thereto per 100 wt. parts of the binder resin, and 0.01–0.5 wt. part of said low-crystalline aromatic metal compound is present at the toner particle surfaces per 100 wt. parts of the toner particles.

33. The method according to claim 31, wherein said toner particles contain 0.05–5 wt. parts of the aromatic metal compound internally added thereto per 100 wt. parts of the binder resin, and 0.01–0.3 wt. part of said low-crystalline aromatic metal compound is present at the toner particle surfaces per 100 wt. parts of the toner particles.

34. The method according to claim 24, wherein the first toner has an average circularity of 0.955–0.990.

35. The method according to claim 24, wherein the first toner has an average circularity of 0.960–0.990.

36. The method according to claim 24, wherein the first toner has an average circularity of 0.960–0.985.

37. The method according to claim 24, wherein the first toner has a standard deviation of circularity of below 0.04.

38. The method according to claim 24, wherein the first toner has a weight-average particle size of 4–9 μm.

39. The method according to claim 24, wherein said first toner further includes external additive particles in addition to the toner particles and the low-crystalline aromatic metal compound present at the toner particle surfaces.

40. The method according to claim 39, wherein the first toner has been obtained by first blending under stirring the toner particles and the low-crystalline aromatic metal compound to form the toner particles carrying the low-crystalline aromatic metal compound at the surface thereof, and then blending the toner particles further with the external additive particles.

41. The method according to claim 39, wherein said external additive particles include at least two species of particles having mutually different average particle sizes.

42. The method according to claim 41, wherein at least one species of the external additive particles have an average particle size of 0.03–0.8 μm.

43. The method according to claim 24, wherein said toner particles have been obtained by first melt-kneading toner ingredients including at least the binder resin, the colorant and the release agent, followed by cooling and pulverization to form particles having an average circularity of below 0.955, and then subjecting the particles to a surface modification providing an enhanced circularity.

44. The method according to claim 24, wherein said toner particles have been obtained by polymerizing a polymerizable monomer composition comprising at least a polymerizable monomer, a colorant and a release agent in an aqueous medium.

45. The method according to claim 24, the first electrostatic image is developed with the first toner according to a mono-component developing scheme to form the first toner image in the first developing step.

46. The method according to claim 24, the first electrostatic image is developed with the first toner in mixture with magnetic carrier particles according to a two-component developing scheme to form the first toner image in the first developing step.

47. The method according to claim 24, wherein said second toner comprises second toner particles each comprising at least a binder resin, a second colorant and a release agent, and a low-crystalline aromatic metal compound present at surfaces of the second toner particles;

wherein said second toner has an average circularity of at least 0.955, and said low-crystalline aromatic metal compound has an X-ray diffraction characteristic free from peaks exhibiting a measurement intensity of at least 10000 cps and a half-value half-width of at most 0.3 deg. in a range of measurement angles 2θ of 6 to 40 deg.

48. The method according to claim 24, further including:

a third developing step of developing a third electrostatic image held on the image bearing member with a third toner to form a third toner image on the image bearing member, and a third transfer step of transferring the third toner image on the image bearing member onto the transfer member already carrying the first and second toner images thereon.

49. The method according to claim 48, wherein said second toner comprises second toner particles each comprising at least a binder resin, a second colorant and a release agent, and a low-crystalline aromatic metal compound present at surfaces of the second toner particles;

said second toner has an average circularity of at least 0.955, and said low-crystalline aromatic metal compound has an X-ray diffraction characteristic free from peaks exhibiting a measurement intensity of at least 10000 cps and a half-value half-width of at most 0.3 deg. in a range of measurement angles 2θ of 6 to 40 deg.

50. The method according to claim 48, wherein said second toner comprises second toner particles each comprising at least a binder resin, a colorant and a release agent, and a low-crystalline aromatic metal compound present at surfaces of the second toner particles; said second toner has an average circularity of at least 0.955, and said low-crystalline aromatic metal compound has an X-ray diffraction characteristic free from peaks exhibiting a measurement intensity of at least 10000 cps and a half-value half-width of at most 0.3 deg. in a range of measurement angles 2θ of 6 to 40 deg.; and said third toner comprises third toner particles each comprising at least a binder resin, a third colorant and a release agent, and a low-crystalline aromatic metal compound present at surfaces of the third toner particles; said third toner has an average circularity of at least 0.955, and said low-crystalline aromatic metal compound has an X-ray diffraction characteristic free from peaks exhibiting a measurement intensity of at least 10000 cps and a half-value half-width of at most 0.3 deg. in a range of measurement angles 2θ of 6 to 40 deg.

51. The method according to claim 24, further including: a third developing step of developing a third electrostatic image held on the image bearing member with a third toner to form a third toner image on the image bearing member, a third transfer step of transferring the third toner image on the image bearing member onto the transfer member already carrying the first and second toner images thereon, a fourth developing step of developing a fourth electrostatic image held on the image bearing member with a fourth toner to form a fourth toner image on the image bearing member, and a fourth transfer step of transferring the fourth toner image on the image bearing member onto the transfer member already carrying the first to third toner images thereon.

52. The method according to claim 51, wherein said second toner comprises second toner particles each comprising at least a binder resin, a second colorant and a release agent, and a low-crystalline aromatic metal compound present at surfaces of the second toner particles;

said second toner has an average circularity of at least 0.955, and said low-crystalline aromatic metal compound has an X-ray diffraction characteristic free from peaks exhibiting a measurement intensity of at least 10000 cps and a half-value half-width of at most 0.3 deg. in a range of measurement angles 2θ of 6 to 40 deg.

53. The method according to claim 51, wherein said second toner comprises second toner particles each comprising at least a binder resin, a colorant and a release agent, and a low-crystalline aromatic metal compound present at surfaces of the second toner particles; said second toner has an average circularity of at least 0.955, and said low-crystalline aromatic metal compound has an X-ray diffraction characteristic free from peaks exhibiting a measurement intensity of at least 10000 cps and a half-value half-width of at most 0.3 deg. in a range of measurement angles 2θ of 6 to 40 deg.; and said third toner comprises third toner particles each comprising at least a binder resin, a third colorant and a release agent, and a low-crystalline aromatic metal compound present at surfaces of the third toner particles; said third toner has an average circularity of at least 0.955, and said low-crystalline aromatic metal compound has an X-ray diffraction characteristic free from peaks exhibiting a measurement intensity of at least 10000 cps and a half-value half-width of at most 0.3 deg. in a range of measurement angles 2θ of 6 to 40 deg.

54. The method according to claim 51, wherein said second toner comprises second toner particles each comprising at least a binder resin, a colorant and a release agent, and a low-crystalline aromatic metal compound present at surfaces of the second toner particles; said second toner has an average circularity of at least 0.955, and said low-crystalline aromatic metal compound has an X-ray diffraction characteristic free from peaks exhibiting a measurement intensity of at least 10000 cps and a half-value half-width of at most 0.3 deg. in a range of measurement angles 2θ of 6 to 40 deg.;

said third toner comprises third toner particles each comprising at least a binder resin, a third colorant and a release agent, and a low-crystalline aromatic metal compound present at surfaces of the third toner particles; said third toner has an average circularity of at least 0.955, and said low-crystalline aromatic metal compound has an X-ray diffraction characteristic free from peaks exhibiting a measurement intensity of at least 10000 cps and a half-value half-width of at most 0.3 deg. in a range of measurement angles 2θ of 6 to 40 deg.; and said fourth toner comprises fourth toner particles each comprising at least a binder resin, a fourth colorant and a release agent, and a low-crystalline aromatic metal compound present at surfaces of the fourth toner particles; said fourth toner has an average circularity of at least 0.955, and said low-crystalline aromatic metal compound has an X-ray diffraction characteristic free from peaks exhibiting a measurement intensity of at least 10000 cps and a half-value half-width of at most 0.3 deg. in a range of measurement angles 2θ of 6 to 40 deg.

55. The method according to claim 51, wherein said first to fourth toners are mutually different toners selected in an arbitrary order from the group consisting of a magenta toner, a cyan toner, a yellow toner and a black toner.

56. The method according to claim 24, wherein said transfer member is an intermediate transfer member, the first toner image on the image bearing member is primarily transferred onto the intermediate transfer member in the first transfer step, and the second toner image on the image bearing member is primarily transferred onto the intermediate transfer member already carrying the first toner image, and said image forming method further includes:

a secondary transfer step of transferring the first toner image and the second toner image on the intermediate transfer member inclusively onto a recording material, and a fixing step of fixing the first toner image and the second toner image onto the recording material.

57. The method according to claim 48, wherein said transfer member is an intermediate transfer member, the first toner image on the image bearing member is primarily transferred onto the intermediate transfer member in the first transfer step, the second toner image on the image bearing member is primarily transferred onto the intermediate transfer member already carrying the first toner image in the second transfer step, and the third toner image on the image bearing member is primarily transferred onto the intermediate transfer member already carrying the first and second toner images in the third transfer step, and said image forming method further includes:

a secondary transfer step of transferring the first to third toner images on the intermediate transfer member inclusively onto a recording material, and a fixing step of fixing the first to third toner images onto the recording material.

58. The method according to claim 51, wherein said transfer member is an intermediate transfer member, the first toner image on the image bearing member is primarily transferred onto the intermediate transfer member in the first transfer step, the second toner image on the image bearing member is primarily transferred onto the intermediate transfer member already carrying the first toner image in the second transfer step, the third toner image on the image bearing member is primarily transferred onto the intermediate transfer member already carrying the first and second toner images in the third transfer step, and the fourth toner image on the image bearing member is primarily transferred onto the intermediate transfer member already carrying the first to third toner images in the fourth transfer step, and said image forming method further includes:

a secondary transfer step of transferring the first to fourth toner images on the intermediate transfer member inclusively onto a recording material, and a fixing step of fixing the first to fourth toner images onto the recording material.

59. The method according to claim 24, wherein said transfer member is a recording material; the first toner image on the image bearing member is transferred onto the recording material held on a transfer drum in the first transfer step, and the second toner image on the image bearing ember is transferred onto the recording material held on the transfer drum and already carrying the first toner image in the second transfer step, and said image forming method further includes:

a step of separating the recording material carrying the first and second toner images from the transfer drum, and a fixing step of fixing the first and second toner images on the recording material.

60. The method according to claim 48, wherein said transfer member is a recording material; the first toner image on the image bearing member is transferred onto the recording material held on a transfer drum in the first transfer step, the second toner image on the image bearing ember is transferred onto the recording material held on the transfer drum and already carrying the first toner image in the second transfer step, and the third toner image on the image bearing member is transferred onto the recording material held on the transfer drum and already carrying the first and second toner images thereon in the third transfer step, and said image forming method further includes:

a step of separating the recording material carrying the first to third toner images from the transfer drum, and a fixing step of fixing the first to third toner images on the recording material.

61. The method according to claim 51, wherein said transfer member is a recording material; the first toner image on the image bearing member is transferred onto the recording material held on a transfer drum in the first transfer step, the second toner image on the image bearing ember is transferred onto the recording material held on the transfer drum and already carrying the first toner image in the second transfer step, the third toner image on the image bearing member is transferred onto the recording material held on the transfer drum and already carrying the first and second toner images thereon in the third transfer step, and the fourth toner image on the image bearing member is transferred onto the recording material held on the transfer drum and already carrying the first to third toner images thereon in the fourth transfer step, and said image forming method further includes:

a step of separating the recording material carrying the first to fourth toner images from the transfer drum, and a fixing step of fixing the first to fourth toner images on the recording material.

62. An image forming method, comprising, at least:

a charging step of charging an image bearing member;

an exposure step of exposing the charged image bearing member to image light to form an electrostatic latent image on the image member, a developing step of developing the electrostatic latent image on an image bearing member with a layer of a toner carried on a toner-carrying member in contact with the image bearing member to form a toner image on the image bearing member, and a transfer step of transferring the toner image on the image bearing member to a transfer member, wherein said toner comprises toner particles each comprising at least a binder resin, a colorant and a release agent, and a low-crystalline aromatic metal compound present at surfaces of the toner particles;

wherein said toner has an average circularity of at least 0.955, and said low-crystalline aromatic metal compound has an X-ray diffraction characteristic free from peaks exhibiting a measurement intensity of at least 10000 cps and a half-value half-width of at most 0.3 deg. in a range of measurement angles 2θ of 6 to 40 deg.

63. The method according to claim 62, wherein said low-crystalline aromatic metal compound is present at the toner particle surfaces in a proportion of 0.01–0.5 wt. part per 100 wt. parts of the toner particles.

64. The method according to claim 62, wherein said low-crystalline aromatic metal compound is present at the toner particle surfaces in a proportion of 0.01–0.3 wt. part per 100 wt. parts of the toner particles.

65. The method according to claim 62, wherein said low-crystalline aromatic metal compound is present at the toner particle surfaces in a form of coating the toner particle surfaces.

66. The method according to claim 62, wherein said low-crystalline aromatic metal compound comprises an aromatic hydroxycarboxylic acid metal compound.

67. The method according to claim 66, wherein said aromatic hydroxycarboxylic acid metal compound has aluminum or zirconium as its central metal atom.

68. The method according to claim 66, wherein said aromatic hydroxycarboxylic acid metal compound has aluminum as its central metal atom.

69. The method according to claim 62, wherein said toner particles contain an aromatic metal compound internally added thereto.

70. The method according to claim 69, wherein said toner particles contain 0.05–5 wt. parts of the aromatic metal compound internally added thereto per 100 wt. parts of the binder resin, and 0.01–0.5 wt. part of said low-crystalline aromatic metal compound is present at the toner particle surfaces per 100 wt. parts of the toner particles.

71. The method according to claim 69, wherein said toner particles contain 0.05–5 wt. parts of the aromatic metal compound internally added thereto per 100 wt. parts of the binder resin, and 0.01–0.3 wt. part of said low-crystalline aromatic metal compound is present at the toner particle surfaces per 100 wt. parts of the toner particles.

72. The method according to claim 62, wherein the toner has an average circularity of 0.955–0.990.

73. The method according to claim 62, wherein the toner has an average circularity of 0.960–0.990.

74. The method according to claim 62, wherein the toner has an average circularity of 0.960–0.985.

75. The method according to claim 62, wherein the toner has a standard deviation of circularity of below 0.04.

76. The method according to claim 62, wherein the toner has a weight-average particle size of 4–9 μm.

77. The method according to claim 62, wherein said toner further includes external additive particles in addition to the toner particles and the low-crystalline aromatic metal compound present at the toner particle surfaces.

78. The method according to claim 77, wherein the toner has been obtained by first blending under stirring the toner particles and the low-crystalline aromatic metal compound to form the toner particles carrying the low-crystalline aromatic metal compound at the surface thereof, and then blending the toner particles further with the external additive particles.

79. The method according to claim 77, wherein said external additive particles include at least two species of particles having mutually different average particle sizes.

80. The method according to claim 79, wherein at least one species of the external additive particles have an average particle size of 0.03–0.8 μm.

81. The method according to claim 62, wherein said toner particles have been obtained by first melt-kneading toner ingredients including at least the binder resin, the colorant and the release agent, followed by cooling and pulverization to form particles having an average circularity of below 0.955, and then subjecting the particles to a surface modification providing an enhanced circularity.

82. The method according to claim 62, wherein said toner particles have been obtained by polymerizing a polymerizable monomer composition comprising at least a polymerizable monomer, a colorant and a release agent in an aqueous medium.

83. The method according to claim 62, wherein the toner-carrying member is moved at a surface velocity which is 1.05–3.0 times that of the image bearing member in the developing step, and the toner-carrying member has a surface roughness Ra of at most 1.5 μm.

84. The method according to claim 62, wherein the image bearing member is charged in the charging step by means of a charging member which is disposed in contact with the image bearing member and supplied with an external voltage.

* * * * *

UNITED STATES PATENT AND TRADEMARK OFFICE

CERTIFICATE OF CORRECTION

PATENT NO. : 6,183,927 B1
DATED : February 6, 2001
INVENTOR(S) : Magome et al.

It is certified that error appears in the above-identified patent and that said Letters Patent is hereby corrected as shown below:

Title page,
Item [56], "01573 1/1984 (JP)." should read -- 015739 1/1984 (JP). --.

Column 5,
Line 25, "fund" should read -- found --.

Column 8,
Line 40, "prevention" should read -- preventing --.

Column 9,
Line 37, "is" should read -- are --.

Column 13,
Line 60, "cadmiun" should read -- cadmium --.

Column 14,
Line 43, "particle" should read -- particles --.

Column 15,
Line 66, "particle" should read -- particles --.

Column 18,
Line 9, "ethyl" should read -- methyl --.

Column 21,
Line 38, "outer 22" should read -- outer wall 22 --; and
Line 50, "outer 22" should read -- outer wall 22 --.

Column 24,
Line 8, "doe" should read -- does --.

Column 27,
Line 65, "e" should read -- be --.

UNITED STATES PATENT AND TRADEMARK OFFICE

CERTIFICATE OF CORRECTION

PATENT NO. : 6,183,927 B1
DATED : February 6, 2001
INVENTOR(S) : Magome et al.

It is certified that error appears in the above-identified patent and that said Letters Patent is hereby corrected as shown below:

Column 28,
Line 6, "provides" should read -- providing --.

Column 31,
Line 40, "was" should read -- were --.

Column 41,
Line 7, "for" should read -- are --.

Column 45,
Table 7, "Example 2" should read -- Example 5 --.

Column 47,
Table 9, "primary should read -- primary

| (%) | (%) |
|---|---|
| 90 | 91 |
| 92 | 92 |
| 91 | 91 |
| 88 | 88 |
| 91 | 91 |
| 92 | 92 |
| 92 | 92 |
| 89 | 89 |
| 88 | 88 |
| 91 | 91 |
| 92 | 92 |
| 91” | 91 --. |

UNITED STATES PATENT AND TRADEMARK OFFICE

CERTIFICATE OF CORRECTION

PATENT NO. : 6,183,927 B1
DATED : February 6, 2001
INVENTOR(S) : Magome et al.

It is certified that error appears in the above-identified patent and that said Letters Patent is hereby corrected as shown below:

Column 49,
Table 16, "density should read -- density

| | |
|---|---|
| 1.52 | 1.25 |
| 1.30 | 1.30 |
| 1.33 | 1.33 |
| 1.40 | 1.40 |
| 1.26 | 1.26 |
| 1.30 | 1.30 |
| 1.32 | 1.32 |
| 1.40 | 1.40 |
| 1.25 | 1.25 |
| 1.27 | 1.27 |
| 1.32 | 1.32 |
| 1.42" | 1.42 --. |

Column 53,
Line 67, "hydrophobilized" should read -- hydrophobized --.

Column 56,
Line 17, "a" (2nd occurrence) should read -- as --.

Column 61,
Line 17, "100 wt." should read -- 100 wt. parts of the toner particles. --.

Signed and Sealed this

Thirtieth Day of July, 2002

*Attest:*

*Attesting Officer*

JAMES E. ROGAN
*Director of the United States Patent and Trademark Office*